US012654975B2

(12) United States Patent
Fukuchi et al.

(10) Patent No.: US 12,654,975 B2
(45) Date of Patent: Jun. 16, 2026

(54) MEDIUM PROCESSING APPARATUS AND IMAGE FORMING SYSTEM INCORPORATING SAME

(71) Applicants: Kensuke Fukuchi, Kanagawa (JP); Jun Saito, Kanagawa (JP); Yasushi Tsuruoka, Kanagawa (JP); Shohei Saito, Kanagawa (JP); Kei Sasaki, Kanagawa (JP); Keisuke Sugiyama, Kanagawa (JP)

(72) Inventors: Kensuke Fukuchi, Kanagawa (JP); Jun Saito, Kanagawa (JP); Yasushi Tsuruoka, Kanagawa (JP); Shohei Saito, Kanagawa (JP); Kei Sasaki, Kanagawa (JP); Keisuke Sugiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 224 days.

(21) Appl. No.: 18/612,207

(22) Filed: Mar. 21, 2024

(65) Prior Publication Data

US 2024/0317536 A1 Sep. 26, 2024

(30) Foreign Application Priority Data

Mar. 22, 2023 (JP) ..... 2023-045284
Feb. 13, 2024 (JP) ..... 2024-019699

(51) Int. Cl.
*B65H 37/04* (2006.01)

(52) U.S. Cl.
CPC ... *B65H 37/04* (2013.01); *B65H 2301/51616* (2013.01)

(58) Field of Classification Search
CPC . B42C 1/12; B65H 37/04; B65H 2301/51611; B65H 2301/51616;

(Continued)

(56) References Cited

U.S. PATENT DOCUMENTS 9,969,144 B1 * 5/2018 Awano ..... B42B 5/00
10,087,034 B2 * 10/2018 Awano ..... G03G 15/6544

(Continued)

FOREIGN PATENT DOCUMENTS

CN 108928668 A 12/2018
CN 115385153 A 11/2022

(Continued)

OTHER PUBLICATIONS

U.S. Appl. No. 18/331,574, filed Jun. 8, 2023.

(Continued)

*Primary Examiner* — Leslie A Nicholson, III
(74) *Attorney, Agent, or Firm* — Harness, Dickey & Pierce, P.L.C.

(57) ABSTRACT

A medium processing apparatus includes a liquid applier, a binder, a mover, first and second rotators. The first rotator rotates the binder between a first inclined posture and a first parallel posture. The second rotator rotates the liquid applier between a second inclined posture and a second parallel posture, and includes a posture change assembly and a collision avoidance assembly. The posture change assembly changes the posture of the liquid applier from the second inclined or parallel posture to the second parallel or inclined posture at a posture changing position. The collision avoidance assembly allows the binder in the first inclined posture to pass a restriction position, and restricts the binder in the first parallel posture from passing through the restriction position. The binder reaches the restriction position before the liquid applier reaches the posture changing position.

9 Claims, 35 Drawing Sheets

(58) Field of Classification Search
CPC .... B65H 2301/5162; B65H 2301/5142; B65H 2301/43828; G03G 15/6544; G03G 2215/00852; G03G 2215/00864; G03G 2215/00827; B31F 1/07; B31F 1/36; B31F 5/001; B31F 5/02; B31F 2201/0754; B31F 2201/0784
USPC ..... 270/58.08
See application file for complete search history.

(56) References Cited

U.S. PATENT DOCUMENTS

| | | | | |
|---|---|---|---|---|
| 11,691,450 | B2 * | 7/2023 | Fukasawa | G03G 15/6547 270/58.08 |
| 11,868,073 | B2 * | 1/2024 | Sasaki | G03G 15/6544 |
| 11,987,468 | B2 * | 5/2024 | Suzuki | B65H 37/04 |
| 12,005,675 | B2 * | 6/2024 | Matsumoto | B31F 5/02 |
| 12,043,508 | B2 * | 7/2024 | Oikawa | B31F 1/36 |
| 12,214,984 | B2 * | 2/2025 | Akamatsu | B65H 37/04 |
| 12,365,560 | B2 * | 7/2025 | Sasaki | B65H 37/04 |
| 2014/0219747 | A1 | 8/2014 | Takahashi et al. | |
| 2018/0339484 | A1 | 11/2018 | Takahashi et al. | |
| 2018/0339485 | A1 | 11/2018 | Takahashi et al. | |
| 2022/0371849 | A1 | 11/2022 | Susaki | |
| 2022/0394145 | A1 | 12/2022 | Seto et al. | |
| 2023/0234322 | A1 | 7/2023 | Fukuchi et al. | |
| 2023/0234804 | A1 | 7/2023 | Suzuki et al. | |
| 2023/0241859 | A1 | 8/2023 | Saito et al. | |
| 2023/0271804 | A1 | 8/2023 | Abe et al. | |
| 2023/0294950 | A1 | 9/2023 | Ibuka et al. | |
| 2023/0399191 | A1 | 12/2023 | Akamatsu et al. | |

FOREIGN PATENT DOCUMENTS

| | | | |
|---|---|---|---|
| JP | 2015-166281 | A | 9/2015 |
| JP | 6057167 | B2 | 1/2017 |
| JP | 2018-123007 | A | 8/2018 |
| JP | 2018-199245 | A | 12/2018 |
| JP | 2019-010810 | A | 1/2019 |
| JP | 2019-010811 | A | 1/2019 |

OTHER PUBLICATIONS

Extended European Search Report dated Sep. 18, 2024 issued in corresponding European Patent Application No. 24165137.1.
Chinese Office Action dated Apr. 18, 2026 issued in corresponding Chinese Patent Application No. CN202410296105.X.

* cited by examiner

MEDIUM PROCESSING APPARATUS AND IMAGE FORMING SYSTEM INCORPORATING SAME

CROSS-REFERENCE TO RELATED APPLICATIONS

This patent application is based on and claims priority pursuant to 35 U.S.C. § 119(a) to Japanese Patent Application Nos. 2023-045284, filed on Mar. 22, 2023, and 2024-019699, filed on Feb. 13, 2024, in the Japan Patent Office, the entire disclosure of each of which is hereby incorporated by reference herein.

BACKGROUND

Technical Field

Embodiments of the present disclosure relate to a medium processing apparatus and an image forming system incorporating the medium processing apparatus.

Background Art

Medium processing apparatuses are known in the related art that bind sheet-shaped media, on which images are formed by image forming apparatuses, into a bundle of media. Since sheets of paper are widely known as an example of the sheet-shaped media, a "sheet bundle" that is a bundle or stack of sheets of paper is used as an example of a bundle of sheet-shaped media in the following description. Some medium processing apparatuses include a crimper that can perform so-called "crimp binding" that presses and deforms a bundle of sheets by nipping the bundle of sheets with serrated binding teeth without using metal binding needles from a viewpoint of resource saving and reduction in environmental load.

An increased number of sheets of the sheet bundle hamper the binding teeth in biting into the sheet bundle and may cause some sheets to peel off from the bound sheets. Thus, the crimp binding has some difficulties in keeping the sheet bundle bound as appropriate. In order to increase the binding strength, some medium processing apparatuses that execute the crimp binding include a liquid applier that applies liquid in advance to a position on a sheet where the binding teeth contact the sheet, to allow the binding teeth to easily bite into a sheet bundle.

Some medium processing apparatuses can change the posture of the binder between a parallel binding posture that is parallel to the main scanning direction and an inclined binding posture that is inclined to the main scanning direction. In this case, to apply the liquid to the entire area of the binding position, it is desirable to change the posture of the liquid applier between a parallel application posture that is parallel to the parallel binding posture and an inclined application posture that is parallel to the inclined binding posture.

SUMMARY

Embodiments of the present disclosure described herein provide a novel medium processing apparatus includes a liquid applier, a binder, a mover, a first rotator, and a second rotator. The liquid applier applies liquid to a part of at least one medium conveyed in a conveyance direction. The binder is disposed adjacent to the liquid applier in a main scanning direction orthogonal to the conveyance direction to perform a given process on a bundle of media including the at least one medium on which the liquid is applied by the liquid applier. The mover causes the liquid applier and the binder to move between a first side and a second side in the main scanning direction along a surface of the at least one medium. The first rotator rotates the binder about a first shaft to change a posture of the binder between a first inclined posture in which a lateral direction of the binder is inclined to the main scanning direction and a first parallel posture in which the lateral direction of the binder is parallel to the main scanning direction. The second rotator rotates the liquid applier about a second shaft to change a posture of the liquid applier between a second inclined posture in which a lateral direction of the liquid applier is inclined to the main scanning direction and a second parallel posture in which the lateral direction of the liquid applier is parallel to the main scanning direction. The second rotator includes a posture change assembly and a collision avoidance assembly. The posture change assembly change the posture of the liquid applier from the second inclined posture to the second parallel posture at a posture changing position when the liquid applier moves toward the first side in the main scanning direction, and change the posture of the liquid applier from the second parallel posture to the second inclined posture at the posture changing position when the liquid applier moves toward the second side. The collision avoidance assembly allows the binder in the first inclined posture to pass a restriction position, and restricts the binder in the first parallel posture from passing through the restriction position. The binder reaches the restriction position before the liquid applier reaches the posture changing position.

Further, embodiments of the present disclosure described herein provide an image forming system including an image forming apparatus and the above-described medium processing apparatus. The image forming apparatus forms an image on a medium. The medium processing apparatus performs the given process on a bundle of media including the medium on which the image is formed by the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
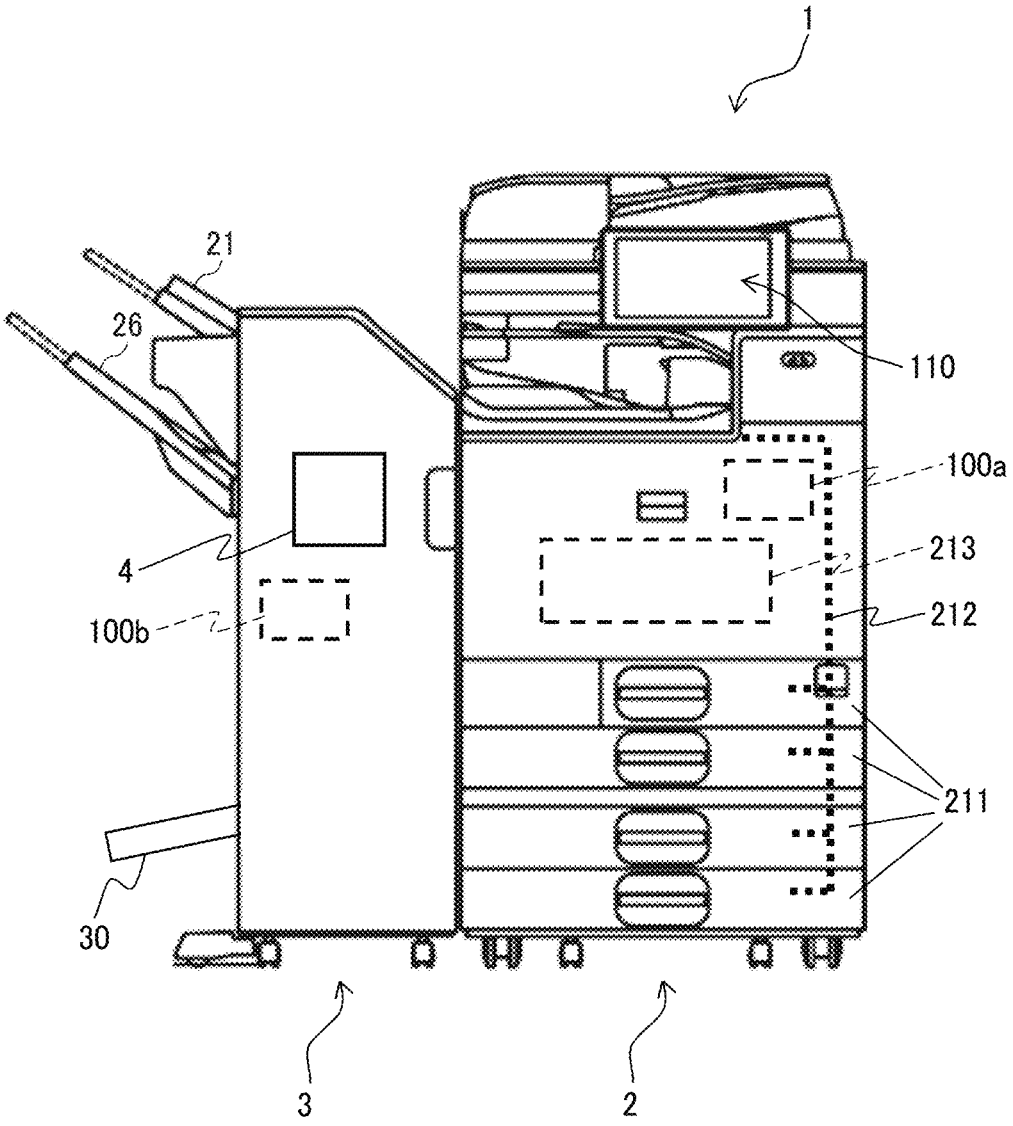
FIG. 1 is a diagram illustrating the overall configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiment of Image Forming System 1

A description is given of an image forming system 1 according to an embodiment of the present disclosure, with reference to the drawings.

FIG. 1 is a diagram illustrating an overall configuration of the image forming system 1.

The image forming system 1 has a function of forming an image on a sheet P as a sheet medium and a function of performing a post-processing operation on the sheet P as a process after the image is formed on the sheet P.

As illustrated in FIG. 1, the image forming system 1 includes an image forming apparatus 2 having the image forming function and a post-processing apparatus 3 serving as a medium processing apparatus having the post-processing function, according to an embodiment of the present disclosure. In the image forming system 1, the image forming apparatus 2 and the post-processing apparatus 3 operate in conjunction with each other.

In the present embodiment, the sheet-like medium to be processed in the image forming system 1 is described on the assumption that the medium is a sheet of "paper". The object to be processed according to the present embodiment is not limited to a paper. For example, any material or specification may be used as long as an image can be formed on a medium in a known image forming process and the medium is a target of the image forming process. The medium includes a medium which can be an object of the folding process or the binding process, and the material or the specification is not limited.

The image forming apparatus 2 forms an image on the sheet P and ejects the sheet P having the image to the post-processing apparatus 3. The image forming apparatus 2 includes a sheet tray 211 that accommodates the sheet P, a conveyor 212 that conveys the sheet P accommodated in the sheet tray 211, and an image former 213 that forms an image on the sheet P conveyed by the conveyor 212. The image former 213 may be an inkjet system that forms an image using ink or an electrophotographic system that forms an image using toner. The image forming apparatus 2 also includes a controller 100*a* that controls various operations of the conveyor 212 and the image former 213. Since the image forming apparatus 2 has a typical configuration, a detailed description of the configuration and functions of the image forming apparatus 2 are omitted.

Sheets of paper are widely known as an example of sheet-shaped media. Further, in the following description, a sheet-shaped medium as a medium to be processed is referred to as a "sheet P." Further, in the following description, a bundle of sheets of paper as a plurality of media is an example of a "sheet bundle Pb."

A description is given of the post-processing apparatus 3 according to a first embodiment of the present disclosure.

Figure 2:
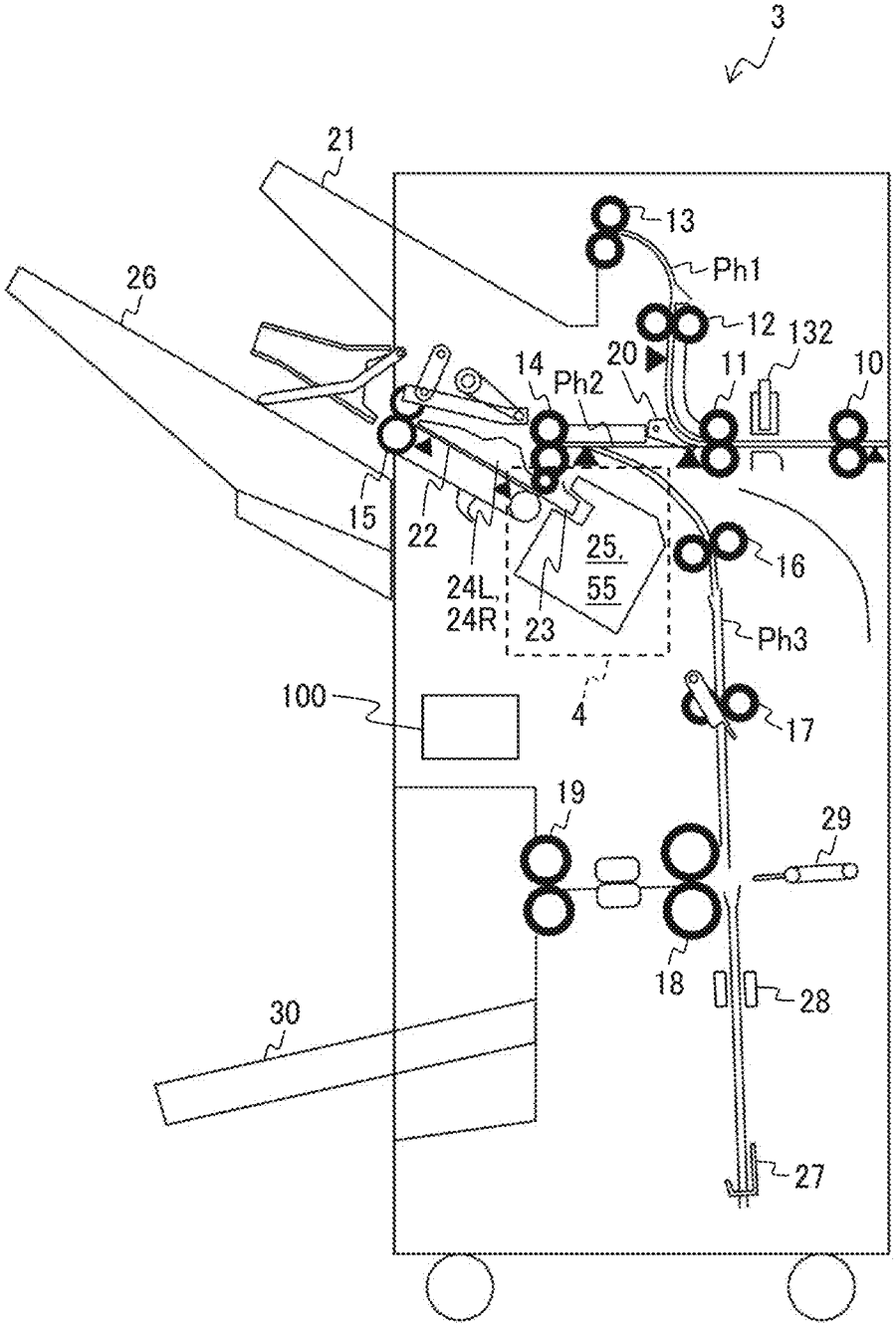
FIG. 2 is a diagram illustrating an internal configuration of a post-processing apparatus according to the present embodiment.

FIG. 2 is a diagram illustrating an internal configuration of the post-processing apparatus 3 according to the present embodiment of the present disclosure.

The post-processing apparatus 3 has a function that performs given post-processing on the sheet P on which an image is formed by the image forming apparatus 2. An example of the post-processing according to the present embodiment is a binding process as a "crimping process" that binds, without staples, multiple sheets P on each of which an image is formed as a bundle of sheets, which may be referred to as a sheet bundle. Another example of the post-processing according to the present embodiment is a binding process as a "stapling process" that binds, with staples, the multiple sheets P on each of which an image is formed as a bundle of sheets (i.e., sheet bundle). In the following description, the bundle of sheets may be referred to as a "sheet bundle Pb" as a bundle of media.

In the present embodiment, a description is typically given of liquid application in a crimp binding process. However, the liquid application related to a stapling process is similar to the liquid application in the crimp binding process. In the following description, the term "binding process" indicates both the "crimp binding process" and the "stapling process", and is not limited to a binding method (whether a binding needle is used or a pressing and deforming process is performed).

More specifically, the "crimp binding process" according to the present embodiment is a process called "crimp binding" to apply pressure to the binding position corresponding to a part of the sheet bundle Pb to deform (perform pressure deformation on) the binding position and bind the sheet bundle Pb. The binding that can be executed by the post-processing apparatus 3 includes edge binding and saddle binding. The edge binding is a process to bind an end (including an edge) of the sheet bundle Pb. The saddle binding is a process to bind the center of the sheet bundle Pb.

The post-processing apparatus 3 includes the conveyance roller pairs 10 to 19, each functioning as a conveyor, the switching member 20, and a controller 100*b* serving as a controller. The controller 100*b* controls the operations of, for example, the conveyance roller pairs 10 to 19 (conveyors), and the switching member 20. Details of the controller 100*b* will be described below. The conveyance roller pairs 10 to 19 convey, inside the post-processing apparatus 3, the sheet P supplied from the image forming apparatus 2. More specifically, the conveyance roller pairs 10 to 13 convey the sheet P along a first conveyance passage Ph1. The conveyance roller pairs 14 and 15 convey the sheet P along a second conveyance passage Ph2. The conveyance roller pairs 16 to 19 convey the sheet P along a third conveyance passage Ph3. A hole punch 132 is disposed between the conveyance roller pairs 10 and 11. The hole punch 132 performs punching on a sheet P conveyed by the conveyance roller pairs 10 and 11.

The first conveyance passage Ph1 is a passage extending to a first ejection tray 21 from a supply port through which the sheet P is supplied from the image forming apparatus 2. The second conveyance passage Ph2 is a passage branching from the first conveyance passage Ph1 between the conveyance roller pairs 11 and 14 in a conveyance direction and extending to a second ejection tray 26 via an internal tray 22. The third conveyance passage Ph3 is a passage that branches off from the first conveyance passage Ph1 between the conveyance roller pairs 11 and 14 in the sheet conveyance direction and reaches to a third ejection tray 30.

The switching members 20 each serving as a switcher are disposed at a branching position of the first conveyance passage Ph1 and the second conveyance passage Ph2. Each of the switching member 20 can change the position between a first position and a second position. The switching member 20 at the first position guides the sheet P to be ejected to the first ejection tray 21 through the first conveyance passage Ph1. The switching members 20 at the second position guides the sheet P conveyed through the first conveyance passage Ph1 to the second conveyance passage Ph2. When a trailing end of the sheet P entering the second conveyance passage Ph2 passes through the conveyance roller pair 11, the conveyance roller pair 14 is rotated in reverse to guide the sheet P to the third conveyance passage Ph3. The post-processing apparatus 3 further includes multiple sensors that detect the positions of the sheet P in the first conveyance passage Ph1, the second conveyance passage Ph2, and the third conveyance passage Ph3. Each of the multiple sensors is indicated by a black triangle in FIG. 2.

The post-processing apparatus 3 further includes the first ejection tray 21. The sheet P that is output through the first conveyance passage Ph1 is placed on the first ejection tray 21. Among the sheets P supplied from the image forming apparatus 2, a sheet P not subjected to the binding process is ejected to the first ejection tray 21.

The post-processing apparatus 3 further includes the internal tray 22 serving as a receptacle, an edge-binding end fence 23, side fences 24L and 24R, an edge binder 25, a staple binder 55, and the second ejection tray 26. The internal tray 22, the edge-binding end fence 23, the side fences 24L and 24R, the edge binder 25, and the staple binder 55 perform edge binding on the sheet bundle Pb including the multiple sheets P conveyed from the second conveyance passage Ph2 to the internal tray 22. Among the sheets P supplied from the image forming apparatus 2, the sheet bundle Pb subjected to the edge binding is ejected to the second ejection tray 26.

The "edge binding process" includes "parallel binding process," "oblique binding process," and "vertical binding process." The "parallel binding process" is a process of binding the sheet bundle Pb along one side of the sheet bundle Pb parallel to the main scanning direction. The "oblique binding process" is a process of binding a corner of the sheet bundle Pb. The "vertical binding process" is a process of binding the sheet bundle Pb along one side of the sheet bundle Pb parallel to the conveyance direction.

In the following description, a direction in which the sheet P is conveyed from the conveyance roller pair 15 toward the edge-binding end fence 23 is defined as a "conveyance direction." In other words, the "conveyance direction" herein corresponds to a direction in which the sheet P that has been output from the image forming apparatus 2 is moved toward the second ejection tray 26 by, for example, the conveyance roller pair 10, is changed to move toward the edge-binding end fence 23 by the conveyance roller pair 15 in a direction different from the above-described direction. The direction that is orthogonal to the conveyance direction and a thickness direction of the sheet P is defined as a "main scanning direction" or a "width direction of the sheet P."

The sheets P that are sequentially conveyed through the second conveyance passage Ph2 are temporarily placed on the internal tray 22 serving as a placement tray. The edge-binding end fence 23 aligns the position, in the conveyance direction, of the sheet P or the sheet bundle Pb placed on the internal tray 22. The side fences 24L and 24R align the position, in the main scanning direction, of the sheet P or the sheet bundle Pb placed on the internal tray 22. The edge binder 25 and the staple binder 155 perform edge binding on the sheet bundle Pb aligned by the edge-binding end fence 23 and the side fences 24L and 24R. Then, the conveyance roller pair 15 ejects the sheet bundle Pb subjected to the edge binding to the second ejection tray 26.

As illustrated in FIGS. 1 and 2, the post-processing apparatus 3 includes a door 4 on the side face of the housing. The door 4 moves, in other words, performs an open-close operation, between a closed position at which an opening in the side face of the housing of the post-processing apparatus 3 and an open position at which the opening is open. The door 4 is disposed at a position facing at least one of the internal tray 22, the edge-binding end fence 23, and the edge binder 25 in the main scanning direction. Due to such a configuration, the user can remove the sheet P jammed in the area around the internal tray 22, the edge-binding end fence 23, the edge binder 25, and the staple binder 55, in other words, perform a paper jam handling, by moving the door 4 to the open position.

Further, the user can supply or replenish liquid to a first liquid storage tank 43 by moving the door 4 to the open position. Further, for example, the first liquid storage tank 43 is detachably attached to a liquid applier 31. By so doing, the user can replace a first liquid storage tank 43 that is empty to another first liquid storage tank 43 that is replenished with liquid, by moving the door 4 to the open position. However, a configuration that is accessible to the area around the internal tray 22, the edge-binding end fence 23, the edge binder 25, and the staple binder 55 is not limited to the door 4.

The post-processing apparatus 3 further includes a center-fold-binding end fence 27, a saddle binder 28, a sheet folding blade 29, and the third ejection tray 30. The center-fold-binding end fence 27, the saddle binder 28, and the sheet folding blade 29 perform the saddle binding on the sheet bundle Pb including the sheets P that are conveyed through the third conveyance passage Ph3. Among the sheets P supplied from the image forming apparatus 2, the sheet bundle Pb subjected to the saddle binding is ejected to the third ejection tray 30.

The center-fold-binding end fence 27 aligns the positions of the sheets P that are sequentially conveyed through the third conveyance passage Ph3, in a conveyance direction in which the sheets P are conveyed. The center-fold-binding end fence 27 can move between a binding position where the center-fold-binding end fence 27 causes the center of the sheet bundle Pb to face the saddle binder 28 and a folding position where the center-fold-binding end fence 27 causes the center of the sheet bundle Pb to face the sheet folding blade 29. The saddle binder 28 binds the center of the sheet bundle Pb aligned by the center-fold-binding end fence 27 at the binding position. The sheet folding blade 29 folds, in half, the sheet bundle Pb placed on the center-fold-binding end fence 27 at the folding position and causes the conveyance roller pair 18 to nip the sheet bundle Pb. The conveyance roller pairs 18 and 19 eject the sheet bundle Pb subjected to the saddle binding to the third ejection tray 30.

A detailed description is given of the edge binder 25 according to an embodiment of the present disclosure.

Figure 3:
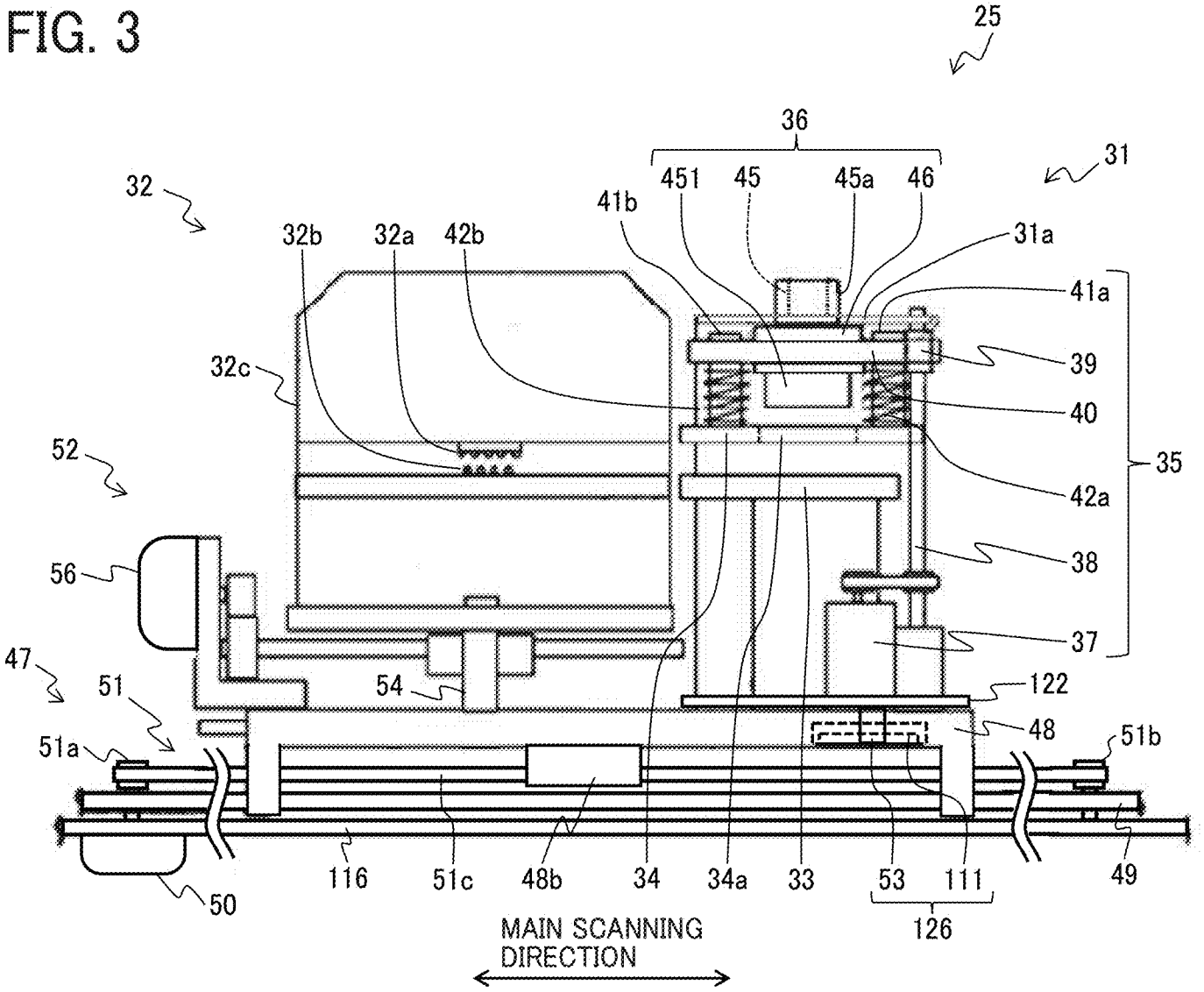
FIG. 3 is a schematic diagram illustrating a configuration of an edge binder according to an embodiment of the present disclosure, viewed from an upstream side in a conveyance direction of a sheet.

FIG. 3 is a schematic diagram illustrating the edge binder 25 that performs a liquid application process and a crimp binding process illustrated in FIG. 2, viewed from the upstream side in the conveyance direction of a sheet.

Figure 4:
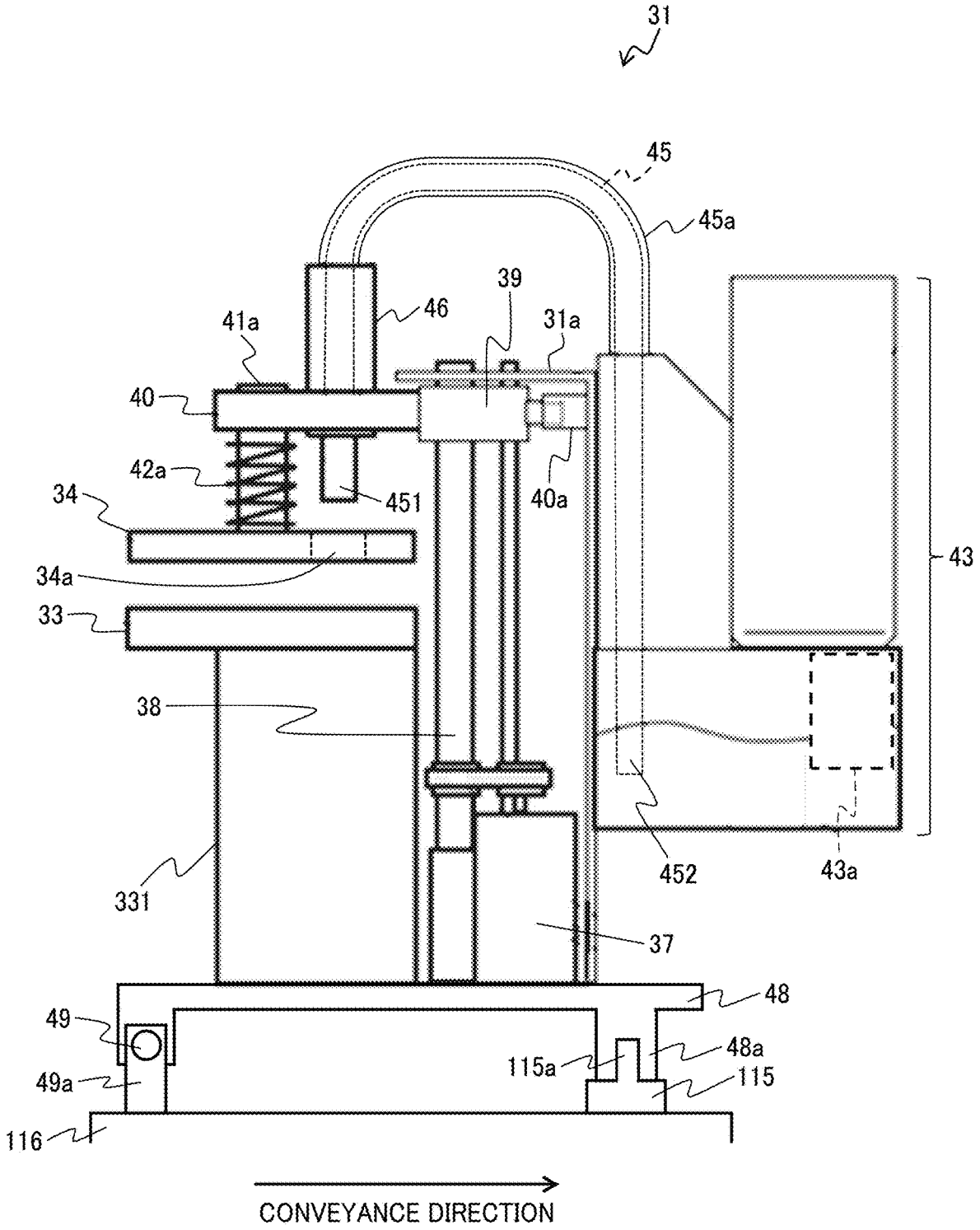
FIG. 4 is a schematic diagram illustrating the edge binder of FIG. 3, viewed from a liquid applier in a main scanning direction.

FIG. 4 is a schematic diagram illustrating a liquid applier 31 of the edge binder 25 when viewed from the main scanning direction.

As illustrated in FIG. 3, the edge binder 25 includes the liquid applier 31 that applies liquid to the sheets P, and a crimper 32 that is an example of a post-processing device and performs crimping binding on the sheet bundle Pb. The liquid applier 31 and the crimper 32 are disposed downstream from the internal tray 22 in the conveyance direction and adjacent to each other in the main scanning direction.

As illustrated in FIG. 4, the liquid applier 31 applies the liquid stored in the first liquid storage tank 43 (liquid storage) to the sheet P or the sheet bundle Pb placed on the internal tray 22. The application of the liquid to the sheet P or the sheet bundle Pb by the liquid applier 31 and the operation of the liquid applier 31 in applying the liquid are referred to as "liquid application" below. The liquid application of the liquid applier 31 involving control processing is referred to as a "liquid application process".

More specifically, the liquid that is stored in the first liquid storage tank 43 as liquid for the "liquid application" includes, as a main component, the liquid state of a compound of hydrogen and oxygen compound represented by the chemical formula $H_2O$. The liquid hydrogen-oxygen compound is at any temperature. For example, the liquid hydrogen-oxygen compound may be so-called warm water or hot water. The liquid hydrogen-oxygen compound is not limited to pure water. The liquid hydrogen-oxygen compound may be purified water or may contain ionized salts. The metal ion content ranges from so-called soft water to ultrahard water. In other words, the liquid hydrogen-oxygen compound is at any hardness.

The liquid that is stored in the first liquid storage tank 44 may include an additive in addition to the main component. The liquid that is stored in the first liquid storage tank 44 may include residual chlorine used as tap water. Preferably, for example, the liquid that is stored in the first liquid storage tank 44 may include, as an additive, a colorant, a penetrant, a pH adjuster, a preservative such as phenoxyethanol, a drying inhibitor such as glycerin, or a combination thereof. Furthermore, because water is used as a component of ink used for inkjet printers or ink used for water-based pens, such water or ink may be used for the "liquid application".

The water is not limited to the specific examples described above. The water may be water in a broad sense such as hypochlorous acid water or an ethanol aqueous solution diluted for disinfection. However, tap water may be used simply to enhance the binding strength after the binding process because tap water is easy to obtain and store. A liquid including water as a main component as exemplified above enhances the binding strength of the sheet bundle Pb, in comparison with a liquid of which the main component is not water (liquid).

As illustrated in FIGS. 3 and 4, the liquid applier 31 is movable in the main scanning direction together with the crimper 32 by a driving force transmitted from an edge binder movement motor 50. The liquid applier 31 includes a lower pressure plate 33 serving as a receptacle for the sheet P or the sheet bundle Pb, an upper pressure plate 34 (pressure unit), a liquid applier movement assembly 35, and a liquid application assembly 36.

The components of the liquid applier 31 such as the lower pressure plate 33, the upper pressure plate 34, the liquid applier movement assembly 35, the liquid application assembly 36, and the liquid applier movement motor 37 are held by a liquid application frame 31*a* and a base 48.

The lower pressure plate 33 and the upper pressure plate 34 are disposed downstream from the internal tray 22 in the conveyance direction. The sheets P or the sheet bundle Pb that is placed on the internal tray 22 is also placed on the lower pressure plate 33. The lower pressure plate 33 is provided on a lower pressure plate holder 331. The upper pressure plate 34 is movable in the thickness direction of the sheet P or the sheet bundle Pb at a position where the upper pressure plate 34 faces the sheet P or the sheet bundle Pb placed on the internal tray 22.

In other words, the lower pressure plate 33 and the upper pressure plate 34 are disposed to face each other in the thickness direction of the sheet P or the sheet bundle Pb with the sheet P or the sheet bundle Pb placed on the internal tray 22 and interposed between the lower pressure plate 33 and the upper pressure plate 34. In the following description, the thickness direction of the sheet P or the sheet bundle Pb may be referred to simply as "thickness direction." Further, the upper pressure plate 34 is provided with a through hole 34*a* passing through the upper pressure plate 34 in the thickness direction at a position opposite to the liquid application member 451 held via the joint 46 attached to the base plate 40. The liquid application member 451 is one end portion of a liquid supply member 45 (liquid absorber) described below and corresponds to a tip portion of the liquid supply member 45.

The liquid applier movement assembly 35 moves the upper pressure plate 34, the base plate 40, the joint 46, the liquid application member 451, and the liquid supply member 45 in the thickness direction of the sheet P or the sheet bundle Pb. The liquid applier movement assembly 35 according to the present embodiment moves the upper pressure plate 34, the base plate 40, the joint 46, the liquid application member 451, and the liquid supply member 45 in conjunction with each other with a single liquid applier movement motor 37. The liquid applier movement assembly 35 includes, for example, a liquid applier movement motor 37, a trapezoidal screw 38, a nut 39, the base plate 40, columns 41*a* and 41*b*, and coil springs 42*a* and 42*b*.

The liquid applier movement motor 37 generates driving force to move the upper pressure plate 34, the base plate 40, the joint 46, the liquid application member 451, and the liquid supply member 45. The trapezoidal screw 38 extends in the thickness direction of the sheet P or the sheet bundle Pb and is provided with the liquid application frame 31*a* such that the trapezoidal screw 38 is rotatable in the forward and reverse directions. The trapezoidal screw 38 is coupled to an output shaft of the liquid applier movement motor 37 via, for example, a pulley and a belt. The nut 39 is screwed to the trapezoidal screw 38. The trapezoidal screw 38 is rotated in the forward and reverse directions by the driving force transmitted from the liquid applier movement motor 37. The rotation of the trapezoidal screw 38 causes the nut 39 to reciprocate on the trapezoidal screw 38.

The base plate 40 is positioned apart from the upper pressure plate 34. The base plate 40 holds the liquid application member 451 with the tip portion of the liquid application member 451 protruding from the base plate 40 toward the upper pressure plate 34. The base plate 40 is coupled to the trapezoidal screw 38 via the nut 39 such that base plate 40 can reciprocate along the trapezoidal screw 38 as the trapezoidal screw 38 rotates in the forward and reverse directions. The position of the base plate 40 in the vertical direction is detected by a movement sensor 40*a* (see FIG. 14).

The columns 41*a* and 41*b* project from the base plate 40 toward the upper pressure plate 34 around the tip portion of the liquid application member 451. The columns 41*a* and 41*b* can relatively move with respect to the base plate 40 in the thickness direction. The columns 41*a* and 41*b* hold the upper pressure plate 34 with the respective tip ends closer to the lower pressure plate 33 than the other ends of the columns 41*a* and 41. The other ends of the columns 41*a* and 41*b* opposite the ends closer to the lower pressure plate 33 are provided with stoppers that prevent the columns 41*a* and 41*b* from being removed from the base plate 40.

The coil springs 42*a* and 42*b* are fitted around the columns 41*a* and 41*b*, respectively, between the base plate 40 and the upper pressure plate 34. The coil springs 42*a* and 42*b* bias the upper pressure plate 34 and the columns 41*a* and 41*b* toward the lower pressure plate 33 with respect to the base plate 40.

The liquid applier 31 applies liquid to the sheet P or the sheet bundle Pb placed on the internal tray 22. Specifically, the liquid applier 31 brings the liquid application member 451 into contact with the sheet P or the sheet bundle Pb to apply the liquid to at least one sheet P of the sheet bundle Pb. The liquid application assembly 36 serving as a part of the liquid applier 31 includes the liquid application member 451, the liquid supply member 45, the first liquid storage tank 43, and the joint 46.

The first liquid storage tank 43 stores the liquid to be supplied to the sheet P or the sheet bundle Pb. The liquid stored in the first liquid storage tank 43 is detected by a liquid level sensor 43*a* serving as a first liquid detector.

The liquid application member 451 applies the liquid stored in the first liquid storage tank 43 to the sheet P or the sheet bundle Pb. The liquid application member 451 is held by the base plate 40 with the tip portion of the liquid application member 451 facing the upper pressure plate 34. Further, the liquid application member 451 includes a material having a relatively high liquid absorption. For example, the liquid application member 451 includes an open cell foam that can contain liquid. The liquid application member 451 is not limited to a particular kind as long as the liquid application member 451 is made of a material having a property of absorbing and holding the liquid and has a property of being crushable in accordance with a pressing force applied when the liquid application member 451 is in contact with the sheet P. The pressing force corresponds to an amount of movement of the liquid application member 451 to the sheet P (or the sheet bundle Pb). For example, the liquid application member 451 may be a foam material such as a sponge or a fiber material that can absorb liquid by capillary action.

The liquid supply member 45 (liquid absorber) is an elongated member having a liquid immersion portion 452 at a base end (proximal end) immersed in the liquid stored in the first liquid storage tank 43 and a tip end (distal end) coupled to the liquid application member 451. Like the liquid application member 451, for example, the liquid supply member 45 is made of a material having a relatively high liquid absorption. As a result, the liquid absorbed from the liquid immersion portion 452 of the liquid supply member 45 is supplied to the liquid application member 451 by the capillary phenomenon. In other words, the liquid stored in the first liquid storage tank 43 is drawn up from the liquid immersion portion 452 of the liquid supply member 45, and the drawn liquid is supplied to the liquid application member 451 that is coupled to the tip portion via the liquid supply member 45.

As described above, the liquid drawn up from the liquid immersion portion 452 of the liquid supply member 45 is supplied to the liquid application member 451 through the liquid supply member 45. Then, the liquid application member 451 comes into contact with the uppermost surface of the sheet P or the sheet bundle Pb, and thus liquid application is performed. For this reason, the liquid application member 451 is supported by the base plate 40 with the tip end of the liquid application member 451 facing downward.

Although the case where the liquid application member 451 and the liquid supply member 45 are separate bodies has been described above, the liquid application member 451 and the liquid supply member 45 may be integrally formed of a material having the same properties (for example, a material having a high liquid absorption rate). In other words, the liquid application member 451 may be part of the liquid supply member 45. In such a case, liquid can be supplied from the liquid supply member 45 to the liquid application member 451 more smoothly by the capillary action.

A protector 45*a* is an elongated cylindrical body (e.g., a tube) that is fitted around the liquid supply member 45. Such a configuration prevents the liquid absorbed by the liquid supply member 45 from leaking or evaporating. Each of the liquid supply member 45 and the protector 45*a* is made of a flexible material. The joint 46 fixes the liquid application member 451 to the base plate 40. Accordingly, even when the liquid application member 451 is moved by the liquid applier movement assembly 35, the liquid application member 451 keeps projecting from the base plate 40 toward the upper pressure plate 34 with the tip portion of the liquid application member 451 facing the upper pressure plate 34.

In the liquid application process, the controller 100*b* controls the amount of movement (pressing amount) of the liquid application member 451 to the sheet P or the sheet bundle Pb by controlling the amount of driving force of the liquid applier movement motor 37. By controlling the amount of movement of the liquid application member 451 relative to the sheet P or the sheet bundle Pb, the size of the area (contact area) where the liquid application member 451 contacts the sheet P or the sheet bundle Pb or the contact time of the liquid application member 451 can be adjusted. With this adjustment, the amount of liquid applied to the sheet P or the sheet bundle Pb and the spread of the liquid in the liquid application process can be adjusted.

A description is given of the configuration of the crimper 32 according to an embodiment of the present disclosure.

The crimper 32 serving as a binder presses and deforms a portion of the sheet bundle Pb by serrated upper crimping teeth 32*a* and lower crimping teeth 32*b*, and crimps the sheets P of the portion to bind the sheet bundle Pb. In other words, the crimper 32 can bind the sheet bundle Pb without staples. The components of the crimper 32 such as the upper crimping teeth 32*a* and the lower crimping teeth 32*b* are disposed on a crimping frame 32*c*. The crimper 32 is an example of a binder that binds the binding position of a sheet bundle Pb by pressing and deforming the sheet bundle Pb. In the following description, such a way of pressing and deforming a given position on the sheet bundle Pb to bind the sheet bundle Pb may be referred to as "crimp binding." In other words, the crimper 32 crimps and binds the sheet bundle Pb or performs the crimp binding on the sheet bundle Pb. The crimping and binding operation of the crimper 32 that involves control processing is referred to as "crimp binding process". However, an example of the binder is not limited to the crimper 32 and may be a staple binder that causes a staple(s) to pass through the binding position(s) of the sheet bundle Pb (see FIGS. 12 and 13).

Figure 5A:
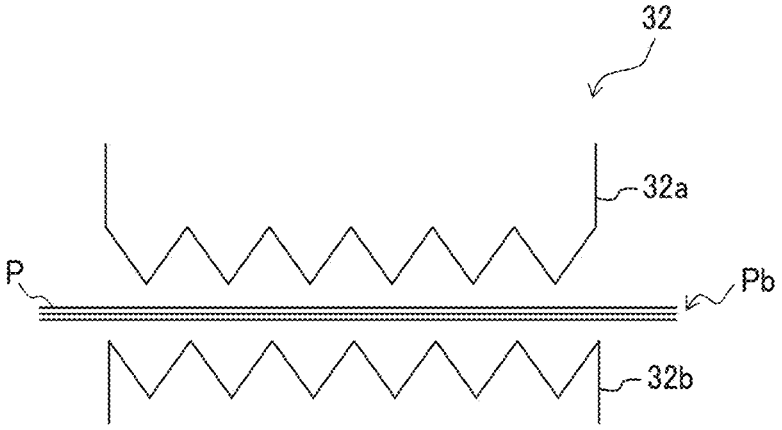
FIGS. 5A and 5B are diagrams each illustrating a schematic configuration of a crimper of the edge binder of FIG. 3.
Figure 5B:
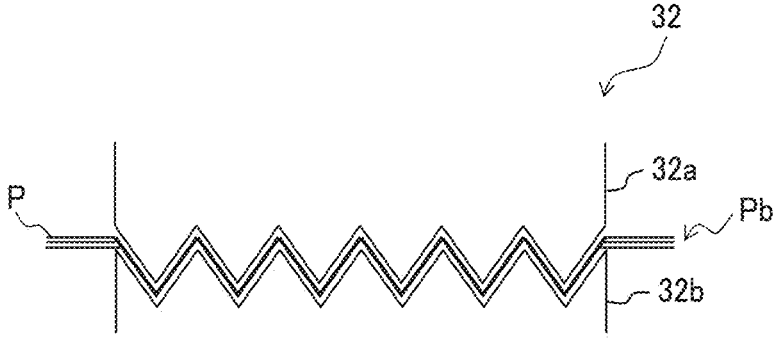

FIGS. 5A and 5B are schematic diagrams illustrating the configuration of the crimper 32.

As illustrated in FIGS. 5A and 5B, the crimper 32 includes the upper crimping teeth 32*a* and the lower crimping teeth 32*b*. The upper crimping teeth 32*a* and the lower crimping teeth 32*b* are disposed to face each other in the thickness direction of the sheet bundle Pb to sandwich the sheet bundle Pb placed on the internal tray 22. The upper crimping teeth 32*a* and the lower crimping teeth 32*b* have respective serrate faces facing each other. The serrate face of each of the upper crimping teeth 32*a* and the lower crimping teeth 32*b* includes concave portions and convex portions alternately formed.

The concave portions and the convex portions of the upper crimping teeth 32*a* are shifted from those of the lower crimping teeth 32*b* such that the upper crimping teeth 32*a* are engaged with the lower crimping teeth 32*b*. The upper crimping teeth 32*a* and the lower crimping teeth 32*b* are brought into contact with and separated from each other by the driving force of a contact-separation motor 32*d* illustrated in FIG. 14.

In the process of supplying the sheets P of the sheet bundle Pb to the internal tray 22, the upper crimping teeth 32*a* and the lower crimping teeth 32*b* are separated from each other as illustrated in FIG. 5A. When all the sheets P of the sheet bundle Pb are placed on the internal tray 22, the upper crimping teeth 32*a* and the lower crimping teeth 32*b* are engaged with each other as illustrated in FIG. 5B by the driving force of the contact-separation motor 32*d* to press and deform the sheet bundle Pb in the thickness direction. As a result, the sheet bundle Pb that has been placed on the internal tray 22 is crimped and bound. The sheet bundle Pb thus crimped and bound is ejected to the second ejection tray 26 by the conveyance roller pair 15.

The configuration of the crimper 32 as a crimping assembly is not limited to the configuration of a moving assembly exemplified in the present embodiment, and may be any other suitable structure in which the upper crimping teeth 32*a* and the lower crimping teeth 32*b* of the crimping assembly engage with each other. For example, the crimping assembly may bring the upper crimping teeth 32*a* and the lower crimping teeth 32*b* into contact with each other and separate the upper crimping teeth 32*a* and the lower crimping teeth 32*b* from each other with a link mechanism and a driving source that simply rotates in the forward direction or that rotates the forward and backward directions (e.g., the crimping assembly disclosed in Japanese Patent No. 6057167). Alternatively, the crimping assembly may employ a linear motion system to linearly bring the upper crimping teeth 32*a* and the lower crimping teeth 32*b* into contact with each other and separate the upper crimping teeth 32*a* and the lower crimping teeth 32*b* from each other with a screw assembly that converts the forward and backward rotational motions of a driving source into linear reciprocating motion.

As illustrated in FIG. 3, the edge binder 25 includes an edge binder movement assembly 47.

The edge binder movement assembly 47 moves the edge binder 25 (in other words, the liquid applier 31 and the crimper 32) in the main scanning direction along the downstream end of the sheet P, which is placed on the internal tray 22, in the conveyance direction. The edge binder movement assembly 47 includes, for example, the base 48, a guide shaft 49, the edge binder movement motor 50, and a driving force transmission assembly 51 that transmits the driving force of the edge binder movement motor 50 to the base 48, and a standby position sensor 540 (see FIG. 14).

The liquid applier 31 and the crimper 32 are attached to the base 48 such that the liquid applier 31 and the crimper 32 are adjacent to each other in the main scanning direction. As illustrated in FIG. 4, the guide shaft 49 is held by multiple guide shaft brackets 49*a* disposed in the main scanning direction at a position on the upstream side of a binding assembly base 116 in the conveyance direction of the sheet P. As illustrated in FIG. 3, the guide shaft 49 extends in the main scanning direction on the binding assembly base 116. The guide rail 115 is disposed in the main scanning direction on the downstream side of the binding assembly base 116 in the conveying direction of the sheet P. As illustrated in FIG. 4, the guide rail 115 includes a fitting target portion 115*a* that fits to a fitting portion 48*a* of the base 48 in the main scanning direction. In other words, the base 48 is movably held by the guide shaft 49 and the guide rail 115 in the main scanning direction on the binding assembly base 116.

The edge binder movement motor 50 generates a driving force to move the edge binder 25. The driving force transmission assembly 51 transmits the driving force of the edge binder movement motor 50 to the base 48 via pulleys 51*a* and 51*b*, a timing belt 51*c*, and a fastening portion 48*b* that fastens the base 48 and the timing belt 51*c*. As a result, the liquid applier 31 and the crimper 32 integrated by the base 48 move in the main scanning direction along the guide shaft 49.

The edge binder movement motor 50 according to the present embodiment is, for example, a servo motor that can stop the edge binder 25 at a target position (for example, the first binding position B1 and a second binding position B2 described below) without returning the edge binder 25 to an origin position (for example, a standby position HP described below) each time the edge binder 25 is moved.

Figure 16A:
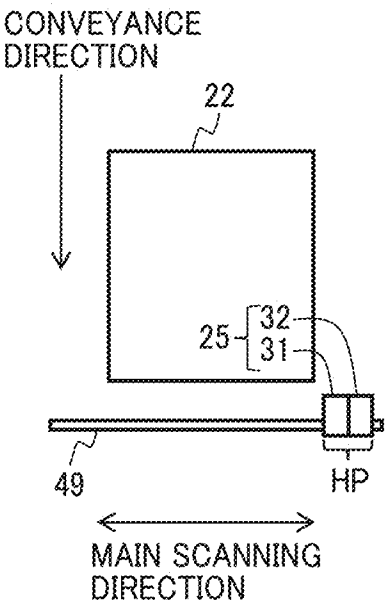
FIGS. 16A, 16B, 16C, and 16D are diagrams illustrating the positions of the edge binder during the operation of a one-point binding.
Figure 16B:
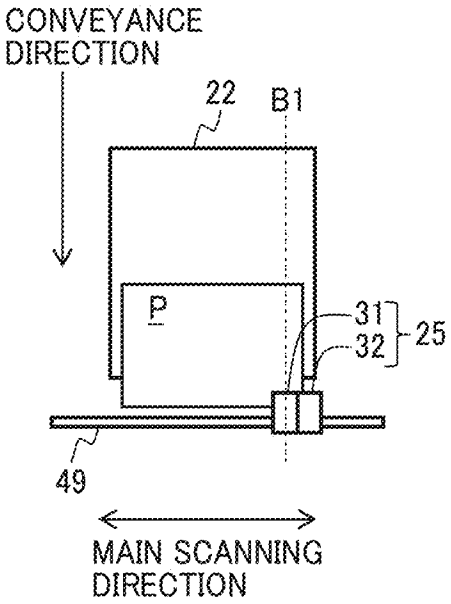

The post-processing apparatus 3 further includes a standby position sensor 44*a* and a first encoder sensor 44*b*. The standby position sensor 44*a* is, for example, a light-shielding optical sensor (see FIG. 14) to detect that the edge binder 25 has reached a standby position HP (see FIGS. 16A and 16D). The first encoder sensor 44*b* (see FIG. 14) is attached to an output shaft of the edge binder movement motor 50. The controller 100*b*, which will be described below, detects that the edge binder 25 has reached the standby position HP, based on the detection result of the standby position sensor 44*a*. The controller 100*b* also counts pulse signals output from the first encoder sensor 44*b* to ascertain the current position of the edge binder 25 moved from the standby position HP.

However, a specific method of stopping the edge binder 25 at the target position without returning the edge binder 25 to the standby position HP is not limited to the aforementioned example. As another example, the post-processing apparatus 3 may include a sensor that detects the arrival of the edge binder 25 at a given target position determined in advance.

Further, a crimper shaft 54 is fixed to a bottom face of the crimping frame 32*c* that holds the components of the crimper 32. The crimper shaft 54 is held by the base 48 on which the crimping frame 32*c* is disposed, so as to be rotatable in the forward and reverse directions. The crimper 32 can be rotated in the forward and reverse directions about the crimper shaft 54 on the base 48 by the driving force transmitted from the crimper pivot motor 56 to the crimper shaft 54.

As illustrated in FIG. 3, the crimper 32 includes a crimper pivot assembly 52. The crimper pivot assembly 52 rotates the crimper 32, which includes upper crimping teeth 32*a* and lower crimping teeth 32*b*, in the forward and reverse directions about the crimper shaft 54 extending in the thickness direction of the sheet P placed on the internal tray 22. The crimper pivot assembly 52 includes the crimper shaft 54 and the crimper pivot motor 56.

Further, the liquid applier 31 is made rotatable in the forward and reverse directions about a liquid applier shaft 53 extending in the thickness direction of the sheet P or the sheet bundle Pb placed on the internal tray 22. A posture changing lever 111, which is a component of a liquid applier pivot assembly 126 to be described below, is integrally attached to the liquid applier shaft 53.

In other words, the liquid applier shaft 53 and the crimper shaft 54 extend parallel to each other at positions apart from each other in the main scanning direction. The liquid applier shaft 53 rotatably supports the liquid application frame 31*a* and the liquid application base 122 in forward and reverse directions with respect to the base 48. The crimper shaft 54 rotatably supports the crimping frame 32*c* in forward and reverse directions with respect to the base 48.

The crimper pivot motor 56 generates a driving force to rotate the crimper 32 in the forward and reverse directions. The driving force of the crimper pivot motor 56 is transmitted to the crimper shaft 54 via a pulley and a timing belt. As a result, the crimping frame 32*c* is pivoted about the crimper shaft 54 in the forward and reverse directions together with the upper crimping teeth 32*a* and the lower crimping teeth 32*b*. The angle of rotation (posture) of the crimper 32 is ascertained by counting the pulse signals output from a second encoder sensor 44*c* (see FIG. 14) attached to the output shaft of the crimper pivot motor 56.

Figure 6:
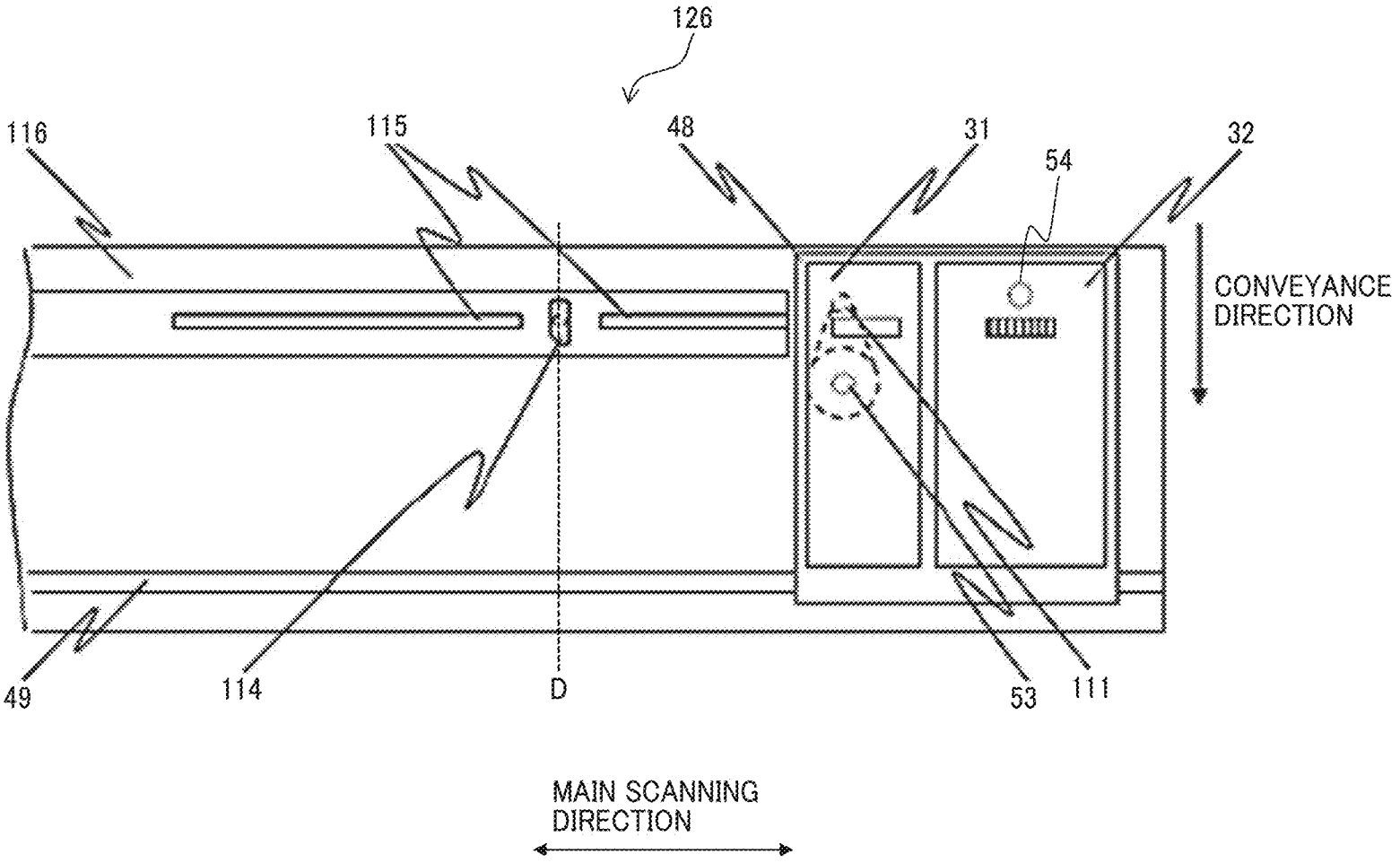
FIG. 6 is a diagram illustrating a liquid applier pivot assembly according to an embodiment of the present disclosure, viewed from the thickness direction of the sheet.
Figure 7:
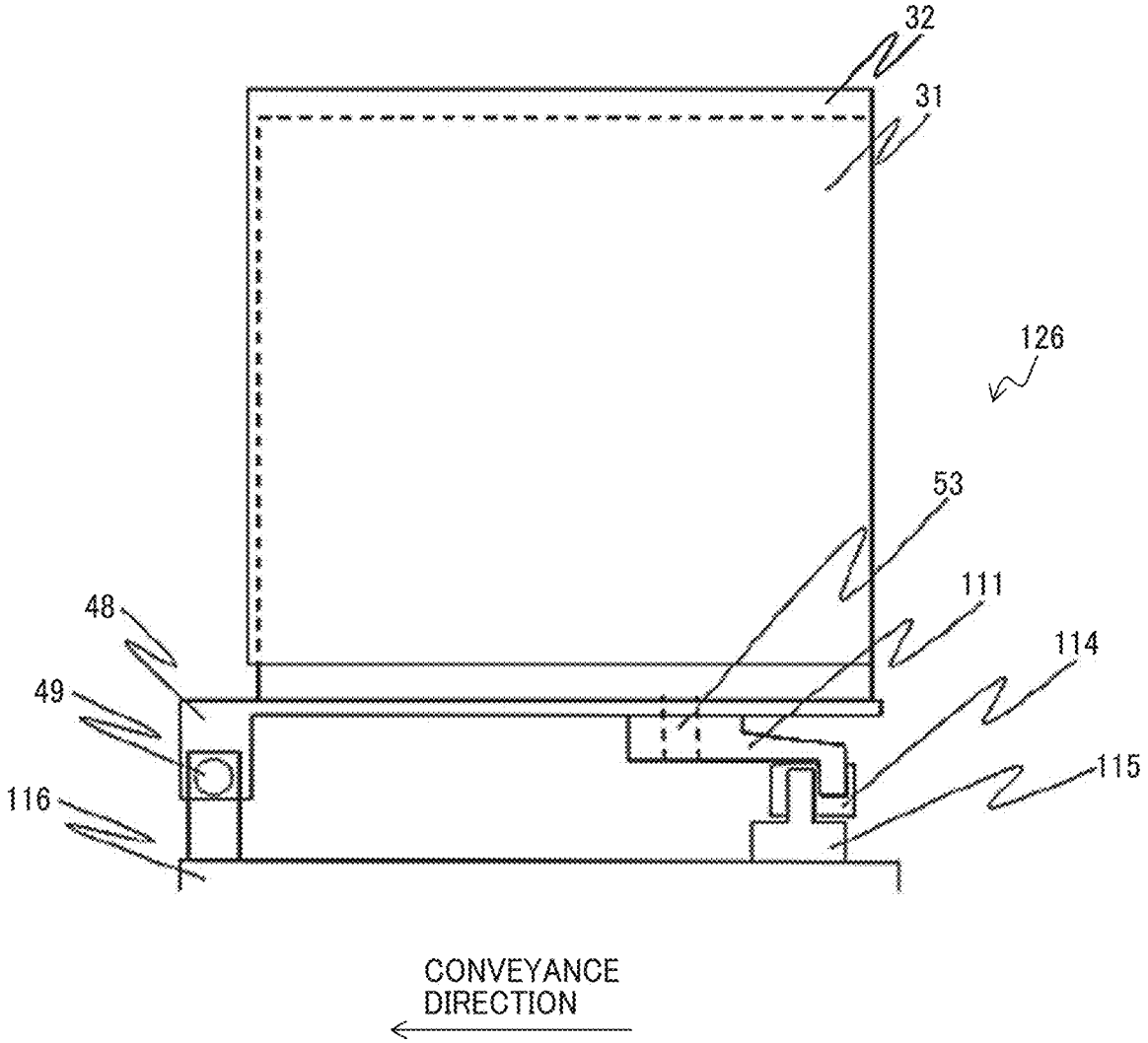
FIG. 7 is a schematic diagram illustrating the liquid applier pivot assembly, viewed in the main scanning direction.

FIGS. 6 and 7 are diagrams illustrating a liquid applier pivot assembly 126 that rotates the above-described liquid applier 31 in the forward and reverse directions.

The liquid applier pivot assembly 126 includes the liquid applier shaft 53 and a posture changing lever 111 that is rotatable in the forward and reverse directions with the liquid applier shaft 53 as a single unit. The liquid applier 31 and the crimper 32 are supported by the base 48. This base 48 is driven by the edge binder movement motor 50 to move in the main scanning direction on the binding assembly base 116 along the guide shaft 49. The binding assembly base 116 includes a posture changing member 114 and a guide rail 115.

The posture changing member 114 is rotatably attached to the binding assembly base 116 at an application posture changing position D in the main scanning direction. As the liquid applier 31 is driven by the edge binder movement motor 50 and moves in the main scanning direction via the base 48, the posture changing lever 111 is rotated.

The posture changing lever 111, the posture changing member 114, and the guide rail 115 are included in a liquid applier pivot assembly 126 that changes the posture of the liquid applier 31 along with the movement of the liquid applier 31 in the main scanning direction. The posture changing lever 111 is an example of a posture changing member that rotates with the liquid applier 31 as a single unit. The posture changing member 114 and the guide rail 115 are an example of a posture changing member that contacts the posture changing lever 111 and changes the posture of the posture changing lever 111 when the liquid applier 31 moves in the main scanning direction.

Figure 8A:
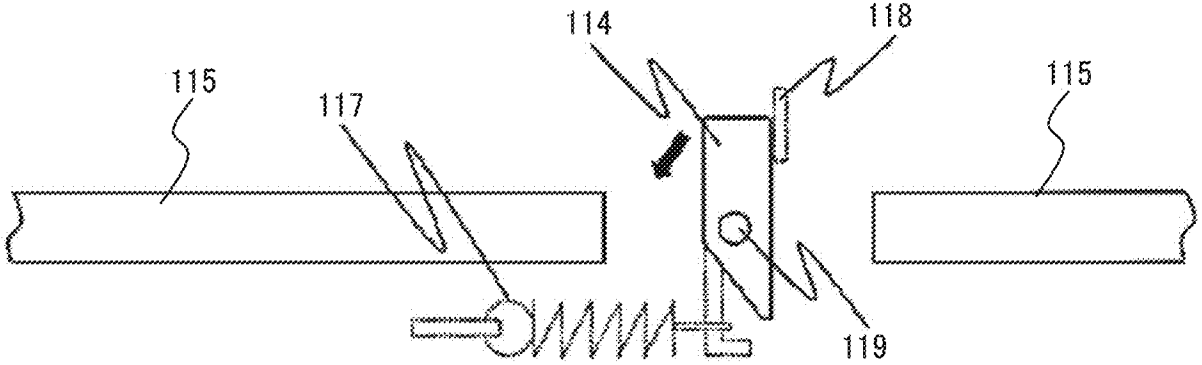
FIGS. 8A and 8B are diagrams each illustrating a configuration of a posture changing member disposed in a binding assembly base.
Figure 8B:
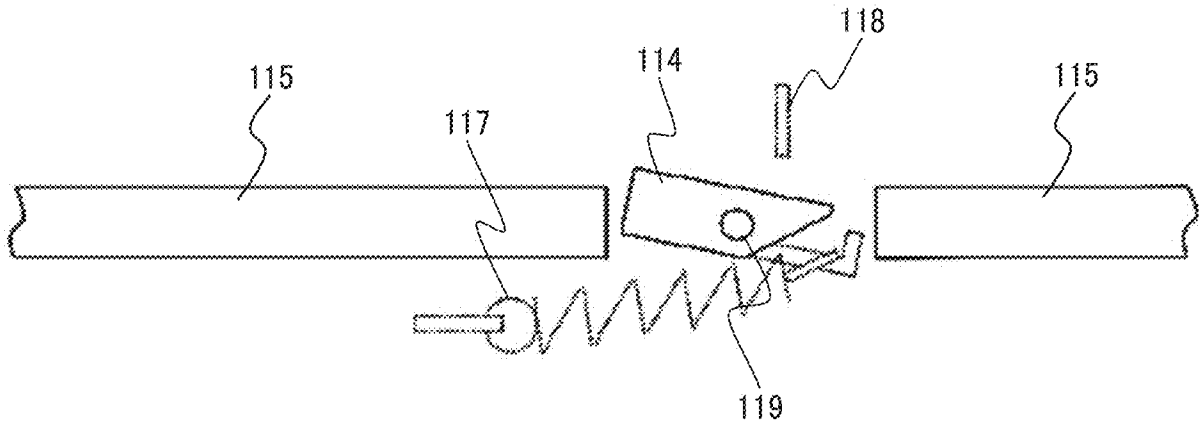
Figure 9A:
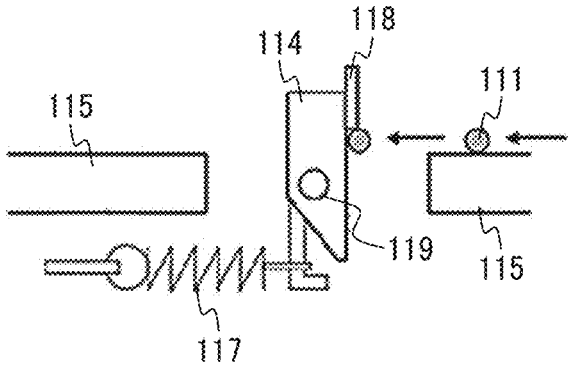
FIGS. 9A, 9B, 9C, 9D, 9E, and 9F are diagrams illustrating a series of operations of a posture changing lever by the posture changing member.
Figure 9B:
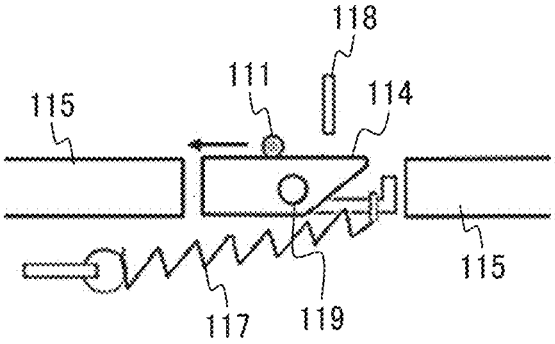
Figure 9C:
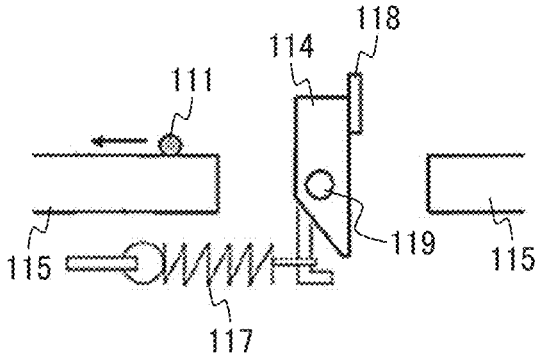
Figure 9D:
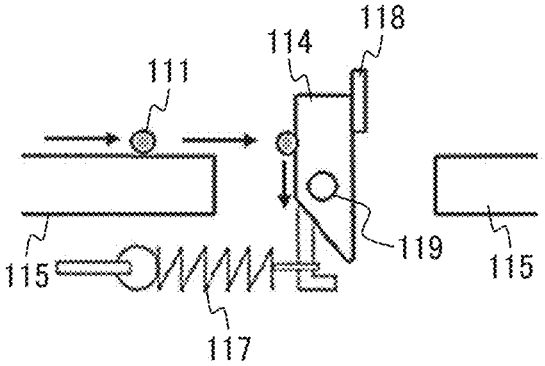
Figure 9E:
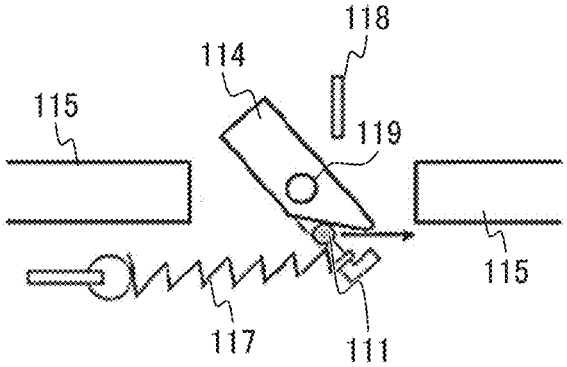
Figure 9F:
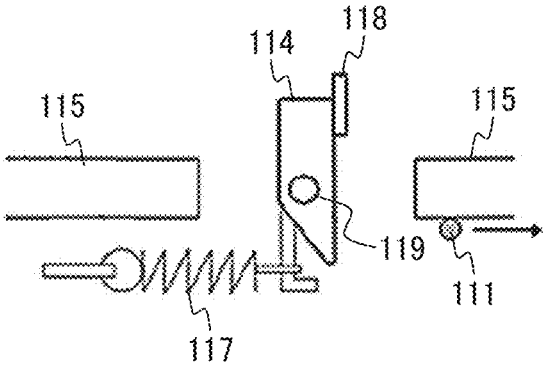

FIGS. 8A and 8B are diagrams each illustrating the configuration of the posture changing member 114 disposed on the binding assembly base 116.

FIGS. 9A, 9B, 9C, 9D, 9E, and 9F are diagrams illustrating a series of operations of the posture changing lever 111 by the posture changing member 114.

The posture changing member 114 is rotatably held by a posture changing member shaft 119 disposed on the binding assembly base 116. On the other hand, the posture changing member 114 has one end that is attached to the binding assembly base 116 and the other hand that is biased in one direction (the clockwise direction of the posture changing member shaft 119 in FIGS. 8A and 8B) by a biasing spring 117 that is attached to the posture changing member 114. A posture changing member stopper 118 is disposed on the binding assembly base 116. As illustrated in FIG. 8A, the posture changing member 114 is restricted to rotate in the clockwise direction and is allowed to rotate in the counterclockwise direction (i.e., a direction indicated by arrow A in FIG. 8A).

Figure 10A:
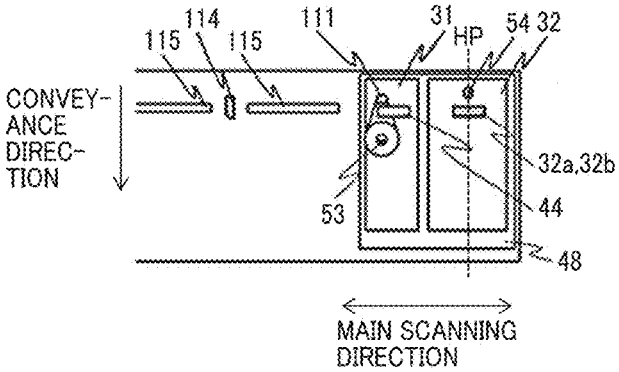
FIGS. 10A, 10B, 10C, 10D, 10E, 10F, 10G, and 10H are diagrams illustrating an operation procedure for changing the liquid applier to an inclined application posture.
Figure 10B:
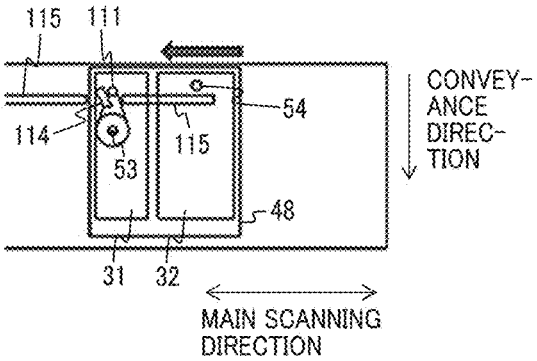
Figure 10C:
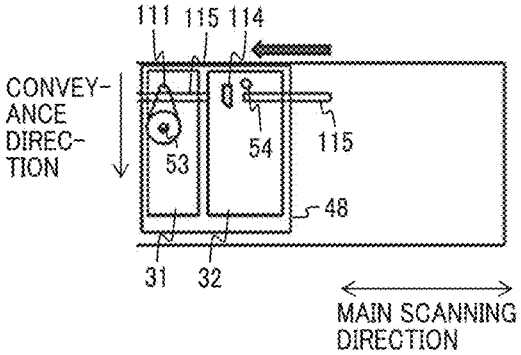
Figure 10D:
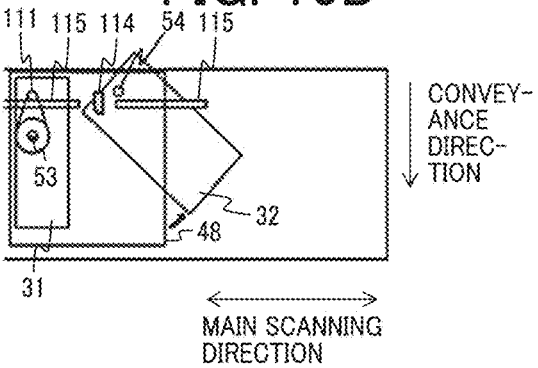
Figure 10E:
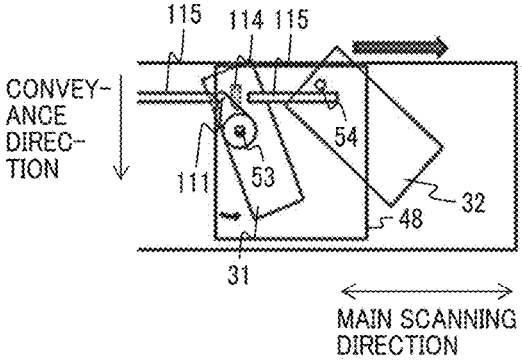
Figure 10F:
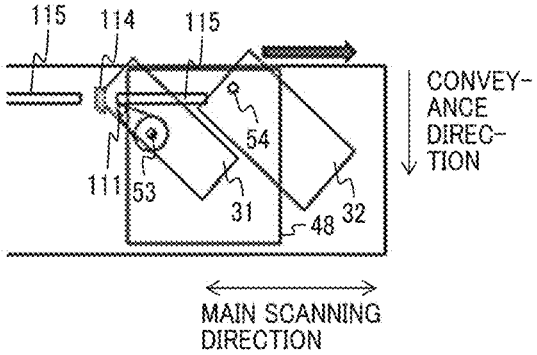
Figure 10G:
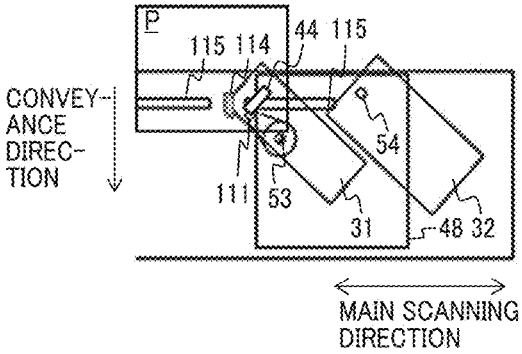

The liquid applier 31 can be changed or pivoted by the liquid applier pivot assembly 126 between a "parallel application posture" illustrated in FIGS. 10A, 10B, 10C, 10D, and 10H and an "inclined application posture" illustrated in FIGS. 10E, 10F, and 10G. The "parallel application posture" is a posture of the liquid applier 31 when the lateral direction of the liquid applier 31 (the longitudinal direction of the liquid application member 451) is in the main scanning direction. The "inclined application posture" is a posture of the liquid applier 31 when the lateral direction of the liquid applier 31 is inclined to the main scanning direction.

The crimper 32 can be changed or pivoted by the crimper pivot assembly 52 between a "parallel binding posture" illustrated in FIGS. 10A, 10B, and 10C and an "inclined binding posture" illustrated in FIGS. 10D, 10E, 10F, 10G, and 10H. The "parallel binding posture" is a posture of the crimper 32 when the lateral direction of the crimper 32 (the longitudinal direction of the upper crimping teeth 32*a* and the lower crimping teeth 32*b*) is in the main scanning direction. The "inclined binding posture" is a posture of the crimper 32 when the lateral direction of the crimper 32 is inclined to the main scanning direction.

The liquid application position of the liquid applier 31 in the parallel application posture and the binding position of the crimper 32 in the parallel binding posture have the longitudinal directions facing the same direction. Similarly, the liquid application position of the liquid applier 31 in the inclined application posture and the binding position of the crimper 32 in the inclined binding posture have the longitudinal directions facing the same direction. In other words, the liquid applier 31 and the crimper 32 rotate between the two postures by the same angle of rotation. The liquid application position of the liquid applier 31 in the parallel application posture and the binding position of the crimper 32 in the parallel binding posture are overlaid on one after another. Similarly, the liquid application position of the liquid applier 31 in the inclined application posture and the binding position of the crimper 32 in the inclined binding posture are overlaid on one after another.

FIGS. 10A, 10B, 10C, 10D, 10E, 10F, 10G, and 10H are diagrams illustrating the operation procedure for changing the crimper 32 and the liquid applier 31 to the "inclined application posture."

As illustrated in FIG. 10A, the crimper 32 and the liquid applier 31 are located at the standby position HP outside the sheet width area. The posture changing lever 111 is disposed upstream from the guide rail 115 in the conveyance direction of the sheet P. Then, as illustrated in FIG. 10B, the crimper 32 and the liquid applier 31 are moved in the left side direction (the direction in the arrow illustrated in FIG. 10B) while pushing and opening the posture changing member 114.

When the liquid applier 31 is changed to the inclined application posture, the edge binder movement motor 50 is driven to move the base 48 holding the crimper 32 and the liquid applier 31 to the left side direction. Since the rotation of the posture changing member 114 in the counterclockwise direction is not restricted, the posture changing lever 111 is pushed to climb over the posture changing member 114 (see FIGS. 9A and 9B).

Then, as illustrated in FIG. 10C, after the posture changing lever 111 has passed over the posture changing member 114, the driving of the edge binder movement motor 50 is stopped to temporarily stop the movement of the base 48 to the left side in the main scanning direction. At this time, the posture changing member 114 is biased by the biasing spring and returns to the rotation restricting posture (see FIG. 9C).

Then, as illustrated in FIG. 10D, the crimper pivot motor 56 generates a driving force to rotate the crimper 32 in the forward and reverse directions. The driving force of the crimper pivot motor 56 is transmitted to the crimper shaft 54 via pulleys and a timing belt. Due to such a configuration, the crimping frame 32*c* is rotated about the crimper shaft 54 with the upper crimping teeth 32*a* and the lower crimping teeth 32*b*. As a result, the crimper 32 changes the posture to the inclined binding posture.

Then, as illustrated in FIG. 10E, the base 48 holding the crimper 32 and the liquid applier 31 is moved to the right side (the direction indicated by arrow in FIG. 10E) in the main scanning direction. Even if the posture changing lever 111 contacts the posture changing member 114, the posture changing member 114 is restricted not to rotate in the clockwise direction. Due to such a configuration, even if the base 48 is moved to the right side direction, the posture changing lever 111 is not allowed to move in the right side and starts to rotate to the inclined application posture (see FIGS. 9D and 9E).

Then, as illustrated in FIG. 10F, the base 48 holding the crimper 32 and the liquid applier 31 is moved to the right side in the main scanning direction. The posture changing lever 111 is moved, while rotating, toward the lower side of the guide rail 115. The posture changing lever 111 is moved toward the lower side of the guide rail 115 (lower than the posture changing member shaft 119 of the posture changing member 114) and is moved in the main scanning direction. As a result, the posture changing member 114 is rotated in the counterclockwise direction against the biasing force of the biasing spring 117. Further, as the base 48 is moved in the right side, the posture changing lever 111 is moved to the right side while the posture changing lever 111 climbs over the posture changing member 114 (see FIGS. 9E and 9F). As a result, the rotation of the liquid applier 31 to the inclined application posture completes.

In other words, when the posture changing lever 111 passes the posture changing member 114 from one end (the left side) to the other end (the right side) in the main scanning direction, the liquid applier 31 is rotated from the parallel application posture to the inclined application posture. Further, when the liquid applier 31 is rotated from the parallel application posture to the inclined application posture, the crimper 32 is rotated to the inclined binding posture in advance, and then the liquid applier 31 is rotated to the inclined application posture.

Then, as illustrated in FIG. 10G, the base 48 holding the crimper 32 and the liquid applier 31 is moved to the right side. When the liquid applier 31 in the inclined application posture is moved to the position facing the liquid application position, the liquid application member 451 is separated from the sheet P to execute liquid application.

Figure 10H:
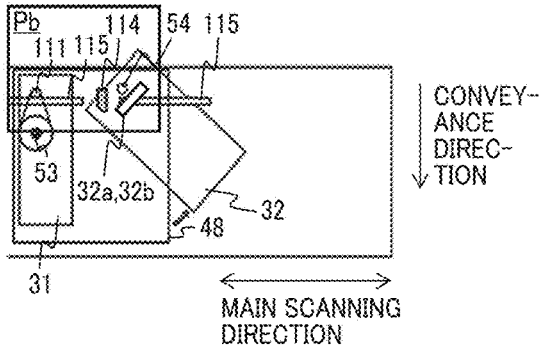

Then, as illustrated in FIG. 10H, after the placement of the sheet bundle Pb including a given number of multiple sheets P is completed, the base 48 holding the crimper 32 and the liquid applier 31 is moved to the left side. After the crimper 32 in the inclined binding posture is moved to the position facing the binding position, the upper crimping teeth 32*a* and the lower crimping teeth 32*b* are separated from the sheet bundle Pb to execute the crimp binding.

FIGS. 11A, 11B, 11C, and 11D are diagrams illustrating the operation procedure for changing the liquid applier 31 to the "parallel application posture" (also the posture at the standby position HP).

Figure 11A:
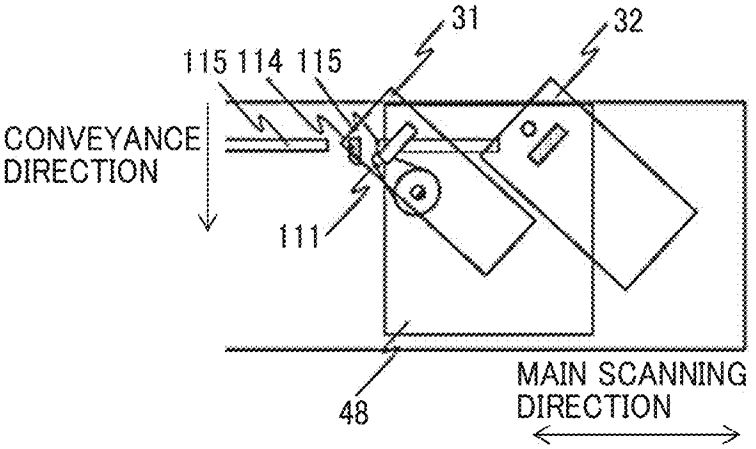
FIGS. 11A, 11B, 11C, and 11D are diagrams illustrating an operation procedure for changing the liquid applier to a parallel application posture.

As illustrated in FIG. 11A, it is assumed that the crimper 32 is in the inclined binding posture and the liquid applier 31 is in the inclined application posture.

Figure 11B:
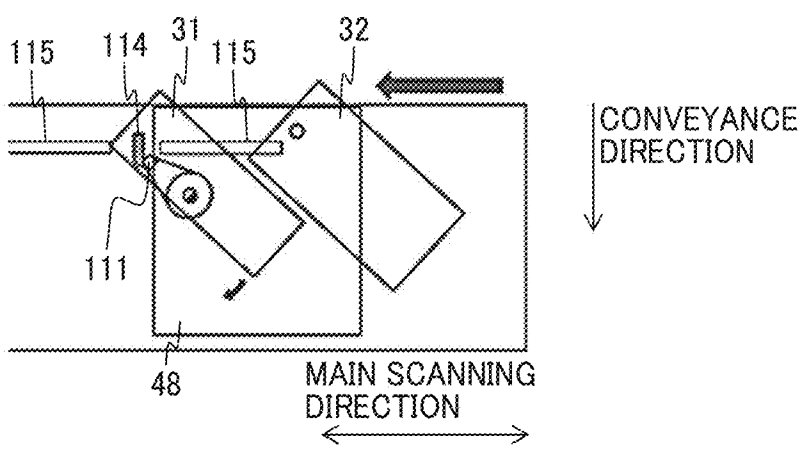

Then, as illustrated in FIG. 11B, the base 48 holding the crimper 32 and the liquid applier 31 is moved to the left side (the direction indicated by the arrow in FIG. 11). Even if the posture changing lever 111 contacts the posture changing member 114, the posture changing member 114 is restricted not to rotate in the clockwise direction. Due to such a configuration, even if the base 48 is moved to the left side direction, the posture changing lever 111 is not allowed to move in the left side and starts to rotate in the clockwise direction in FIG. 11B.

Figure 11C:
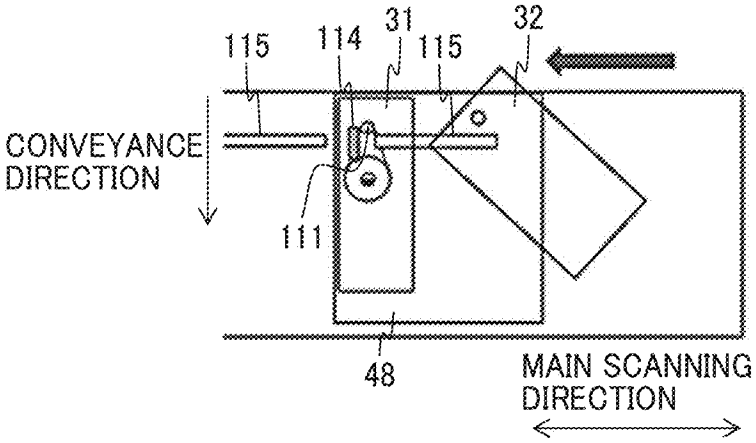
Figure 11D:
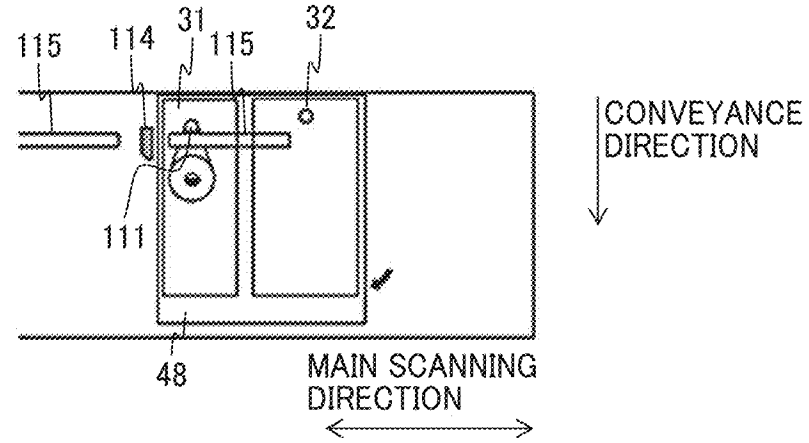

Then, as illustrated in FIG. 11C, the base 48 is further moved to the left side. The posture changing lever 111 is moved, while rotating, toward the upper side of the guide rail 115. When the posture changing lever 111 is moved to the upper side of the guide rail 115, the base 48 is moved to the right side at a timing at which the posture changing lever 111 does not climb over the posture changing member 114, to complete the rotation of the liquid applier 31 to the parallel application posture. Further, by driving the crimper pivot motor 56, the crimper 32 is changed from the inclined binding posture to the parallel binding posture.

In other words, when the posture changing lever 111 passes the posture changing member 114 from the other end (the right side) to the one end (the left side) in the main scanning direction, the liquid applier 31 is rotated from the inclined application posture to the parallel application posture. Further, when the liquid applier 31 is rotated from the inclined application posture to the parallel application posture, the liquid applier 31 is rotated to the parallel application posture in advance, and then the crimper 32 is rotated to the parallel binding posture.

In other words, when the liquid applier 31 in the inclined application posture is moved to the one end in the main scanning direction, the posture changing lever 111 contacts the posture changing member 114 at the application posture changing position D, and the liquid applier 31 is rotated from the inclined application posture to the parallel application posture. On the other hand, when the liquid applier 31 in the parallel application posture is moved to the one end in the main scanning direction, the posture changing lever 111 rotates the posture changing member 114 at the application posture changing position D, and the liquid applier 31 passes the application posture changing position D in the parallel application posture.

In addition, when the liquid applier 31 in the parallel application posture is moved to the other end in the main scanning direction, the posture changing lever 111 contacts the posture changing member 114 at the application posture changing position D, and the liquid applier 31 is rotated from the parallel application posture to the inclined application posture. On the other hand, when the liquid applier 31 in the inclined application posture is moved to the other end in the main scanning direction, the posture changing lever 111 rotates the posture changing member 114 at the application posture changing position D, and the liquid applier 31 passes the application posture changing position D in the inclined application posture.

A description is given of the staple binder 55.

Details of the staple binder 55 having the function of executing the stapling process are described below.

Figure 12:
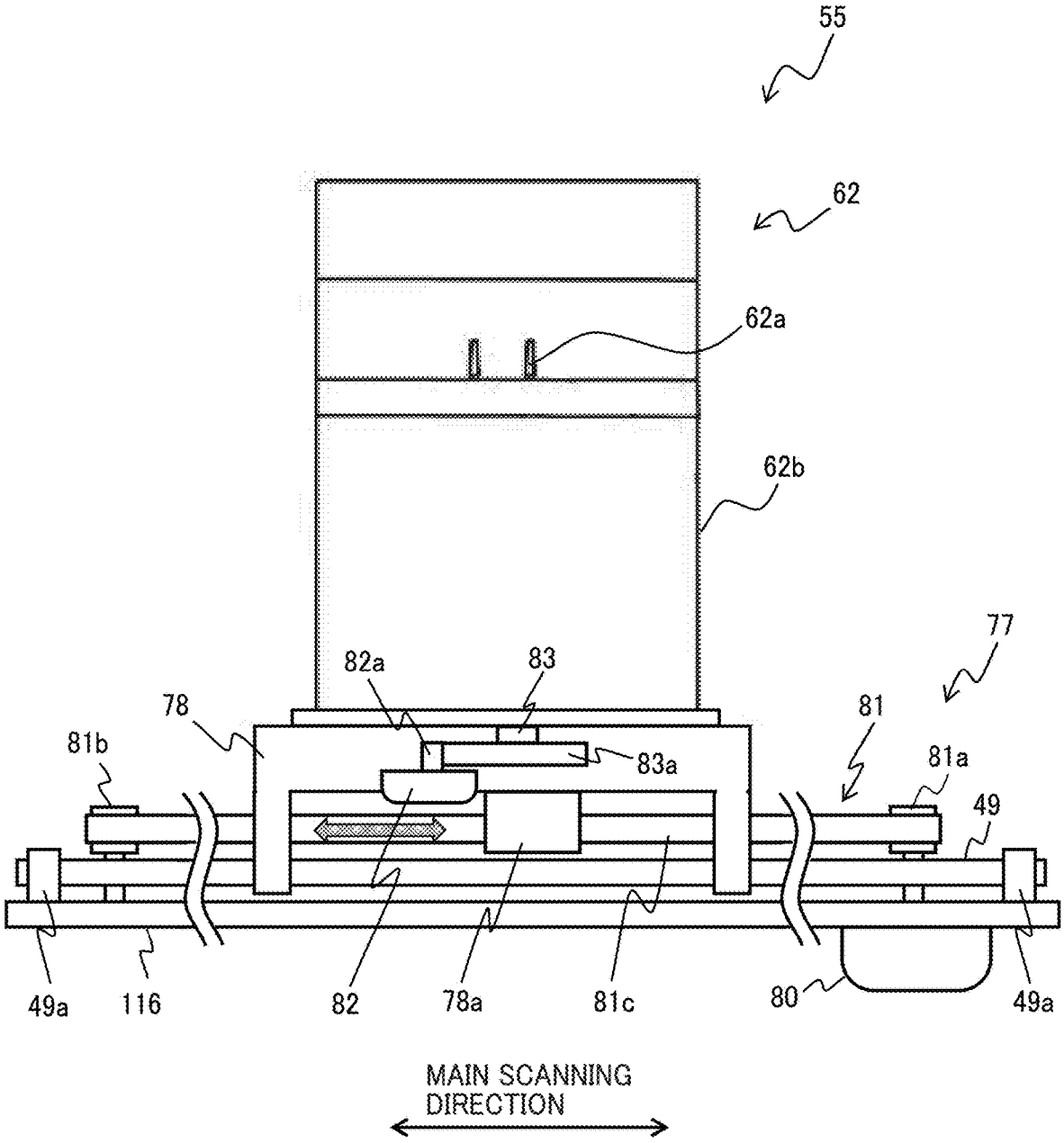
FIG. 12 is a diagram illustrating a staple binder, viewed from an upstream side of the staple binder in the conveyance direction of a sheet.

FIG. 12 is a diagram illustrating the staple binder 55, viewed from the upstream side of the staple binder 55 in the conveyance direction of the sheet P.

The staple binder 55 includes a stapler 62 that binds a sheet bundle Pb with staples. The stapler 62 is disposed downstream from the internal tray 22 in the conveyance direction of the sheet P and spaced apart from the edge binder 25 in the main scanning direction.

The stapler 62 serving as a binder has a configuration of performing so-called "stapling" (i.e., stapling process) to bind a sheet bundle Pb with a staple or staples. To be more specific, the stapler 62 includes a stapling-part drive motor 62*d* illustrated in FIG. 14. The stapling-part drive motor 62*d* drives a stapling part 62*a*. The driving force of the stapling-part drive motor 62*d* causes a staple loaded in the stapling part 62*a* to penetrate through a sheet bundle Pb, so that the stapling part 62*a* binds the sheet bundle Pb. Since the stapler 62 has a typical configuration, a detailed description of the stapler 62 will be omitted unless otherwise required.

As illustrated in FIG. 12, the staple binder 55 includes a staple binder movement assembly 77. The staple binder movement assembly 77 moves the staple binder 55 in the main scanning direction along a downstream end in the conveyance direction of the sheet P or the sheet bundle Pb placed on the internal tray 22. The staple binder movement assembly 77 includes, for example, a base 78, the guide shaft 49, a staple binder movement motor 80, and a driving force transmission assembly 81. The driving force transmission assembly 81 transmits a driving force of the staple binder movement motor 80 to the base 78 via pulleys 81*a* and 81*b*, a timing belt 81*c*, and a fastening portion 78*a* that fastens the base 78 and the timing belt 81*c*. A stapler shaft 83 including a drive transmission gear 83*a* is fixed to a bottom face of a stapling frame 62*b* that holds the components of the stapler 62.

The stapler shaft 83 and the drive transmission gear 83*a* are held by the base 78 on which the stapling frame 62*b* is disposed, so as to be rotatable in the forward and reverse directions. The drive transmission gear 83*a* meshes with an output gear 82*a* of a stapler pivot motor 82. The stapler 62 is rotatable in the forward and reverse directions about the stapler shaft 83 on the base 78 by a driving force transmitted from the stapler pivot motor 82 to the stapler shaft 83 via an output gear 82*a* and the drive transmission gear 83*a*.

The edge binder 25 and the staple binder 55 are supported by the common guide shaft 49. The edge binder movement assembly 47 and the staple binder movement assembly 77 move the edge binder 25 and the staple binder 55 in the main scanning direction along the common guide shaft 49. The edge binder movement assembly 47 and the staple binder movement assembly 77 can separately move the edge binder 25 and the staple binder 55.

Figure 13:
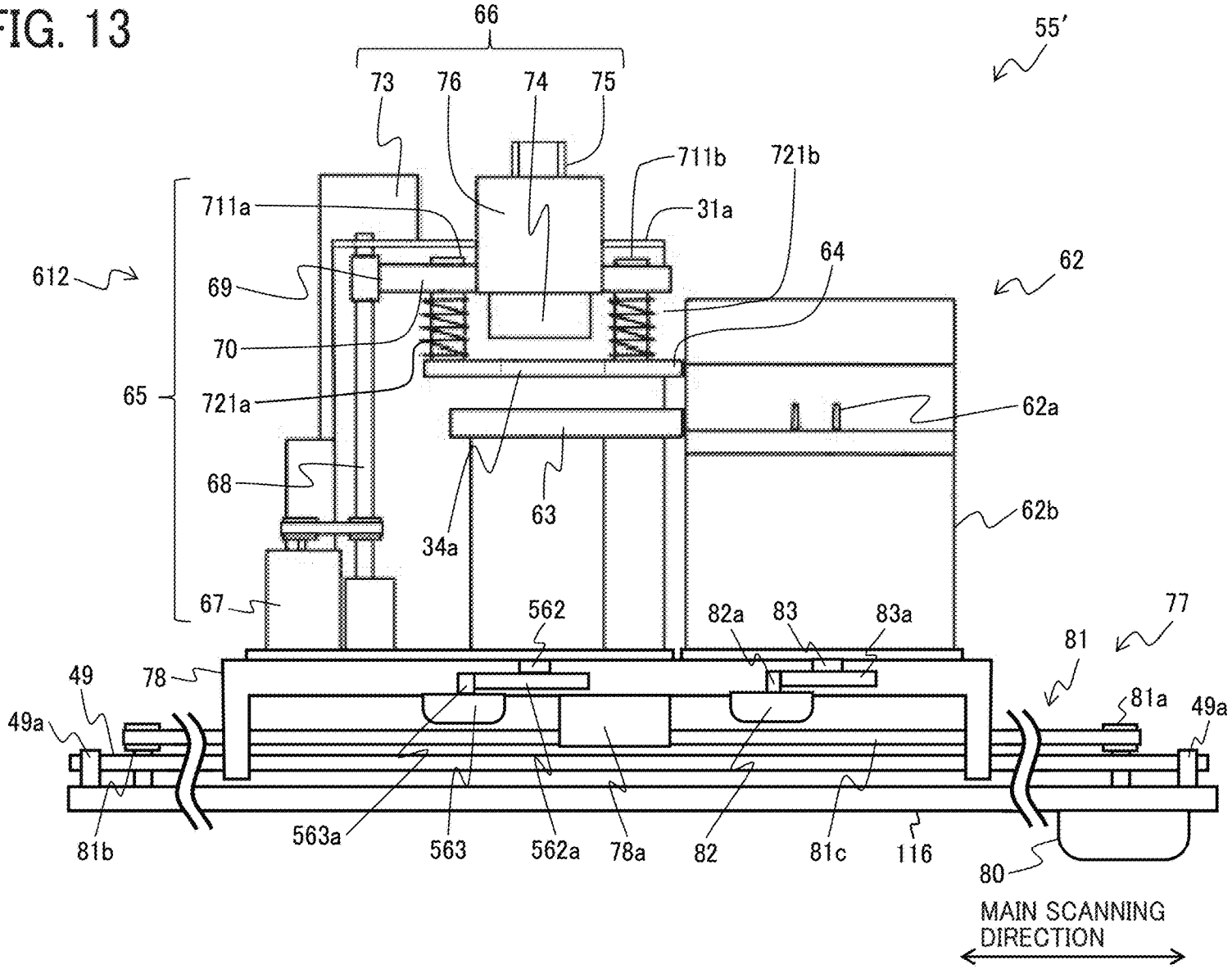
FIG. 13 is a diagram illustrating the staple binder according to a modification of the above-described embodiments, viewed from the upstream side of the staple binder in the conveyance direction of a sheet.

FIG. 13 illustrates a staple binder 55' as a modification of the staple binder 55. More specifically, FIG. 13 is a schematic diagram illustrating of the staple binder 55' as viewed from the upstream side in the conveyance direction of the sheet P.

The staple binder 55' is different from the staple binder 55 in that the staple binder 55' includes a second liquid applier 612 in addition to the stapler 62. As illustrated in FIG. 13, the staple binder 55' includes the second liquid applier 612 and the stapler 62. The second liquid applier 612 and the stapler 62 are disposed downstream from the internal tray 22 in the conveyance direction of the sheet P and adjacent to each other in the main scanning direction. In the following description, components that are the same as or similar to those in the second liquid applier 612 may be denoted by the same reference numerals and the description may be omitted.

The second liquid applier 612 executes "liquid application" of applying liquid stored in a second liquid storage tank 73 to the sheet P or the sheet bundle Pb placed on the internal tray 22. A given area including a position to which the liquid is applied on the sheet P or the sheet bundle Pb by the second liquid applier 612 corresponds to a binding position to be stapled by the stapler 62. As illustrated in FIG. 13, the second liquid applier 612 includes a second lower pressure plate 63, a second upper pressure plate 64, a second liquid applier movement assembly 65, and a second liquid application assembly 66. The second liquid applier movement assembly 65 includes, for example, a second liquid applier movement motor 67, a second trapezoidal screw 68, a second nut 69, a second base plate 70, second columns 711*a* and 711*b*, and second coil springs 721*a* and 721*b*.

A second liquid applier shaft 562 including a drive transmission gear 562*a* is fixed to a bottom face of the liquid application frame 31*a* that holds the components of the second liquid applier 612. The second liquid applier shaft 562 and the drive transmission gear 562*a* are held by the base 78 on which a second liquid application frame 311*a* is disposed, so as to be rotatable in the forward and reverse directions. The drive transmission gear 562*a* meshes with an output gear 563*a* of a second liquid applier pivot motor 563. The second liquid applier 612 can be rotated in the forward and reverse directions about the second liquid applier shaft 562 on the base 78 by a driving force transmitted from the second liquid applier pivot motor 563 to the second liquid applier shaft 562 via the output gear 563*a* and the drive transmission gear 562*a*.

The second liquid application assembly 66 includes a second liquid storage tank 73, a second liquid supplier 75, a second liquid application member 74, and a second joint 76. Since the second liquid application assembly 66 and the liquid application assembly 36 illustrated in FIG. 3 have common configurations, redundant descriptions thereof will be omitted unless otherwise required. Since the configuration of the stapler 62 illustrated in FIG. 13 is like the configuration of the stapler 62 illustrated in FIG. 12, a detailed description thereof is omitted below unless otherwise required.

In the binding process, the staple binder 55' that is illustrated in FIG. 13 performs the liquid application process on the sheet P to loosen and soften the binding position, allowing the staple to easily pass through the sheet bundle Pb. As a result, the number of sheets to be bound per sheet bundle Pb can be increased as compared with a case where the stapling process is performed without applying the liquid.

A description is given of a control block of the post-processing apparatus 3.

A description is given below of a control block of the post-processing apparatus 3, with reference to FIG. 14.

Figure 14:
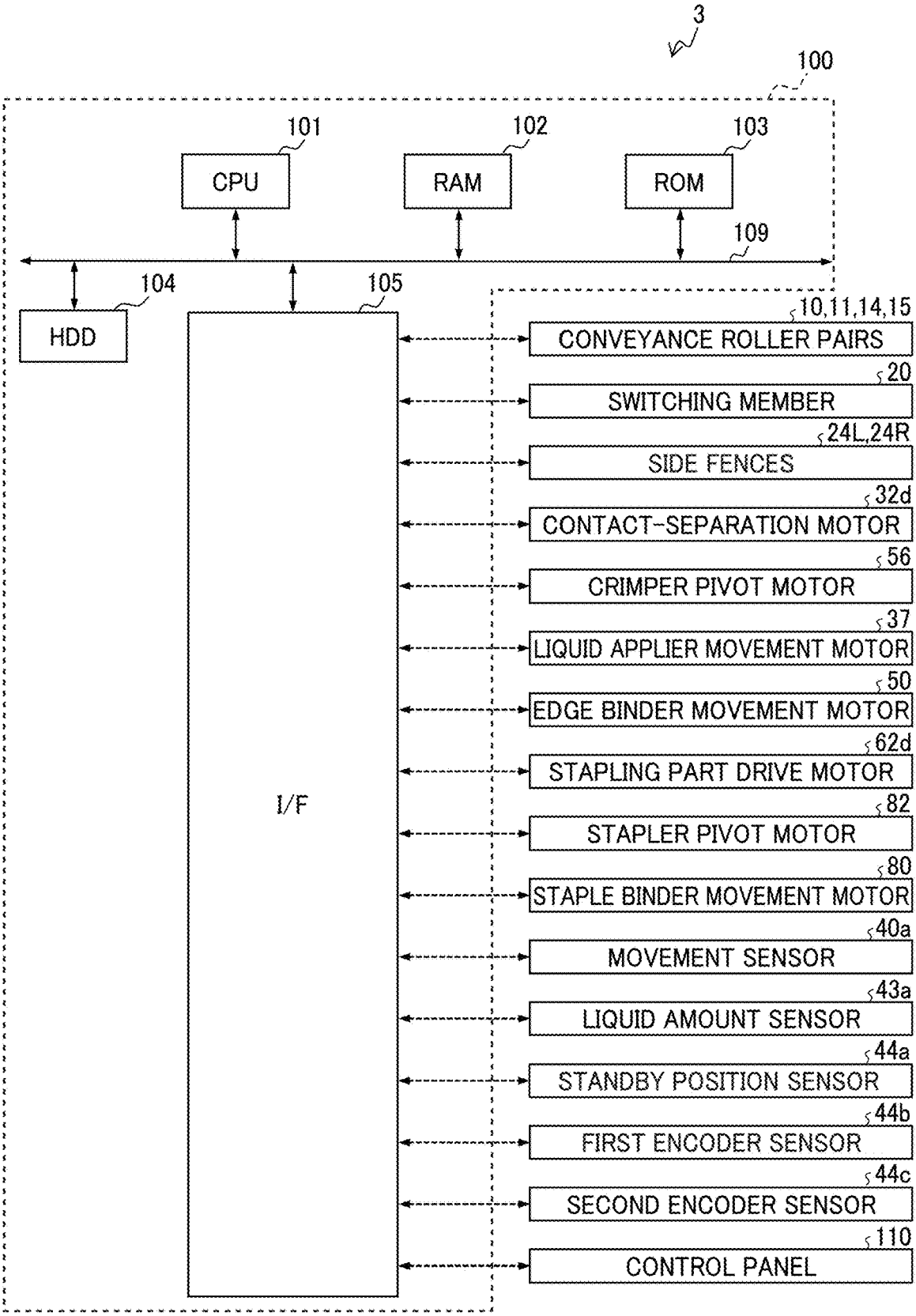
FIG. 14 is a block diagram illustrating a hardware configuration of a control block of the post-processing apparatus according to an embodiment, to control the operation of the post-processing apparatus.

FIG. 14 is a block diagram illustrating a hardware configuration for executing control processing in the post-processing apparatus 3 according to the present embodiment.

As illustrated in FIG. 14, the post-processing apparatus 3 includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the operation of the overall operation of the post-processing apparatus 3.

The RAM 102 is a volatile storage medium that allows data to be read and written at high speed. The CPU 101 uses the RAM 102 as a work area for data processing.

The ROM 103 is a read-only non-volatile storage medium that stores programs such as firmware.

The HDD 104 is a non-volatile storage medium that allows data to be read and written and has a relatively large storage capacity. The HDD 104 stores, e.g., an operating system (OS), various control programs, and application programs.

The post-processing apparatus 3 processes, by an arithmetic function of the CPU 101, e.g., a control program stored in the ROM 103 and an information processing program (or application program) loaded into the RAM 102 from a storage medium such as the HDD 104. Such processing configures a software controller including various functional modules of the post-processing apparatus 3. The software controller thus configured cooperates with hardware resources of the post-processing apparatus 3 to construct functional blocks that implement functions of the post-processing apparatus 3. In other words, the CPU 101, the RAM 102, the ROM 103, the HDD 104, and the I/F 105 constitute at least part of a controller 100*b* serving as a control device that controls the operation of the post-processing apparatus 3.

The I/F 105 is an interface that connects the conveyance roller pairs 10, 11, 14, and 15, the switching member 20, the side fences 24L and 24R, the contact-separation motor 32*d*, the crimper pivot motor 56, the liquid applier movement motor 37, the edge binder movement motor 50, the stapling-part drive motor 62*d*, the stapler pivot motor 82, the staple binder movement motor 80, the movement sensor 40*a*, the liquid level sensor 43*a*, the standby position sensor 44*a*, the first encoder sensor 44*b*, the second encoder sensor 44*c*, and a control panel 110 to the common bus 109.

The controller 100*b* controls, via the I/F 105, the operations of the conveyance roller pairs 10, 11, 14, and 15, the switching member 20, the side fences 24L and 24R, the contact-separation motor 32*d*, the crimper pivot motor 56, the liquid applier movement motor 37, the edge binder movement motor 50, the stapling-part drive motor 62*d*, the stapler pivot motor 82, and the staple binder movement motor 80. The controller 100*b* acquires detection results from the movement sensor 40*a*, the liquid level sensor 43*a*, the standby position sensor 44*a*, the first encoder sensor 44*b*, and the second encoder sensor 44*c*. Although FIG. 14 illustrates only the components related to the edge binder 25 and the staple binder 55 that perform the edge binding, the components related to the saddle binder 28 that performs the saddle binding are also controlled by the controller 100*b*.

As illustrated in FIG. 1, the image forming apparatus 2 includes the control panel 110. The control panel 110 includes an operation device that receives instructions input by an operator and a display serving as a notifier that notifies the operator of information. The control panel includes, for example, physical input buttons and a touch screen overlaid on a display. The control panel 110 acquires information from the user through the operation unit and provides the information to the user through the display. A specific example of the notification unit is not limited to the display and may be a light emitting diode (LED) lamp or a speaker. The post-processing apparatus 3 may include a control panel 110 similar to the above-described control panel 110 of the image forming apparatus 2.

As described above, the post-processing apparatus 3 implements the function of performing operation control related to the liquid application by software (control programs) executed by the CPU 101 with hardware resources included in the controller 100*b*.

In some embodiments, the liquid application performed by the post-processing apparatus 3 may be performed in a form in which the staple binder 155 is provided with only the stapler 62 and the liquid application is performed using the liquid applier 31 of the edge binder 25. Conversely, the edge binder 25 may include only the crimper 32, and the liquid application may be performed in a mode in which the second liquid applier 612 is used. In other words, the post-processing apparatus 3 may have a configuration in which only one of the liquid applier 31 and the second liquid applier 612 performs the liquid application, regardless of the type of the binding process.

In the above description, the staple binder 155' has a configuration of moving along the guide shaft 49 with the stapler 62 and the second liquid applier 612 being integrated, the embodiments of the present disclosure are not limited to the above-described configuration. For example, the stapler 62 and the second liquid applier 612 may have a configuration of moving separately from each other.

A description is given of a binding process according to an embodiment of the present disclosure.

A description is given below of the binding process executed by the edge binder 25 included in the post-processing apparatus 3.

Figure 15:
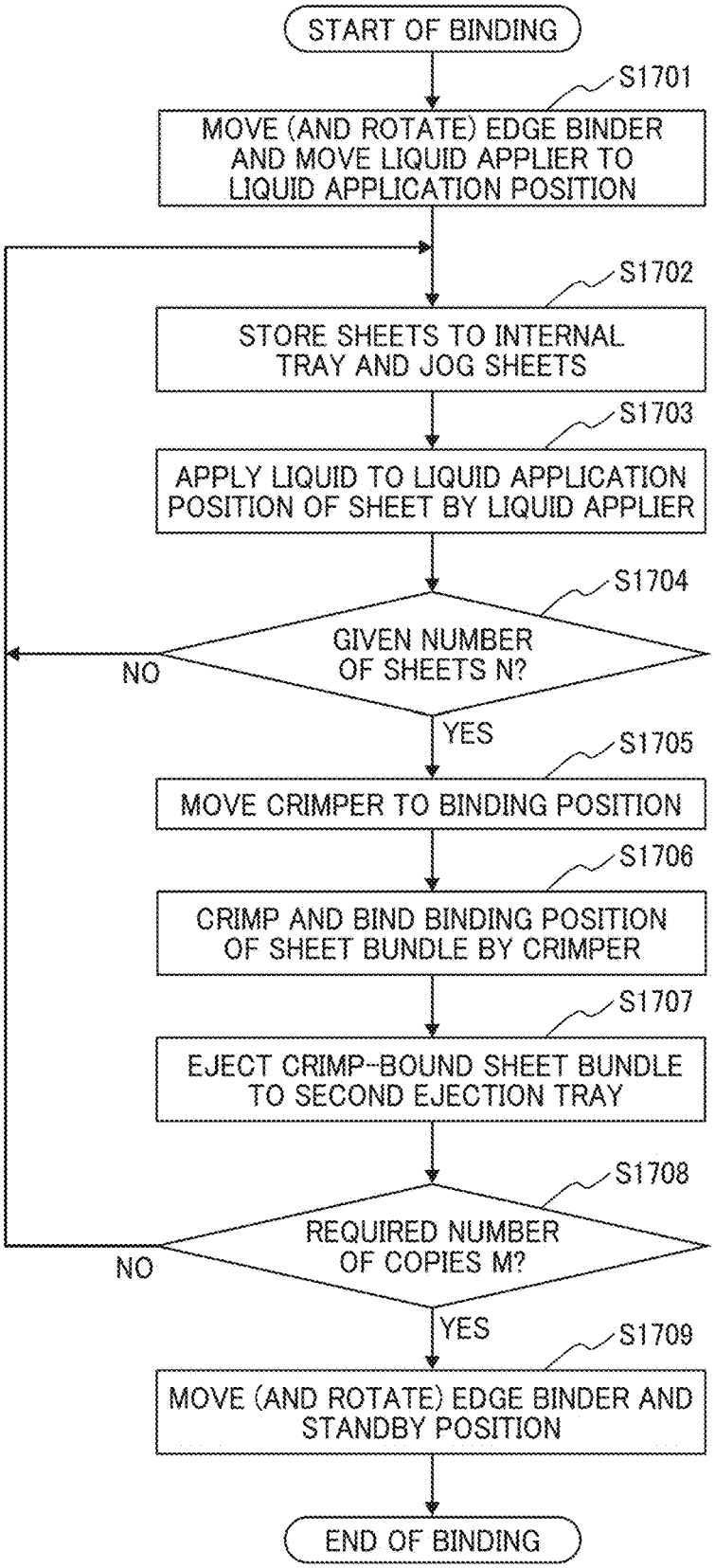
FIG. 15 is a flowchart of a binding process performed by the edge binder of FIG. 3.

FIG. 15 is a flowchart of a process of a one-point binding performed by the edge binder 25.

FIGS. 16A, 16B, 16C, and 16D are diagrams illustrating the transition (change) of the positions of the edge binder 25 (including the liquid applier 31 and the crimper 32) during the operation of a one-point binding.

FIGS. 16A, 16B, 16C, and 16D do not illustrate changes in the postures of the liquid applier 31 and the crimper 32. The position (liquid application position) at which liquid application is executed on the sheet P or the sheet bundle Pb by the liquid applier 31 corresponds to the binding position on the sheet bundle Pb to be crimped and bound by the crimper 32. For this reason, in the following description, the liquid application position and the binding position are denoted by the same reference numeral (B1 and B2).

For example, the controller 100*b* starts the binding process illustrated in FIG. 15 when the controller 100*b* acquires an instruction to execute the binding process from the image forming apparatus 2. In the following description, the instruction to execute the binding process may be referred to as a "binding command."

The binding command includes, for example, the type of the sheet P (i.e., information affecting the spread of liquid, such as material and thickness), the number of sheets P of the sheet bundle Pb, the number of sheet bundles Pb to be bound, the binding position on the sheet bundle Pb, and the binding posture of the edge binder 25. In the following description, the number of sheets P of the sheet bundle Pb may be referred to as "given number of sheets N" whereas the number of sheet bundles Pb to be bound may be referred to as "requested number of copies M." The liquid applier 31 and the crimper 32 are assumed to be in a parallel binding posture and located at a standby position HP (FIG. 16A) that is a position shifted in the width direction from the sheets P placed on the internal tray 22 at the start of the binding process.

When the posture that is instructed by the binding command is the "inclined binding posture", the controller 100*b* drives the crimper pivot motor 56 to rotate the liquid applier 31 and the crimper 32 of the edge binder 25 into the inclined binding posture (step S1701). The controller 100*b* causes the liquid applier pivot assembly 126 to rotate the liquid applier 31 of the edge binder 25 to the inclined binding posture. When the posture is the "inclined binding posture", the crimper 32 alone may be rotated to the inclined binding posture and the liquid applier 31 may be restricted not to rotate in the forward and reverse directions. As a result, the driving assembly may be simplified as compared with a case where both the liquid applier 31 and the crimper 32 are rotated in the forward and reverse directions, and thus effects of cost reduction, downsizing of the apparatus, and reduction of failure of the device are exhibited.

On the other hand, when the posture that is instructed by the binding command is the "parallel binding posture," the controller 100*b* omits the aforementioned operation of rotating the liquid applier 31 and the crimper 32 of the edge binder 25 to the inclined binding posture. The controller 100*b* drives the edge binder movement motor 50 to move the edge binder 25 in the main scanning direction so that the liquid applier 31 faces the first liquid application position B1 instructed by the binding command (step S1701). The controller 100*b* executes the operation of step S1701 before a first sheet P is conveyed to the internal tray 22 by the conveyance roller pairs 10, 11, 14, and 15.

The controller 100*b* rotates the conveyance roller pairs 10, 11, 14, and 15 to store the sheet P, on which the image has been formed by the image forming apparatus 2, onto the internal tray 22 (step S1702). The controller 100*b* moves the side fences 24L and 24R to align the position of the sheet P or the sheet bundle Pb placed on the internal tray 22 in the main scanning direction (step S1702). In short, the controller 100*b* performs so-called jogging.

The controller 100*b* causes the liquid applier 31 facing the first liquid application position B1 to apply liquid to the first liquid application position B1 of the sheet P placed on the internal tray 22 in the immediately preceding step S1702, based on the liquid application control data adjusted in advance (step S1703). In other words, the controller 100*b* drives the liquid applier movement motor 37 to bring the liquid application member 451 into contact with the first liquid application position B1 on the sheet P placed on the internal tray 22 (see FIG. 10B). In the liquid application process in step S1703, the controller 100*b* adjusts the position at which the liquid application member 451 applies liquid to the sheet P in accordance with the type of the sheet P and the binding position included in the binding command. The controller 100*b* adjusts the amount of pressing the liquid application member 451 against the sheet P. In other words, the controller 100*b* controls the driving of the liquid applier movement motor 37 based on the adjusted control data, and adjusts the amount of movement of the liquid application member 451 with respect to the binding position B1 of the sheet P placed on the internal tray 22.

The controller 100*b* determines whether the number of sheets P placed on the internal tray 22 has reached the given number of sheets N instructed by the binding command (step S1704). When the controller 100*b* determines that the number of sheets P placed on the internal tray 22 has not reached the given number of sheets N (NO in step S1704), the controller 100*b* executes the operations of steps S1702 to S1704 again until the number of sheets P placed on the internal tray 22 reaches the given number of sheets N (YES in step S1704).

In other words, the controller 100*b* executes the processing of steps S1702 to S1704 each time the sheet P is conveyed to the internal tray 22 by the conveyance roller pairs 10, 11, 14, and 15.

The liquid application by the liquid applier 31 may be performed on each of the multiple sheets P of the sheet bundle Pb.

Figure 16C:
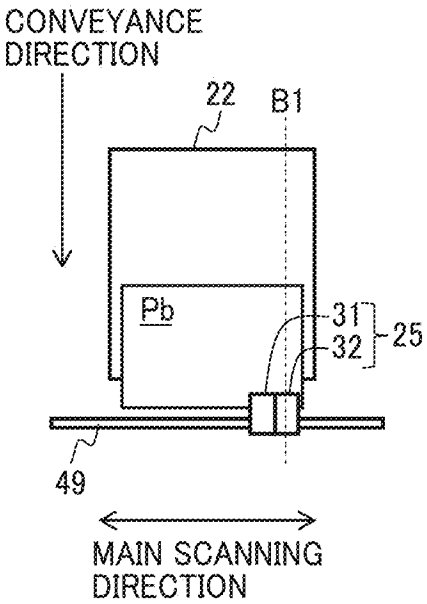

When the controller 100*b* determines that the number of sheets P placed on the internal tray 22 has reached the given number of sheets N (YES in step S1704), the controller 100*b* drives the edge binder movement motor 50 to move the edge binder 25 in the main scanning direction such that the crimper 32 faces the first binding position B1 as illustrated in FIG. 16C (step S1705).

The controller 100*b* causes the crimper 32 to crimp the sheet bundle Pb placed on the internal tray 22 (step S1706). The controller 100*b* causes the conveyance roller pair 15 to eject the sheet bundle Pb thus crimped and bound by the crimper 32 to the second ejection tray 26 (step S1707). Specifically, the controller 100*b* drives the contact-separation motor 32*d* to cause the upper crimping teeth 32*a* and the lower crimping teeth 32*b* to nip the first binding position B1 on the sheet bundle Pb placed on the internal tray 22. The sheet bundle Pb is pressed and deformed between the upper crimping teeth 32*a* and the lower crimping teeth 32*b*. Thus, the crimper 32 crimps the sheet bundle Pb. Then, the controller 100*b* rotates the conveyance roller pair 15 to eject the sheet bundle Pb thus crimped and bound to the second ejection tray 26.

The sheet bundle Pb that is placed on the internal tray 22 has a crimping area (corresponding to the first binding position B1) sandwiched between the upper crimping teeth 32*a* and the lower crimping teeth 32*b* in step S1706. The crimping area overlaps a liquid application area (corresponding to the first liquid application position B1) contacted by the end of the liquid application member 451 in step S1703. In other words, the crimper 32 crimps an area to which liquid is applied by the liquid applier 31 on the sheet bundle Pb placed on the internal tray 22. The crimping area that is nipped by the upper crimping teeth 32*a* and the lower crimping teeth 32*b* may completely or partially overlaps the liquid application area contacted by the distal end (tip portion) of the liquid application member 451, to obtain a sufficient binding strength.

The controller 100*b* determines whether the number of sheet bundles Pb thus ejected to the second ejection tray 26 has reached the requested number of copies M indicated by the binding command (step S1708). When the controller 100*b* determines that the number of sheet bundles Pb thus ejected has not reached the requested number of copies M (NO in step S1708), the controller 100*b* executes the operations of step S1702 and the following steps again. In other words, when the controller 100*b* determines that the number of sheet bundles Pb thus ejected has not reached the requested number of copies M (NO in step S1708), the controller 100*b* repeats the operations of steps S1702 to S1708 until the number of sheet bundles Pb ejected to the second ejection tray 26 reaches the requested number of copies M.

Figure 16D:
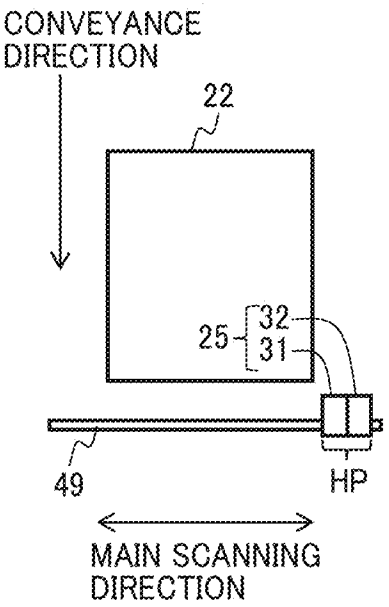

On the other hand, when the controller 100*b* determines that the number of sheet bundles Pb output to the second ejection tray 26 has reached the requested number of copies M (YES in step S1708), the controller 100*b* drives the edge binder movement motor 50 to move the edge binder 25 (the liquid applier 31 and the crimper 32) to the standby position HP as illustrated in FIG. 16D (step S1709) When the posture that is instructed by the binding command is the "inclined binding posture", the controller 100*b* also drives the crimper pivot motor 56 to rotate the liquid applier 31 and the crimper 32 into the parallel binding posture (step S1709). The controller 100*b* causes the liquid applier pivot assembly 126 to rotate the liquid applier 31 to the parallel binding posture (step S1709). On the other hand, when the posture that is instructed by the binding command is the "parallel binding posture," the controller 100*b* skips the aforementioned operation of rotating the liquid applier 31 and the crimper 32 to the parallel binding posture. As a result, the edge binder 25 (the liquid applier 31 and the crimper 32) returns to the standby position HP position illustrated in FIG. 16D. In steps S1701 and S1709, the execution order of the movement in the main scanning direction and the rotation in the forward and reverse directions of the liquid applier 31 and the crimper 32 is not limited to the aforementioned order and may be reversed.

FIGS. 17A, 17B, 17C, 17D, 17E, 17F, 17G, and 17H are diagrams illustrating the positions of the edge binder 25 during the operation of a two-point binding.

A detailed description of points common to the process described with reference to FIGS. 16A, 16B, 16C, and 16D may be omitted, and differences will be mainly described.

Figure 17A:
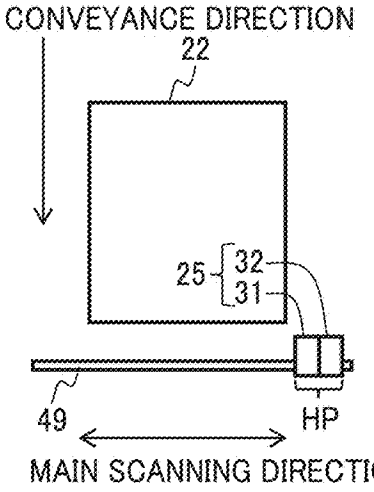
FIGS. 17A, 17B, 17C, 17D, 17E, 17F, 17G, and 17H are diagrams illustrating the positions of the edge binder during the operation of a two-point binding.

As illustrated in FIG. 17A, it is assumed that the edge binder 25 is located at the standby position HP at the start point of the two-point binding. Further, the first binding position B1 and the second binding position B2 are apart from each other in the main scanning direction. In FIGS. 17A to 17H, the case where two sheets P1 and P2 are crimped and bound (in other words, the given number of sheets N=2) will be described. However, the number of sheets P of the sheet bundle Pb is not limited to two.

Figure 17B:
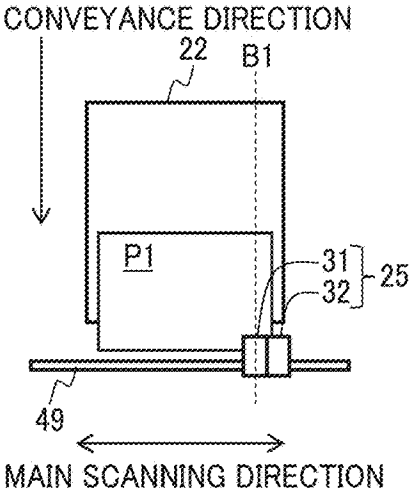

Before the first sheet P1 of the sheet bundle Pb is placed on the internal tray 22, the controller 100*b* moves the edge binder 25 in the main scanning direction so that the liquid applier 31 can face the first liquid application position B1. Subsequently, as illustrated in FIG. 17B, the controller 100*b* places the liquid applier 31 at the position to face the first liquid application position B1. With this state, the sheet P1 on which an image has been formed by the image forming apparatus 2 is placed on the internal tray 22, and the controller 100*b* moves the side fences 24L and 24R in the main scanning direction to jog the sheets.

Figure 17C:
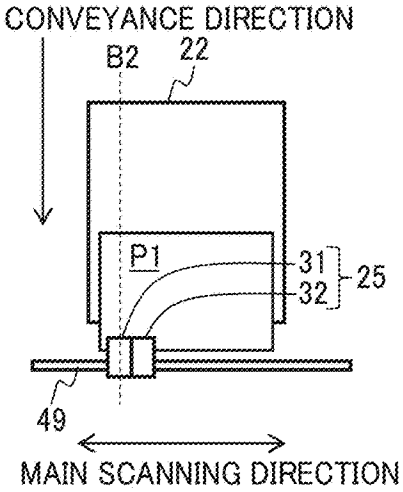

Subsequently, with the first sheet P1 being placed on the internal tray 22, the controller 100*b* causes the liquid applier 31 to apply the liquid at the first liquid application position B1 of the first sheet P1. Then, as illustrated in FIG. 17C, the controller 100*b* causes the edge binder 25 to move in the main scanning direction such that the liquid applier 31 faces the second liquid application position B2 of the first sheet P1. Subsequently, the controller 100*b* causes the liquid applier 31 to apply the liquid at the second liquid application position B2 of the first sheet P1.

Figure 17D:
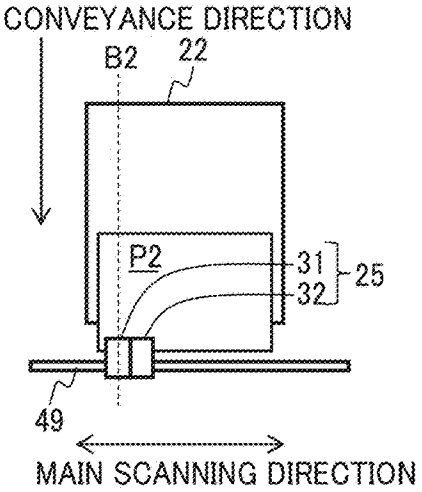

Then, in response to the completion of liquid application by the liquid applier 31 to the first liquid application position B1 and the second liquid application position B2 of the first sheet P1, the controller 100*b* causes the second sheet P2 of the sheet bundle Pb to be accommodated in the internal tray 22 and the side fences 24L and 24R to move in the main scanning direction to jog the sheets, with the liquid applier 31 being disposed at a position to face the second liquid application position B2, as illustrated in FIG. 17D.

Figure 17E:
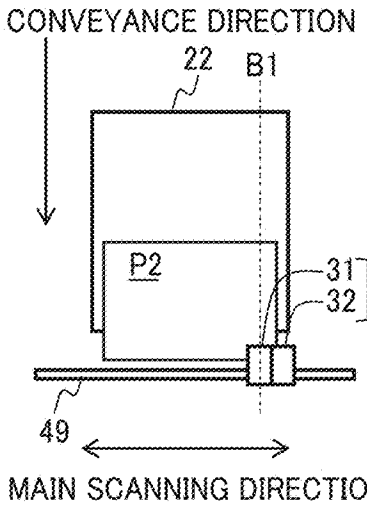

Subsequently, with the second sheet P2 being placed on the internal tray 22, the controller 100*b* causes the liquid applier 31 to apply the liquid at the second liquid application position B2 of the second sheet P2. Then, as illustrated in FIG. 17E, the controller 100*b* causes the edge binder 25 to move in the main scanning direction such that the liquid applier 31 faces the first liquid application position B1 of the second sheet P2. Subsequently, the controller 100*b* causes the liquid applier 31 to apply the liquid at the first liquid application position B1 of the second sheet P2.

In other words, the controller 100*b* controls the conveyance roller pairs 10, 11, 14, and 15 and the liquid applier 31 to repeat the conveyance of the sheet P and the liquid application to the first liquid application position B1 and the second liquid application position B2 until the number of sheets P placed on the internal tray 22 reaches the given number of sheets N. At this time, the controller 100*b* controls the liquid applier 31 to apply the liquid to the B-th sheet P (B<N) in the order of the first liquid application position B1 and the second liquid application position B2. Subsequently, the controller 100*b* controls the liquid applier 31 to apply the liquid to the (B+1)-th sheet P in the order of the second liquid application position B2 and the first liquid application position B1. In other words, the controller 100*b* changes the order in which the liquid applier 31 applies the liquid to the first liquid application position B1 and the second liquid application position B2 for each sheet P. The controller 100*b* also causes the edge binder 25 to move from one side of the first liquid application position B1 and the second liquid application position B2 toward the other side of the first liquid application position B1 and the second liquid application position B2 in the shortest distance without passing through the standby position HP.

Figure 17F:
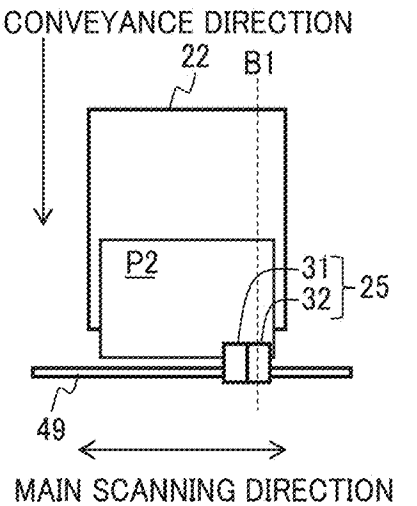
Figure 17G:
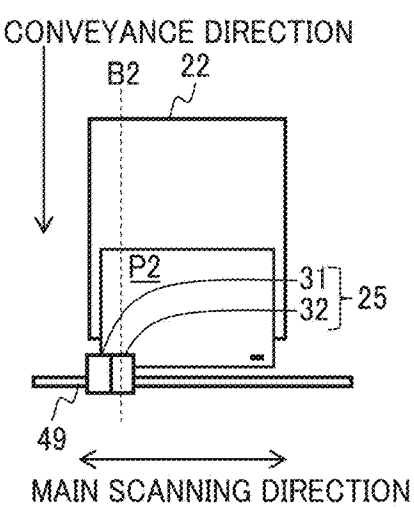

Subsequently, when the controller 100*b* determines that the number of sheets P placed on the internal tray 22 has reached the given number of sheets N, the controller 100*b* causes the edge binder 25 to move in the main scanning direction such that the crimper 32 faces the first binding position B1 as illustrated in FIG. 17F. The controller 100*b* causes the crimper 32 to crimp and bind the first binding position B1 of the sheet bundle Pb including the first sheet P1 and the second sheet P2 placed on the internal tray 22. Then, as illustrated in FIG. 17G, the controller 100*b* causes the edge binder 25 to move in the main scanning direction such that the crimper 32 faces the second binding position B2 of the sheet bundle Pb. The controller 100*b* causes the crimper 32 to crimp and bind the second binding position B2 of the sheet bundle Pb placed on the internal tray 22.

In the example illustrated in FIGS. 17A to 17H, since the controller 100*b* causes the liquid applier 31 to finally apply the liquid to the first liquid application position B1, the crimper 32 performs the crimp binding processes in the order of the first binding position B1 and the second binding position B2. On the other hand, when the controller 100*b* causes the liquid applier 31 to finally apply the liquid to the second liquid application position B2, the crimper 32 performs the crimp binding processes in the order of the second binding position B2 and the first binding position B1.

In other words, as illustrated in FIGS. 17A to 17H, the controller 100*b* causes the edge binder movement assembly 47 to move the edge binder 25 by the shortest distance between the position at which the liquid applier 31 faces the first liquid application position B1 and the position at which the liquid applier 31 faces the second liquid application position B2 without passing through the standby position HP. The controller 100*b* causes the edge binder movement assembly 47 to move the edge binder 25 by the shortest distance between the position at which the crimper 32 faces the first binding position B1 and the position at which the crimper 32 faces the second binding position B2 without passing through the standby position HP. Further, the controller 100*b* causes the edge binder movement assembly 47 to move the edge binder 25 by the shortest distance between the position at which the liquid applier 31 faces the first liquid application position B1 (or the second liquid application position B2) and the position at which the crimper 32 faces the first binding position B1 (or the second binding position B2) without passing through the standby position HP.

Figure 17H:
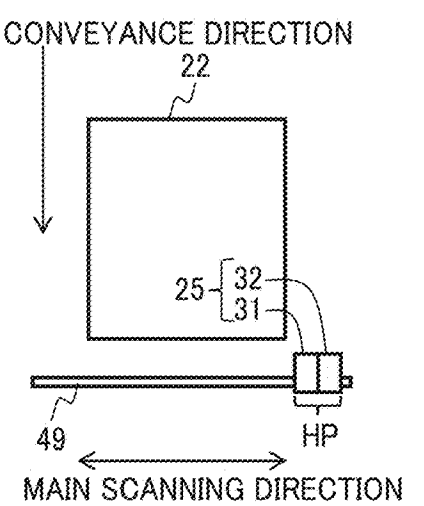

Then, the controller 100*b* causes the conveyance roller pair 15 to rotate to eject the sheet bundle Pb to the second ejection tray 26 after the sheet bundle Pb is crimped and bound by the crimper 32 at the first binding position B1 and the second binding position B2. Further, as illustrated in FIG. 17H, the controller 100*b* drives the edge binder movement motor 50 to move the edge binder 25 (the liquid applier 31 and the crimper 32) to the standby position HP.

Then, the controller 100*b* can cause the liquid applier 31 and the crimper 32 of the edge binder 25 to perform liquid application and crimping binding, respectively, at any position and in any posture of the sheet P or the sheet bundle Pb by combining the posture change of the liquid applier 31 and the crimper 32 described with reference to FIGS. 10A to 10H and 11A to 11D and the movement of the liquid applier 31 and the crimper 32 in the main scanning direction described with reference to FIGS. 16A to 16D and 17A to 17H.

The liquid applier 31 and the crimper 32 are disposed adjacent to each other in the main scanning direction. More specifically, the liquid applier 31 is disposed on one side (left side) from the crimper 32 in the main scanning direction. When the crimper 32 changes the posture from the parallel binding posture to the inclined binding posture, the crimper 32 rotates in the counterclockwise direction in FIGS. 10A to 10H such that the downstream end of the crimper 32 in the conveyance direction of the sheet P faces the other side (right side) in the main scanning direction. Further, when the liquid applier 31 changes the posture from the parallel application posture to the inclined application posture, the liquid applier 31 rotates in the counterclockwise direction in FIGS. 10A to 10H such that the downstream end of the liquid applier 31 in the conveyance direction of the sheet P faces the other side (right side) in the main scanning direction.

Due to such a configuration, when the liquid applier 31 changes the posture from the parallel application posture to the inclined application posture while the crimper 32 keeps the parallel binding posture, the liquid applier 31 collides with the crimper 32. Further, when the crimper 32 changes the posture from the inclined binding posture to the parallel binding posture while the liquid applier 31 keeps the inclined application posture, the crimper 32 collides with the liquid applier 31. In other words, the liquid applier 31 and the crimper 32 need to change the postures in a given order. If the liquid applier 31 or the crimper 32 is forced to change from the given posture unnecessarily, for example, by a user, the liquid applier 31 and the crimper 32 collide with each other as described above, and one or both of the liquid applier 31 and the crimper 32 may be damaged or broken.

A description is given of a proper procedure to move the edge binder 25 (including the liquid applier 31 and the crimper 32) to the other side in the main scanning direction from the position facing the first binding position B1 (corresponding to the first liquid application position B1) to the standby position HP, with reference to FIGS. 18A, 18B, 18C, 19A, 19B, and 19C.

Figure 18A:
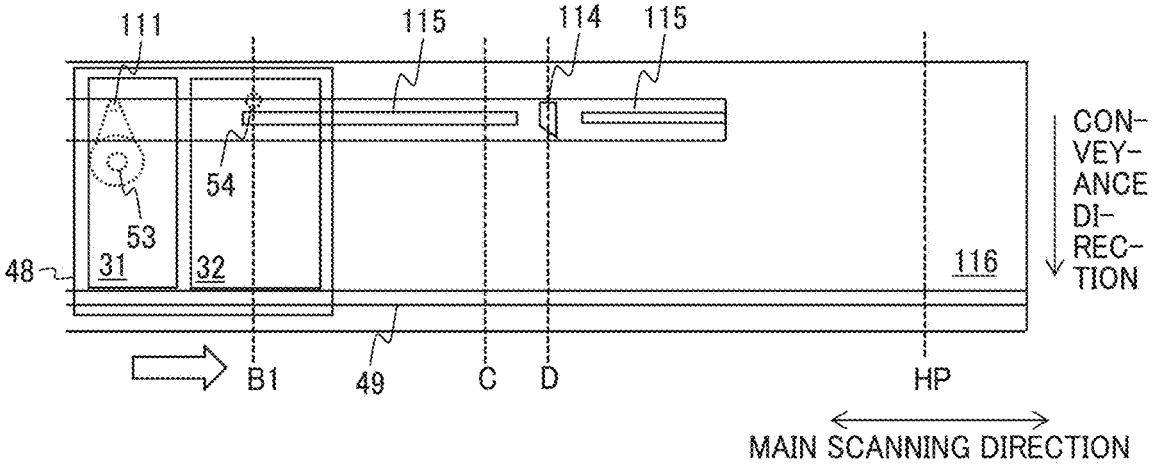
FIGS. 18A, 18B, and 18C are diagrams illustrating the first half of a process of moving the edge binder to a standby position after the edge binder has performed the binding process with a proper procedure.
Figure 18B:
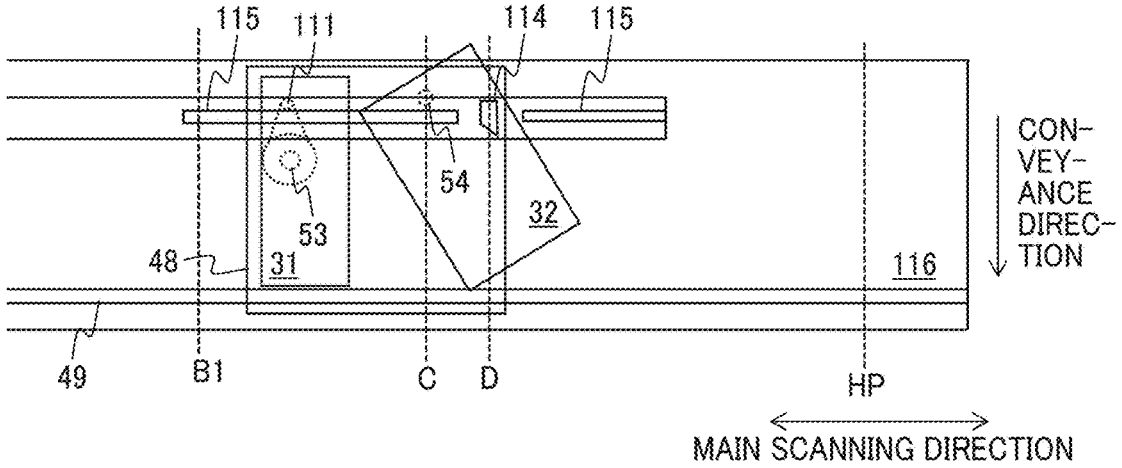
Figure 18C:
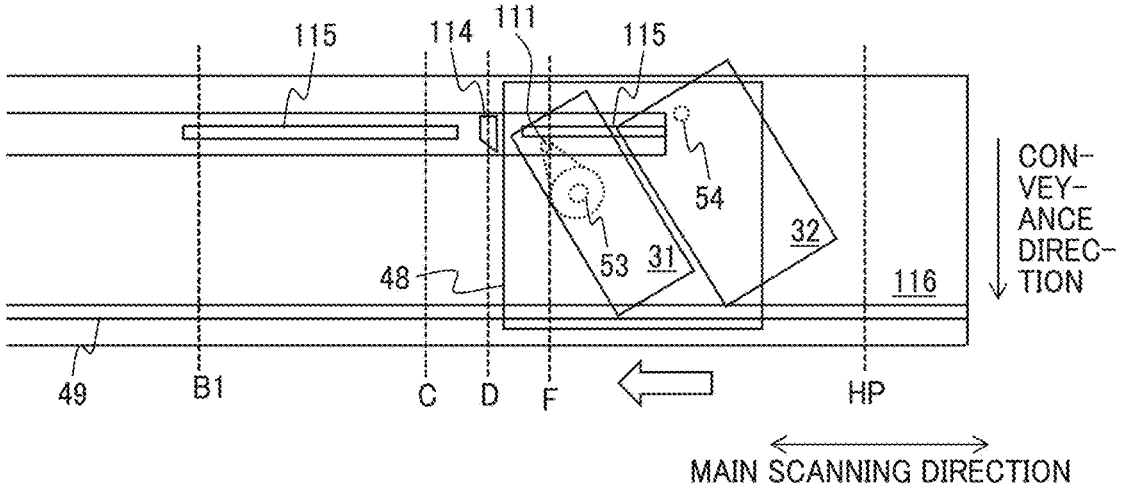

FIGS. 18A, 18B, and 18C are diagrams illustrating the first half of a process of moving the edge binder 25 to the standby position HP with a proper procedure after the edge binder 25 has bound the first binding position B1.

Figure 19A:
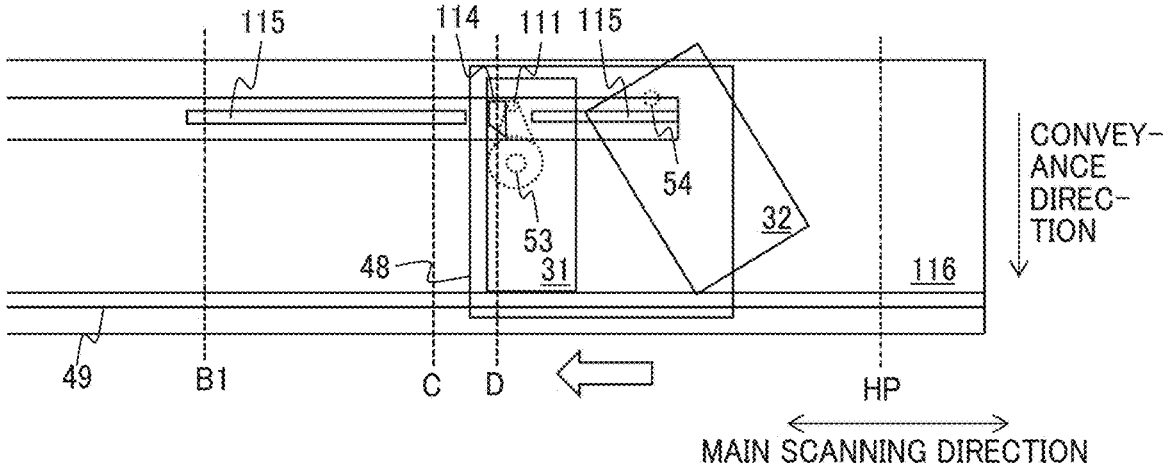
FIGS. 19A, 19B, and 19C are diagrams illustrating the second half of the process of moving the edge binder to the standby position after the edge binder has performed the binding process with the proper procedure.
Figure 19B:
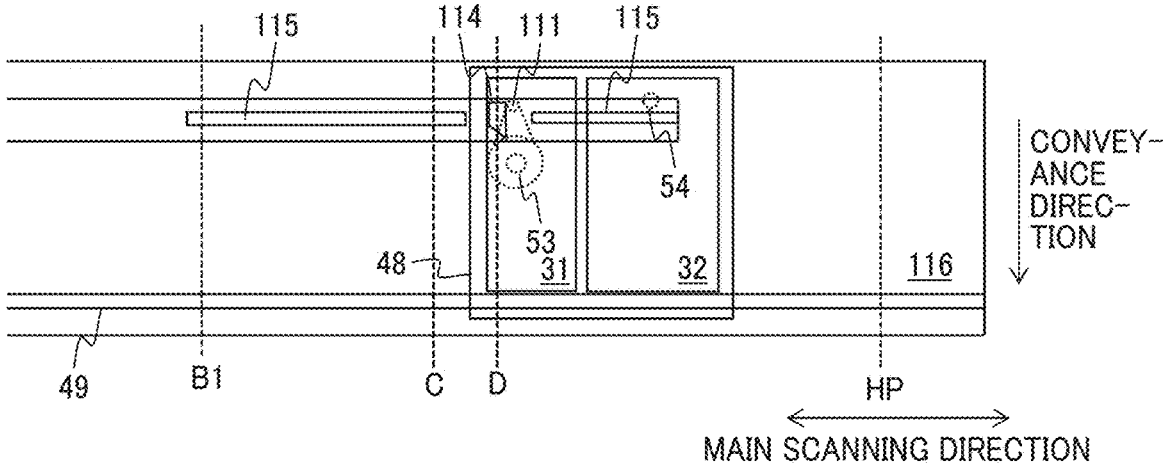
Figure 19C:
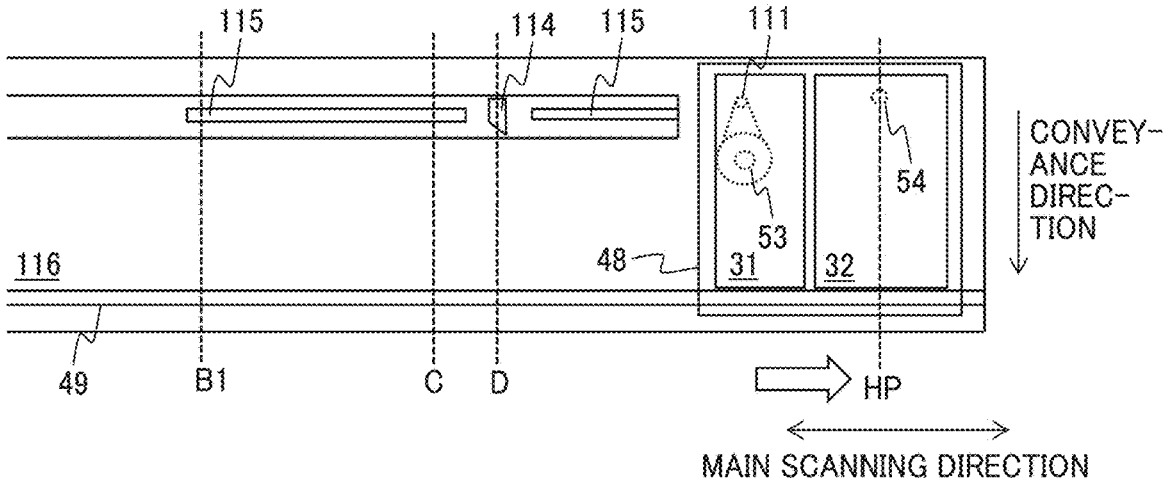

FIGS. 19A, 19B, and 19C are diagrams illustrating the second half of the process of moving the edge binder 25 to the standby position HP with the proper procedure after the edge binder 25 has bound the first binding position B1.

As illustrated in FIG. 18A, immediately after the liquid applier 31 has bound the first binding position B1, it is assumed that the liquid applier 31 is in the parallel application posture and the crimper 32 is in the parallel binding posture. Then, the controller 100*b* drives the edge binder movement motor 50 to move the edge binder 25 to the other side in the main scanning direction until the crimper 32 reaches the binding posture changing position C. The binding posture changing position C is a position at which the crimper 32 is rotated from the parallel binding posture to the inclined binding posture. Further, the binding posture changing position C is a position closer to the standby position HP, than the first binding position B1 and further from the standby position HP, than the application posture changing position D (the installation position of the posture changing member 114).

Then, in response to the arrival of the crimper 32 to the binding posture changing position C, the controller 100*b* stops the edge binder movement motor 50. As illustrated in FIG. 18B, the controller 100*b* drives the crimper pivot motor 56 to change the posture of the crimper 32 from the parallel binding posture to the inclined binding posture. On the other hand, at this time, the liquid applier 31 keeps the parallel application posture.

Then, the controller 100*b* drives the edge binder movement motor 50 to move the edge binder 25 to the other side in the main scanning direction until the liquid applier 31 passes the application posture changing position D to the standby position HP. Then, as illustrated in FIG. 18C, the liquid applier 31 changes the posture from the parallel application posture to the inclined application posture in the course of passing through the application posture changing position D. At this time, since the crimper 32 is already in the inclined binding posture, the liquid applier 31 rotating toward the inclined application posture does not collide with the crimper 32.

The controller 100*b* drives the edge binder movement motor 50 to move the edge binder 25 to the one side in the main scanning direction until the liquid applier 31 reaches the application posture changing position D. Then, as illustrated in FIG. 19A, the liquid applier 31 that has reached the application posture changing position D changes the posture from the inclined application posture to the parallel application posture.

As illustrated in FIG. 19B, the controller 100*b* drives the crimper pivot motor 56 to change the posture of the crimper 32 from the inclined binding posture to the parallel binding posture.

At this time, since the liquid applier 31 is already in the parallel application posture, the crimper 32 rotating toward the parallel binding posture does not collide with the liquid applier 31.

Then, the controller 100*b* drives the edge binder movement motor 50 to move the edge binder 25 to the other side in the main scanning direction until the edge binder 25 reaches the standby position HP. As a result, as illustrated in FIG. 19C, the edge binder 25 reaches the standby position HP while the liquid applier 31 keeps the parallel application posture and the crimper 32 keeps the parallel binding posture.

Figure 20A:
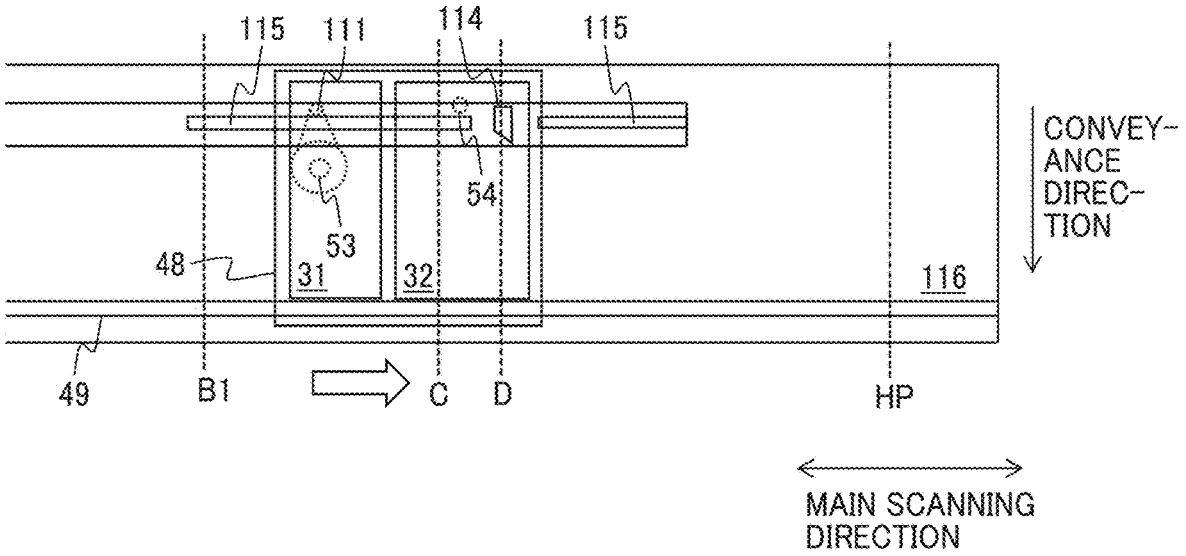
FIGS. 20A and 20B are diagrams illustrating a process of moving the edge binder to the standby position after the edge binder has performed the binding process with a wrong procedure.
Figure 20B:
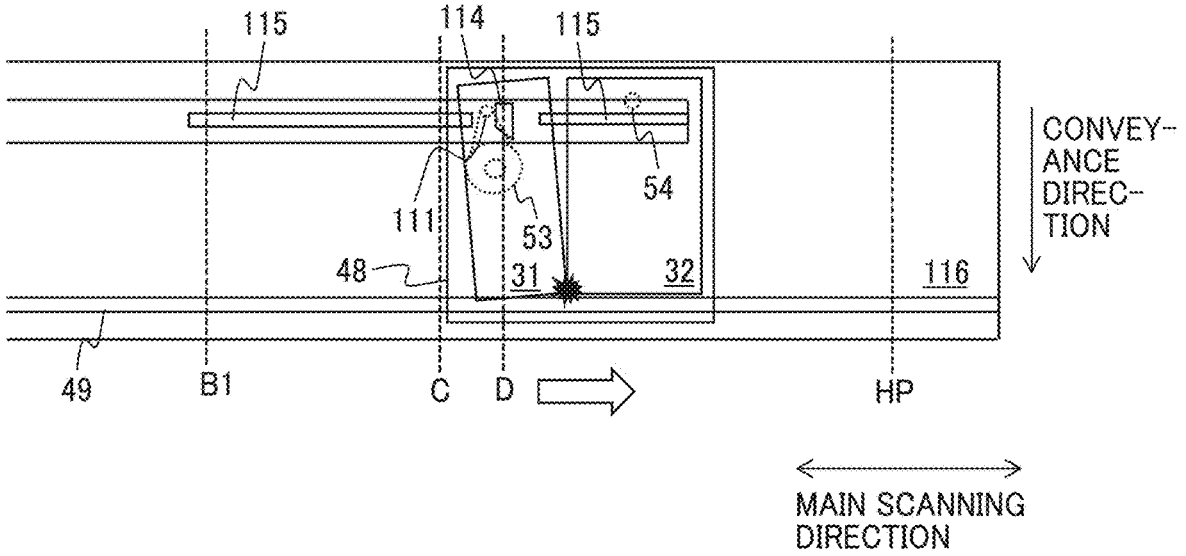

A description is given of a wrong procedure to move the edge binder 25 to the other side in the main scanning direction from the position facing the first binding position B1 to the standby position HP, with reference to FIGS. 20A and 20B.

FIGS. 20A and 20B are diagrams illustrating a process of moving the edge binder to the standby position HP after the edge binder 25 has bound the first binding position B1 with a wrong procedure.

The controller 100*b* ascertains the position of the edge binder 25 in the main scanning direction, based on the accumulated value of the pulse signals output from the first encoder sensor 44*b*. Accordingly, if a user who intends to perform a paper jam handling by moving the door 4 to the open position moves the edge binder 25 in the main scanning direction, the position of the edge binder 25 grasped by the controller 100*b* and the actual position of the edge binder 25 are different from each other.

For example, it is assumed that the user moves the edge binder 25 (see FIG. 18A) at the position facing the first binding position B1 to the position further than the binding posture changing position C to the standby position HP (see FIG. 20A). At this time, the liquid applier 31 is in the parallel application posture and the crimper 32 is in the parallel binding posture.

In this case, the controller 100*b* drives the edge binder movement motor 50 to move the edge binder 25 to the other side in the main scanning direction (the direction indicated by arrow in FIG. 20A), the liquid applier 31 is rotated from the parallel application posture to the inclined application posture in the process of passing through the application posture changing position D. However, as illustrated in FIG. 20B, since the crimper 32 is still in the parallel binding posture, the liquid applier 31 to be rotated to the inclined application posture collides with the crimper 32.

As illustrated in FIGS. 21A, 21B, 21C, 22A, and 22B, the post-processing apparatus 3 according to the present embodiment further includes a collision avoidance assembly 90.

Figure 21A:
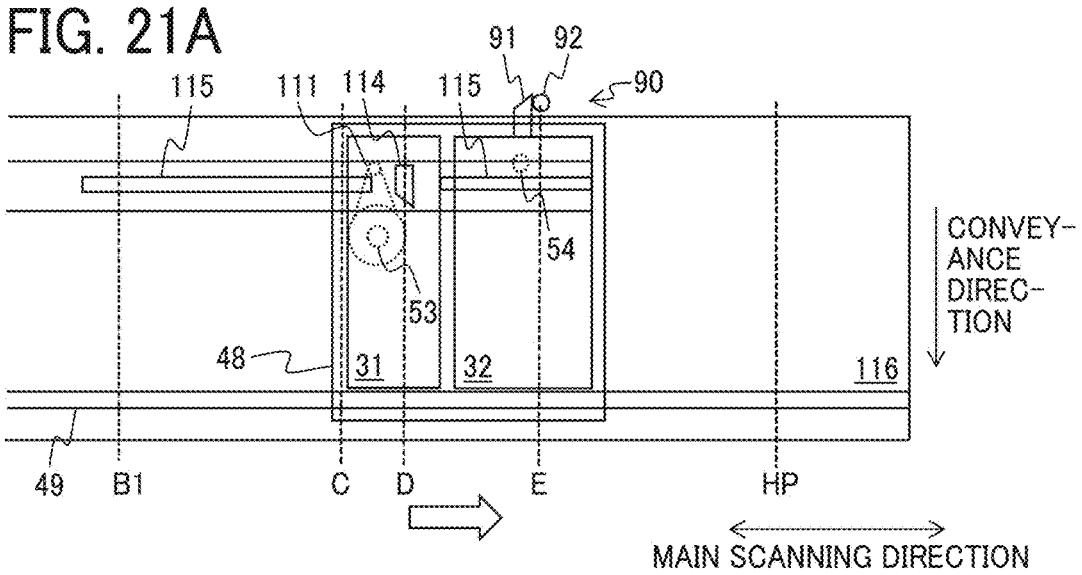
FIGS. 21A, 21B, and 21C are diagrams illustrating a collision avoidance assembly, viewed from the thickness direction of a sheet placed on an internal tray.
Figure 21B:
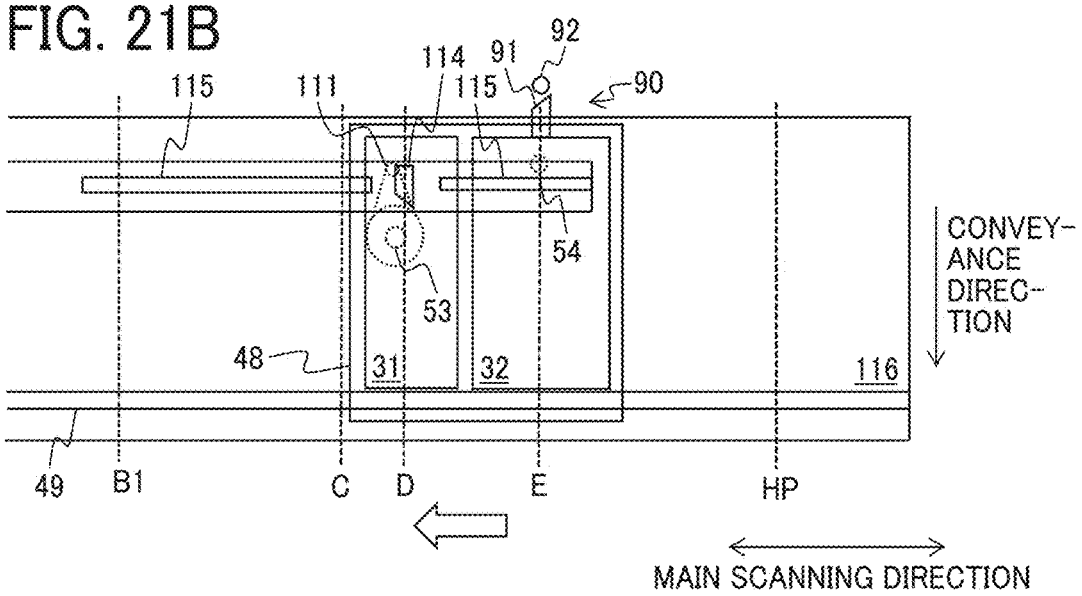
Figure 21C:
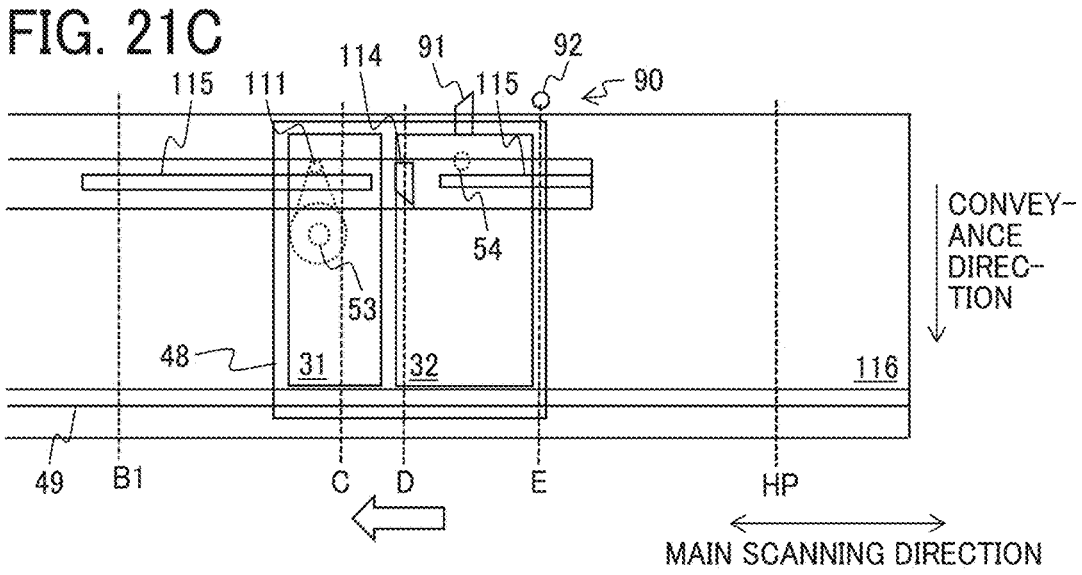

FIGS. 21A, 21B, and 21C are diagrams illustrating the collision avoidance assembly 90, viewed from the thickness direction of the sheet P placed on the internal tray 22.

Figure 22A:
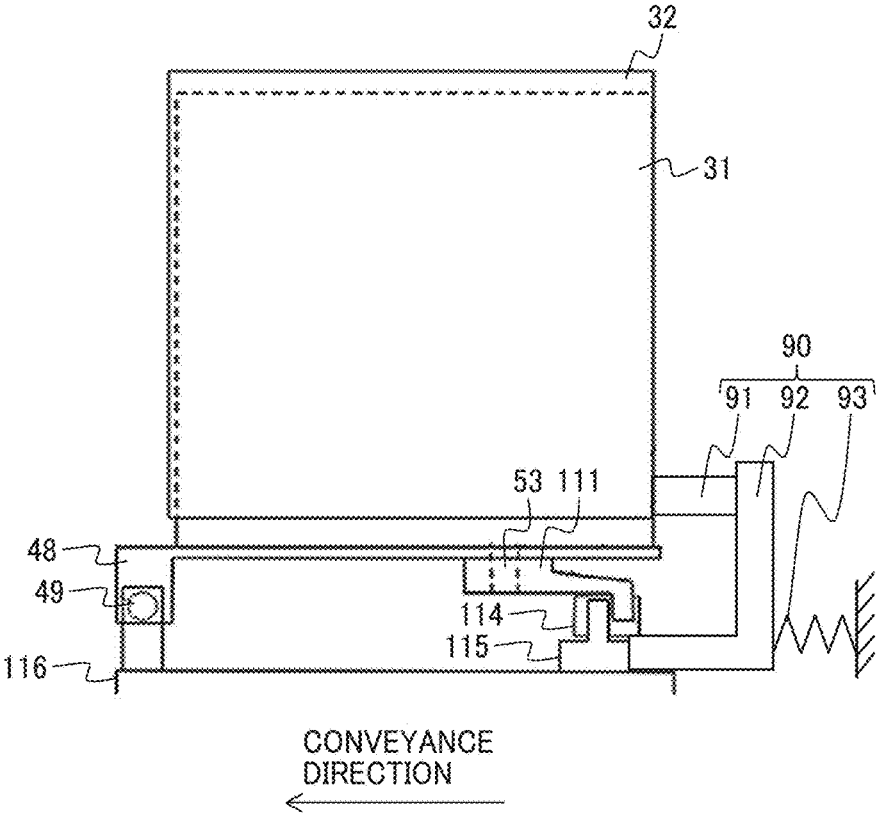
FIGS. 22A and 22B are diagrams illustrating the collision avoidance assembly, viewed in the main scanning direction.
Figure 22B:
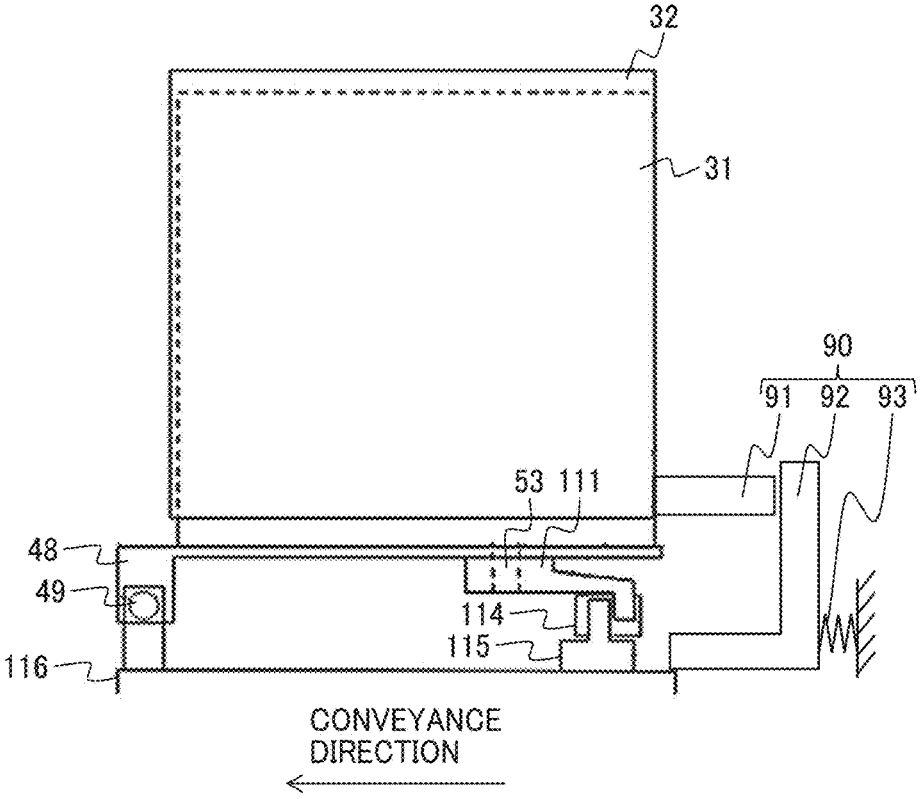

FIGS. 22A and 22B are diagrams illustrating the collision avoidance assembly 90, viewed in the main scanning direction.

The collision avoidance assembly 90 is a mechanism that restricts the liquid applier 31 from passing through the application posture changing position D while the crimper 32 is in the parallel binding posture in the process in which the edge binder 25 is moved to the other side in the main scanning direction. As illustrated in FIGS. 21A to 22B, the collision avoidance assembly 90 includes a restriction member 91, a contact member 92, and a coil spring 93 (serving as a biasing member).

The restriction member 91 is attached to the upstream end of the crimper 32 in the conveyance direction of the sheet P. The restriction member 91 moves in the main scanning direction with the crimper 32 and rotates about the crimper shaft 54 with the crimper 32 in the forward and reverse directions. The face of the restriction member 91 close to the standby position HP is orthogonal to the main scanning direction, in other words, is matched to the conveyance direction of the sheet P. On the other hand, the face of the restriction member 91 opposite to the standby position HP is a tapered face that is narrowed (in other words, tapered) toward the upstream side in the main scanning direction.

The contact member 92 is attached to a binding assembly base 116 (serving as a support) that movably supports the edge binder 25 in the main scanning direction. The contact member 92 is disposed at a restriction position E in the main scanning direction. Further, the contact member 92 is movable in the conveyance direction of the sheet P between a contact position illustrated in FIGS. 21A, 21C, and 22A and a retracted position illustrated in FIGS. 21B and 22B. A coil spring 93 biases the contact member 92 toward the contact position.

The restriction position E is a position closer to the standby position HP than the application posture changing position D in the main scanning direction. The restriction position E is a position at which the crimper 32 (more specifically, the restriction member 91) reaches before the liquid applier 31 (more specifically, the posture changing lever 111) reaches the application posture changing position D when the edge binder 25 moves to the other side in the main scanning direction.

The contact position is a position at which the crimper 32 overlaps with the trajectory of movement of the restriction member 91 when the crimper 32 is in the parallel binding posture. The contact position is a position deviated toward the upstream side in the conveyance direction of the sheet P from the trajectory of movement of the restriction member 91 when the crimper 32 is in the inclined binding posture. The retracted position is a position deviated toward the upstream side in the conveyance direction of the sheet P from the trajectory of movement of the restriction member 91 when the crimper 32 is in the parallel binding posture.

Due to such a configuration, as illustrated in FIG. 21A, as the edge binder 25 moves to the other side in the main scanning direction (the direction indicated by arrow in FIG. 21A) while the crimper 32 keeps the parallel binding posture, the restriction member 91 contacts the contact member 92 at the contact position before the posture changing lever 111 contacts the posture changing member 114. As a result, the collision avoidance assembly 90 prevents the crimper 32 in the parallel binding posture passes the restriction position E to the standby position HP (the other side in the main scanning direction). On the other hand, when the crimper 32 changes the position to the inclined binding posture and the edge binder 25 moves to the other side in the main scanning direction, the restriction member 91 does not contact the contact member 92 at the contact position. As a result, the collision avoidance assembly 90 allows the crimper 32 in the inclined binding posture passes the restriction position E to the standby position HP.

As illustrated in FIG. 21B, when the edge binder 25 moves to the one side in the main scanning direction (the direction indicated by arrow in FIG. 21B) while the crimper 32 is in the parallel binding posture, the tapered face of the restriction member 91 contacts the contact member 92 at the contact position and the contact member 92 moves to the retracted position against the biasing force of the coil spring 93. As a result, the collision avoidance assembly 90 allows the crimper 32 in the parallel binding posture to pass through the restriction position E to the side opposite to the standby position HP (the one side in the main scanning direction). Further, as illustrated in FIG. 21C, when the restriction member 91 passes through the restriction position E, the contact member 92 returns to the contact position again by the biasing force of the coil spring 93.

A description is given of a return process to move the edge binder 25 to the standby position HP while avoiding the collision of the liquid applier 31 and the crimper 32, with reference to FIGS. 23, 24A, 24B, and 24C.

Figure 23:
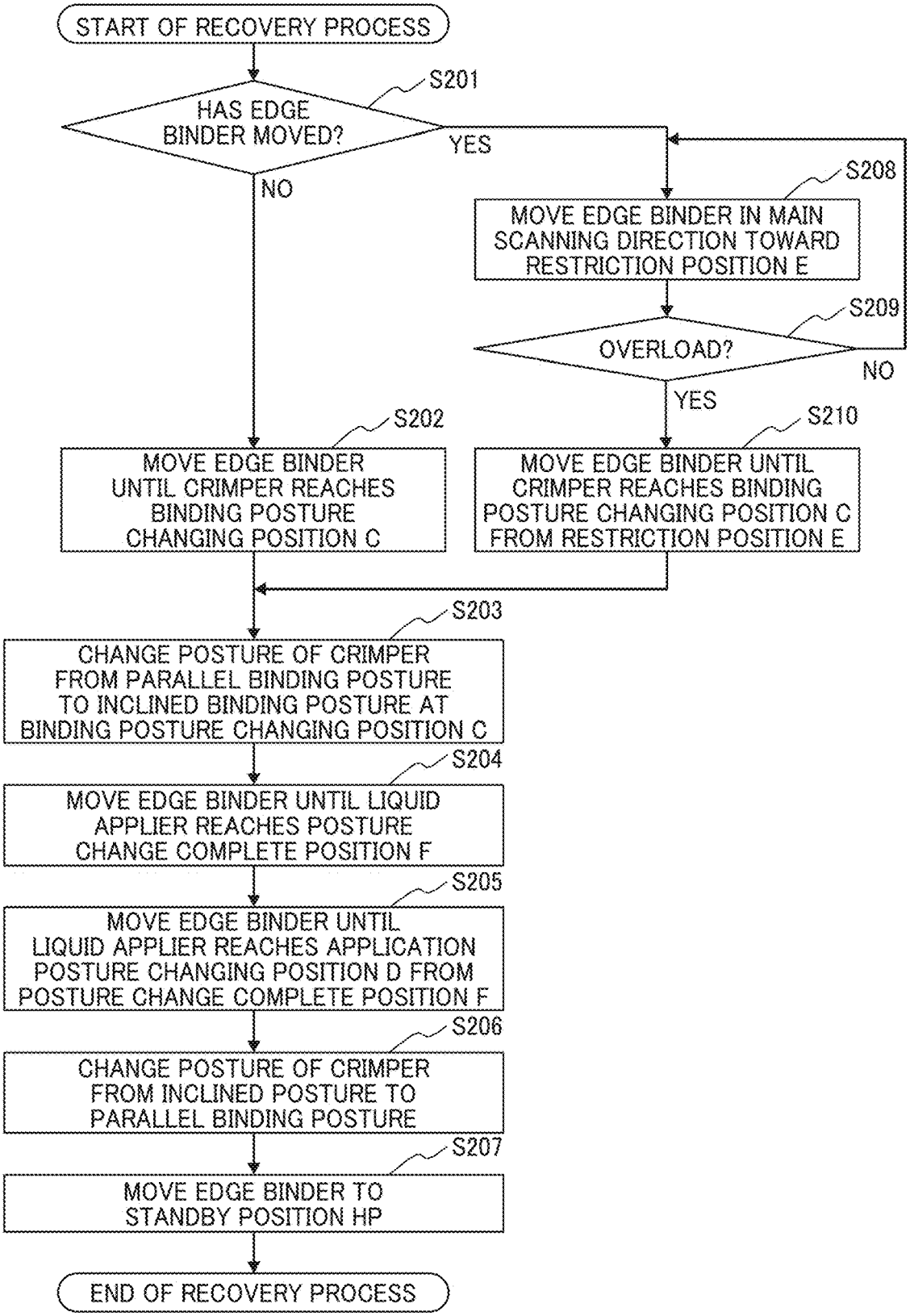
FIG. 23 is a flowchart of a recovery process.

FIG. 23 is a flowchart of an example of the return process.

Figure 24A:
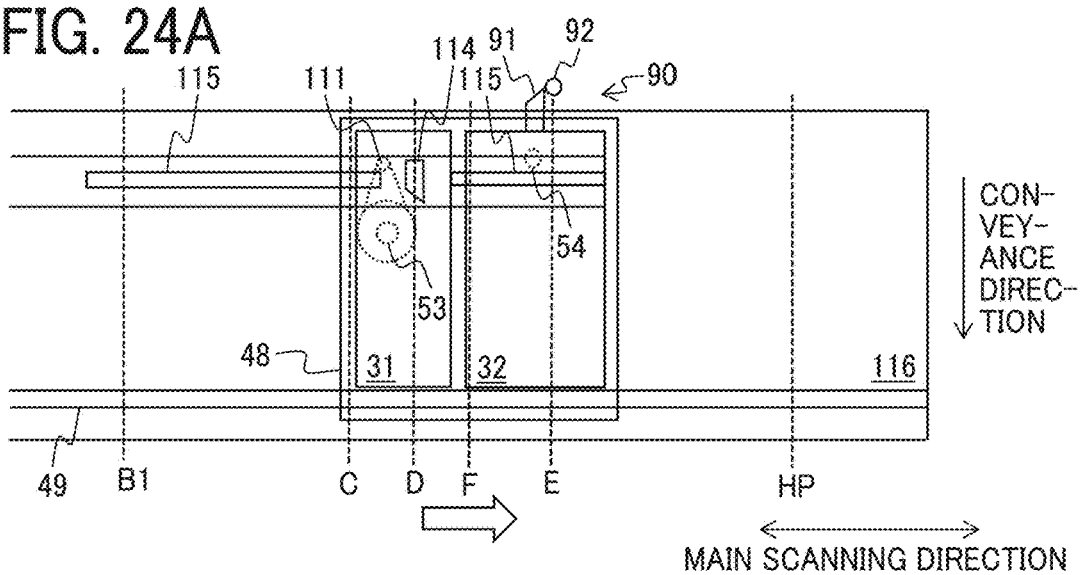
FIGS. 24A, 24B, and 24C are diagrams each illustrating the positions of the liquid applier and the crimper during the recovery process.
Figure 24B:
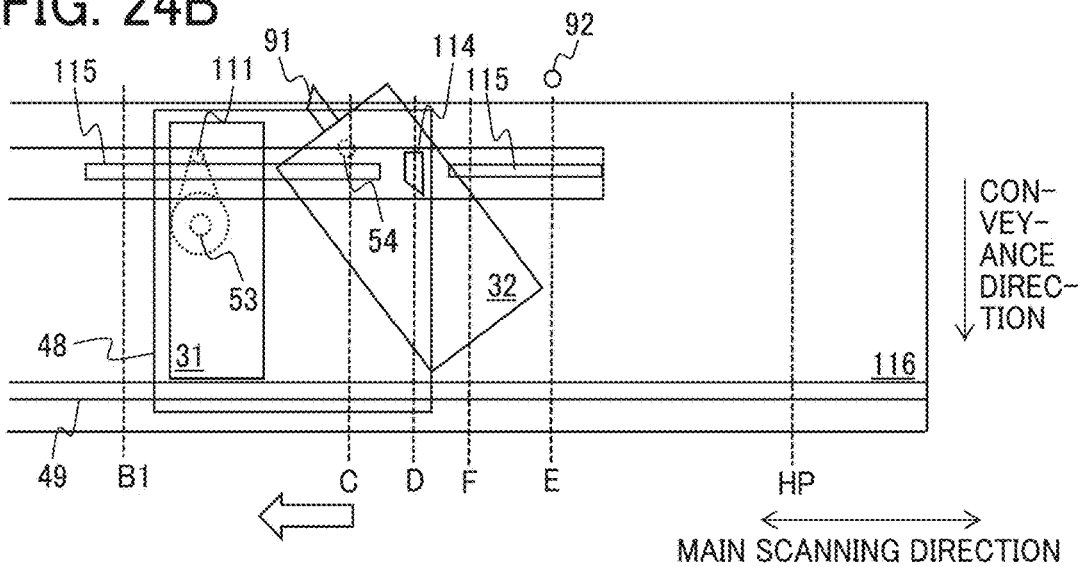
Figure 24C:
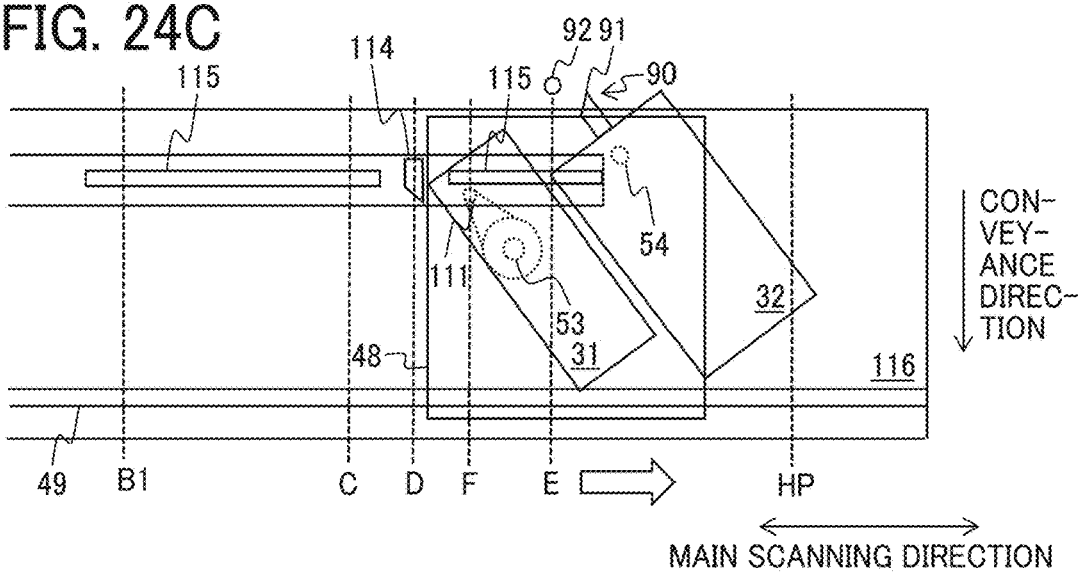

FIGS. 24A, 24B, and 24C are diagrams illustrating the positions and postures of the liquid applier 31 and the crimper 32 during the return process of FIG. 23.

As an example, the controller 100*b* executes the return process illustrated in FIG. 23 after the binding process is normally ended. As another example, the controller 100*b* executes the return process illustrated in FIG. 23 after the binding processing is abnormally ended (for example, the sheet bundle Pb is removed by the paper jam handling).

At the start of the return process, it is assumed that the liquid applier 31 is in the parallel application posture and the crimper 32 is in the parallel binding posture. At the end of the return process, it is assumed that the liquid applier 31 is in the parallel application posture, the crimper 32 is in the parallel binding posture, and the edge binder 25 reaches the standby position HP. Further, the distance between the two positions spaced apart in the main scanning direction (the amount of movement in the main scanning direction) are specified in advance by the number of pulse signals output from the first encoder sensor 44*b*. In other words, the controller 100*b* also counts pulse signals output from the first encoder sensor 44*b* to determine that the edge binder 25 at the first position has reached the second position.

The controller 100*b* initially determines whether the edge binder 25 is moved by the force different from the driving force of the edge binder movement motor 50 (step S201). The action "the edge binder 25 is moved by the force different from the driving force of the edge binder movement motor 50" may indicate, for example, the action that the user moves the edge binder 25 by hand or the action that the edge binder 25 is moved by being caught by the sheet P to be removed from the internal tray 22." Further, the controller 100*b* may indirectly recognize the high probability of movement of the edge binder 25, in step S201, without being limited by directly detecting whether the edge binder 25 is moved by the force different from the driving force of the edge binder movement motor 50 binder 25 is moved by the force different from the driving force of the edge binder movement motor 50.

As an example, when a sensor detects the opening or closing of the door 4, the controller 100*b* may determine that the edge binder 25 is highly likely to have moved. As another example, when a sensor detects that the component (such as a pulley or a timing belt) of the driving force transmission assembly 51 has moved when the edge binder movement motor 50 is not driven, the controller 100*b* may determine that the edge binder 25 is highly likely to have moved. However, a specific method of determining that the edge binder 25 is moved by the force different from the driving force of the edge binder movement motor 50 is not limited to the aforementioned example.

Then, when the controller 100*b* determines that the edge binder 25 is moved by the force different from the driving force of the edge binder movement motor 50 (in other words, the binding process has normally ended) (NO in step S201), as illustrated in FIG. 18A, the controller 100*b* drives the edge binder movement motor 50 in the forward direction to move the edge binder 25 to the other side in the main scanning direction until the crimper 32 reaches the binding posture changing position C (step S202). Then, when the controller 100*b* determines that the crimper 32 has reached the binding posture changing position C, as illustrated in FIG. 18B, the controller 100*b* drives the crimper pivot motor 56 to change the posture of the crimper 32 from the parallel binding posture to the inclined binding posture (step S203).

Then, when the controller 100*b* determines that the crimper 32 has changed the posture to the inclined binding posture, the controller 100*b* drives the edge binder movement motor 50 in the forward direction again. By so doing, as illustrated in FIG. 18C, the edge binder 25 is moved to the other side in the main scanning direction until the liquid applier 31 reaches a change completion position F (step S204). The change completion position F is a position closer to the standby position HP than the application posture changing position D. The change completion position F is also a position at which the posture change of the liquid applier 31 from the parallel application posture to the inclined application posture is completed. Accordingly, the liquid applier 31 changes the posture from the parallel application posture to the inclined application posture in the course when the liquid applier 31 passes through the application posture changing position D. Further, since the crimper 32 is already in the inclined binding posture, the restriction member 91 does not contact the contact member 92 at the restriction position E.

Then, when the controller 100*b* determines that the liquid applier 31 has reached the change completion position F, the controller 100*b* drives the edge binder movement motor 50 in the reverse direction. By so doing, as illustrated in FIG. 19A, the controller 100*b* causes the edge binder 25 to move to the one side in the main scanning direction until the liquid applier 31 reaches the application posture changing position D (step S205). More specifically, the controller 100*b* stops the edge binder movement motor 50 before the posture changing lever 111 contacts the posture changing member 114 to cause the liquid applier 31 to change the posture from the inclined application posture to the parallel application posture and the posture changing lever 111 passes the posture changing member 114 to the one side in the main scanning direction.

Then, when the controller 100*b* determines that the liquid applier 31 has reached the application posture changing position D, the controller 100*b* drives the crimper pivot motor 56. By so doing, as illustrated in FIG. 19B, the crimper 32 changes the posture from the inclined binding posture to the parallel binding posture (step S206). Then, when the controller 100*b* determines that the crimper 32 has changed the posture to the parallel binding posture, the controller 100*b* drives the edge binder movement motor 50 in the forward direction again. By so doing, as illustrated in FIG. 19C, the edge binder 25 is moved to the other side in the main scanning direction until the edge binder 25 reaches the standby position HP (step S207).

On the other hand, when the controller 100*b* determines that the edge binder 25 is moved by the force different from the driving force of the edge binder movement motor 50, in other words, the binding process is abnormally ended (YES in step S201), the controller 100*b* drives the edge binder movement motor 50 in the forward direction to move the edge binder to the other side in the main scanning direction toward the restriction position E (the direction indicated by the arrow in FIG. 24A), as illustrated in FIG. 24A (step S208). When the edge binder 25 is moved by the force different from the driving force of the edge binder movement motor 50, it is likely that the accumulated value of the pulse signals output from the first encoder sensor 44*b* does not correctly reflect the current location of the edge binder 25.

On the other hand, the controller 100*b* increases the volume of electric current to be supplied to the edge binder movement motor 50 serving as a servo motor so as to cause the edge binder 25 to reach the target position. In other words, as illustrated in FIG. 24A, as the restriction member 91 contacts the contact member 92 at the restriction position E and the edge binder 25 is restricted from moving to the other side in the main scanning direction, the volume of electric current to be supplied to the edge binder movement motor 50 is gradually increased. In other words, after the volume of electric current to be supplied to the edge binder movement motor 50 is increased to be greater than the threshold value (referred to as an "overload"), the controller 100*b* can determine that the restriction member 91 has contacted the contact member 92 (in other words, the crimper 32 has reached the restriction position E).

The controller 100*b* continues to drive the edge binder movement motor 50 in the forward direction (step S208) until the controller 100*b* detects the overload of the edge binder movement motor 50 (NO in step S209). Then, after the controller 100*b* detects the overload of the edge binder movement motor 50 (YES in step S209), the controller 100*b* drives the edge binder movement motor 50 in the reverse direction. By so doing, as illustrated in FIG. 24B, the controller 100*b* moves the edge binder 25 to the one side in the main scanning direction (the direction indicated by the arrow in FIG. 24B) until the crimper 32 is moved from the restriction position E to the binding posture changing position C (step S210). Since the distance (amount of movement) between the restriction position E and the binding posture changing position C is specified in advance by the number of pulse signals, the controller 100*b* can determine that the crimper 32 has reached the binding posture changing position C by counting the number of pulse signals output from the first encoder sensor 44*b*. At the timing of step S210, the liquid applier 31 still in the parallel application posture.

Then, the controller 100*b* executes the processes of the above-described steps S203 to S207 in accordance with the determination that the crimper 32 has reached the binding posture changing position C. As a result, as illustrated in FIG. 24B, the crimper 32 changes the posture to the inclined binding posture (step S203). Then, as illustrated in FIG. 24C, the edge binder 25 can pass the restriction position E while the restriction member 91 does not contact the contact member 92 (step S204). Then, as in steps S205 to S207, in other words, as illustrated in FIGS. 19A to 19C, the edge binder 25 can be returned to standby position HP.

Now, a description is given of some or all of the advantages according to the embodiment described above, the enumeration of which is not exhaustive or limiting.

According to the embodiment, the collision avoidance assembly 90 can prevent the crimper 32 from passing through the regulating position E while keeping the parallel binding posture. As a result, when the edge binder 25 returns to the standby position HP, the crimper 32 can change the posture to the inclined binding posture, and then the liquid applier 31 can change the posture to the inclined binding posture. As a result, the liquid applier 31 is prevented from colliding with the crimper 32.

According to the embodiment, the contact member 92 movable between the contact position and the retracted position is biased toward the contact position by the coil spring 93, and the face on one side of the restriction member 91 is formed as a tapered face. Thus, the crimper 32 in the parallel binding posture can be allowed to move to one side in the main scanning direction and prevented from moving to the other side in the main scanning direction with a simple configuration.

Furthermore, according to the embodiment, by executing the return process illustrated in FIG. 23, even when the edge binder 25 is moved by a force different from the driving force of the edge binder movement motor 50 and the current position cannot be accurately grasped, the edge binder 25 can be moved to the standby position HP without causing the liquid applier 31 and the crimper 32 to collide with each other.

Figure 34A:
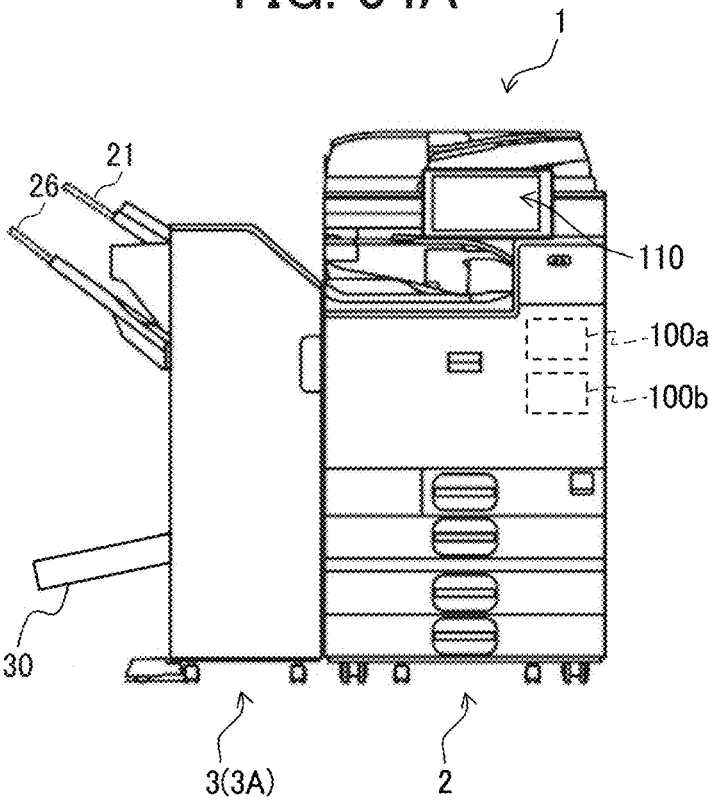
FIGS. 34A and 34B are diagrams illustrating a post-processing apparatus including controllers as a first modification of the present embodiment.
Figure 34B:
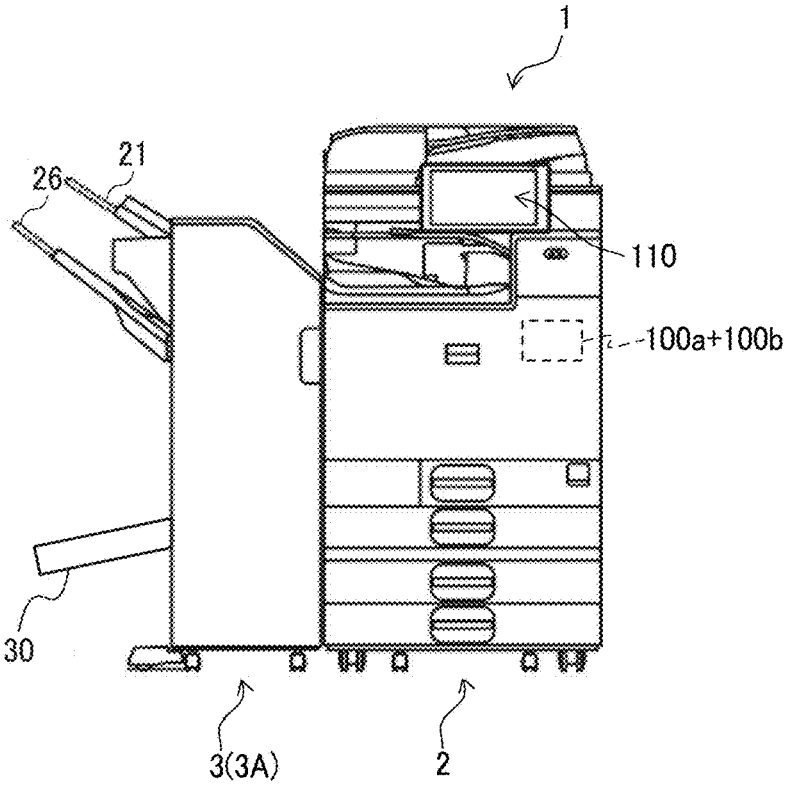

In the above description, the controller 100*b* of the post-processing apparatus 3 is provided separately from the controller 100*a* of the image forming apparatus 2 as illustrated in FIG. 1. However, embodiments of the present disclosure are not limited to the above-described configuration. For example, as illustrated in FIG. 34A, the controller 100*b* of the post-processing apparatus 3 may be disposed in the image forming apparatus 2. Further, as illustrated in FIG. 34B, the controller 100*b* of the post-processing apparatus 3 may be integrated with the controller 100*a* of the image forming apparatus 2.

Figure 35A:
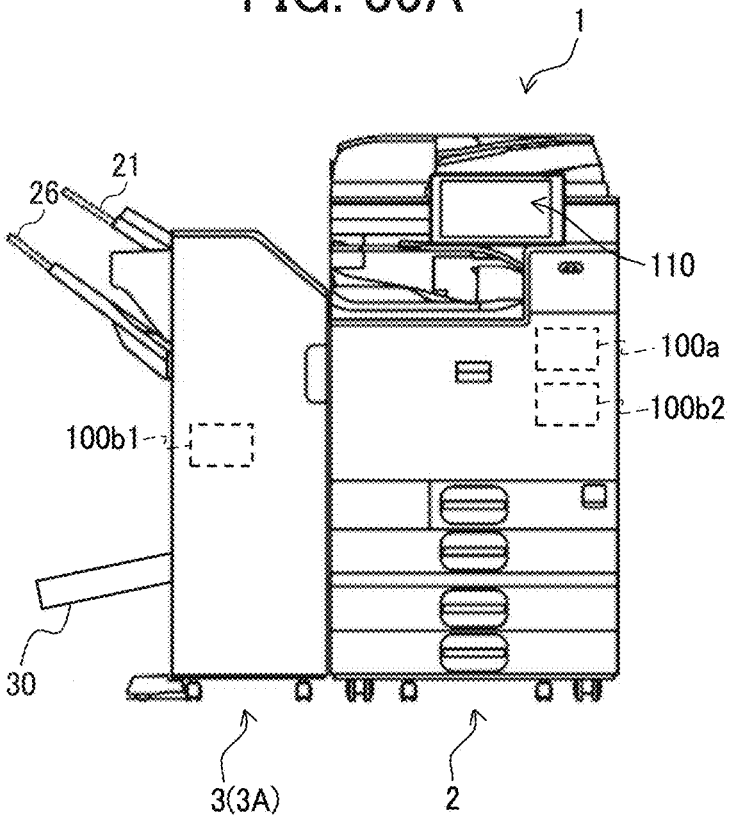
FIGS. 35A and 35B are diagrams each illustrating a post-processing apparatus including controllers as a second modification of the present embodiment.
Figure 35B:
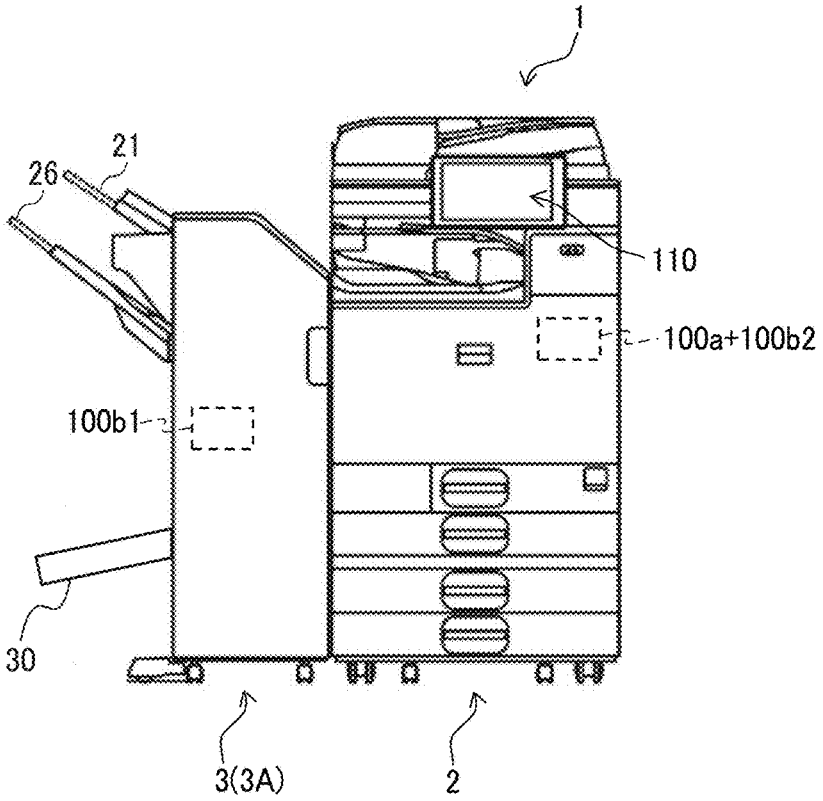

As illustrated in FIG. 35A, the controller 100*b* of the post-processing apparatus 3 may be divided into a controller 100*b*1 (e.g., a drive unit such as a motor) and a controller 100*b*2 (a detector such as a sensor) according to the function, and the controller 100*b*2 of the post-processing apparatus 3 may be disposed in the image forming apparatus 2. Further, as illustrated in FIG. 35B, the controller 100*b*2 of the post-processing apparatus 3 disposed in the image forming apparatus 2 may be integrated with the controller 100*a* of the image forming apparatus 2.

Another Embodiment of Post-Processing Apparatus

Referring now to FIGS. 25 to 33, a description is given of a post-processing apparatus 3A according to another embodiment of the present disclosure.

In the following description, components like those of the above-described embodiment are denoted by like reference numerals, and detailed descriptions thereof may be omitted.

The post-processing apparatus 3A according to another embodiment includes an edge binder 251. The edge binder 251 is different from the edge binder 25 of the post-processing apparatus 3 according to the first embodiment, in which the liquid applier 31 and the crimper 32 are arranged side by side, in that the edge binder 251 includes a crimper 32' and a liquid applier 131 is disposed at an upstream position of a conveyance passage in a direction in which a sheet P is conveyed. Such a configuration allows a given number of sheets P to be stacked after the liquid application process and conveyed to the crimper 32' of the edge binder 251 disposed at a downstream position of the conveyance passage in the direction in which the sheet P is conveyed. Accordingly, the productivity of the binding process performed by the crimper 32' is enhanced.

Since the direction in which the conveyance roller pairs 10, 11, and 14 convey the sheet P is opposite to the "conveyance direction" defined above, the direction in which the conveyance roller pairs 10, 11, and 14 convey the sheet P is defined as an "opposite conveyance direction" in the following description. A direction that is orthogonal to both the opposite conveyance direction and the thickness direction of the sheet P is defined as the "main scanning direction" or the "width direction of the sheet P."

The liquid application position to which liquid is applied on a sheet P or a sheet bundle Pb by the liquid applier 31 corresponds to the binding position on the sheet bundle Pb to be crimped by the crimper 32'. For this reason, in the following description, the liquid application position and the binding position are denoted by the same reference sign (B1).

Figure 25:
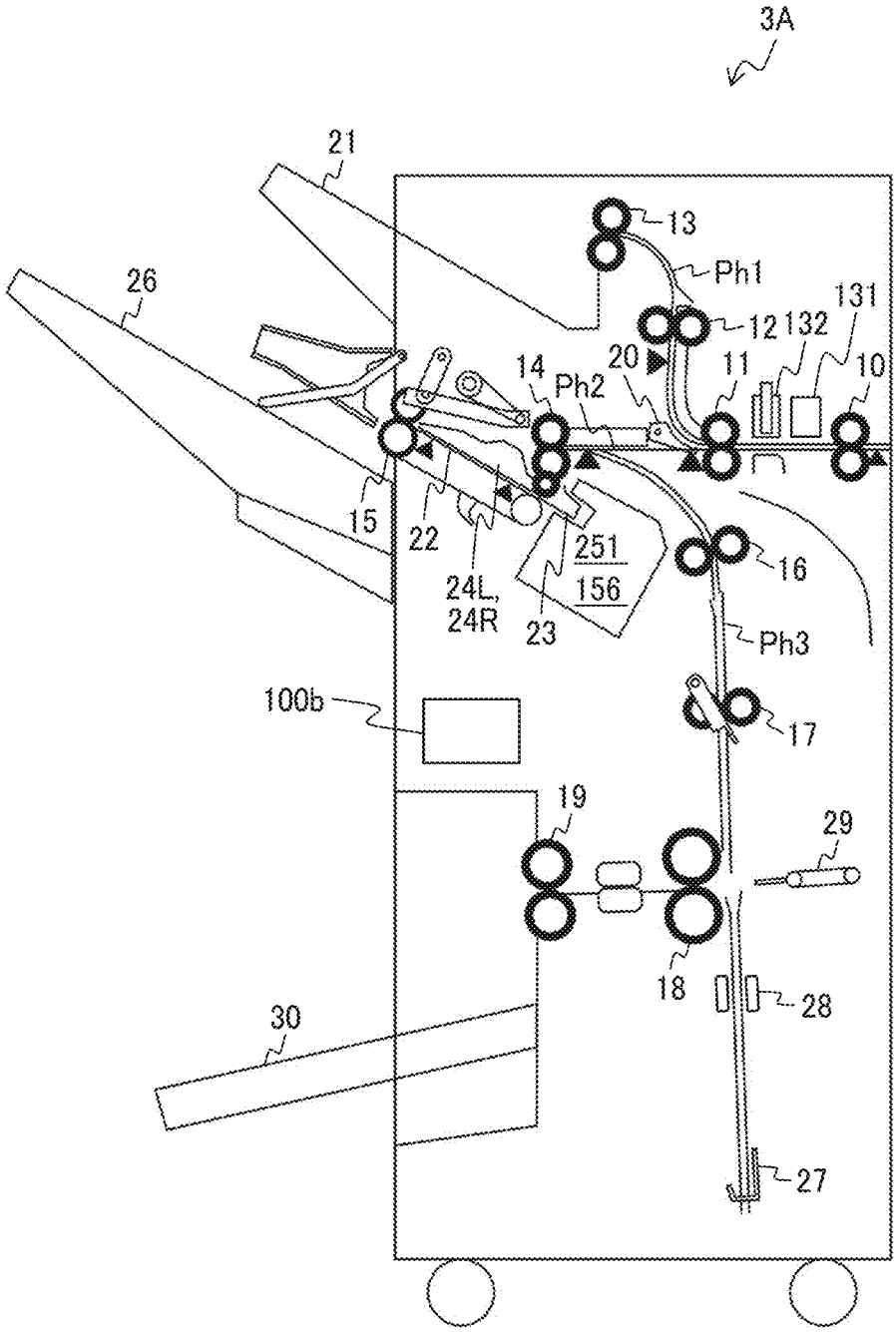
FIG. 25 is a diagram illustrating the internal configuration of a post-processing apparatus according to another embodiment of the present disclosure.

FIG. 25 is a diagram illustrating an internal configuration of the post-processing apparatus 3A according to another embodiment of the present disclosure.

Figure 26A:
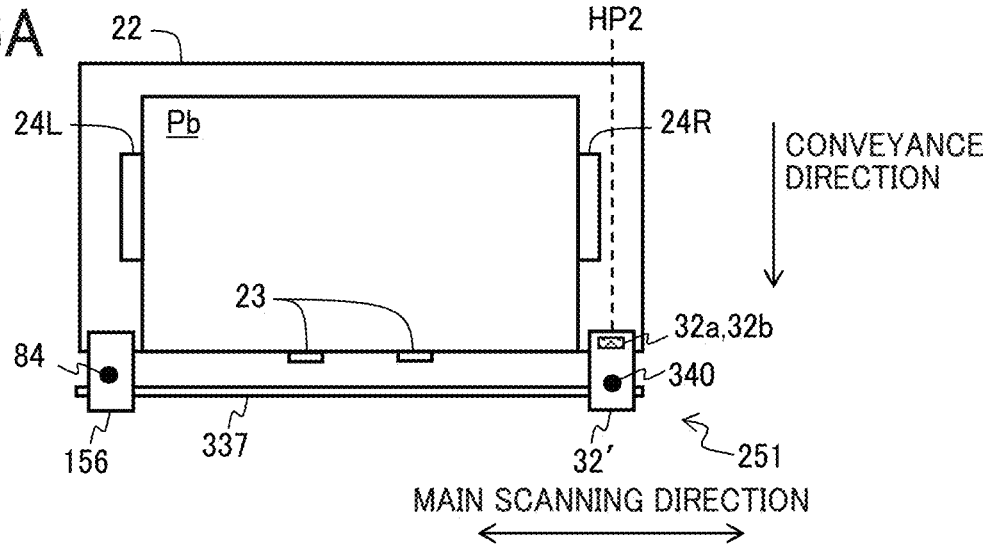
FIGS. 26A, 26B, and 26C are diagrams each illustrating an internal tray of the post-processing apparatus according to another embodiment, viewed from the thickness direction of a sheet.
Figure 26B:
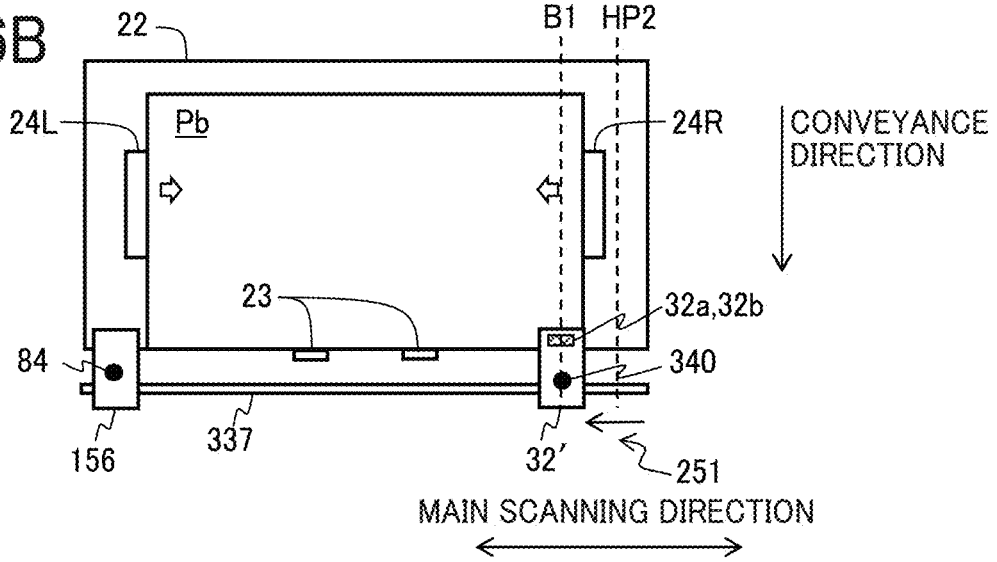
Figure 26C:
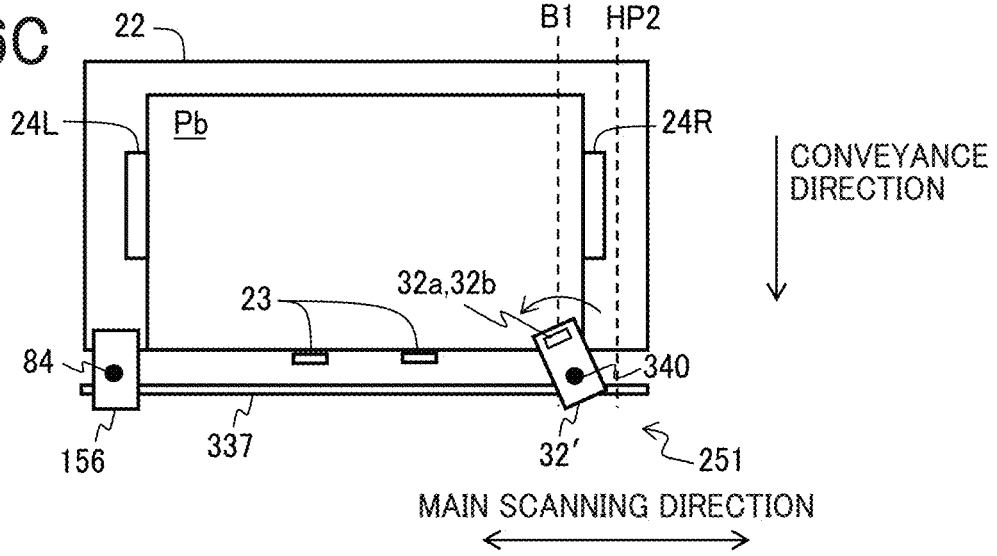

As illustrated in FIGS. 26A, 26B, and 26C, the edge binder 251 includes the crimper 32' alone. As illustrated in FIGS. 26A, 26B, and 26C, the crimper 32' and the staple binder 156 are disposed downstream from the internal tray 22 in the conveyance direction.

In addition, the crimper 32' and the staple binder 156 are located to face a downstream end, in the conveyance direction, of the sheet bundle Pb placed on the internal tray 22 and is movable in the main scanning direction.

Further, the crimper 32' and the staple binder 156 are respectively rotatable in the forward and reverse directions about a crimper shaft 340 and a stapler shaft 84 both extending in the thickness direction of the sheet bundle Pb placed on the internal tray 22. In other words, the crimper 32' and the staple binder 156 bind, at a desired angle, a desired position in the main scanning direction on the sheet bundle Pb placed on the internal tray 22 in, for example, corner oblique binding, parallel one-point binding, or parallel two-point binding.

The crimper 32' presses and deforms the sheet bundle Pb with the serrate upper crimping teeth 32*a* and the serrate lower crimping teeth 32*b* to bind the sheet bundle Pb. In the following description, such a binding way may be referred to as "crimping." In other words, the crimper 32' crimps and binds the sheet bundle Pb or performs the crimping on the sheet bundle Pb. On the other hand, the staple binder 156 passes the staple through a binding position on the sheet bundle Pb placed on the internal tray 22 to staple the sheet bundle Pb.

Each of FIGS. 26A, 26B, and 26C is a view of the internal tray 22 in the thickness direction of the sheet bundle Pb.

Figure 27:
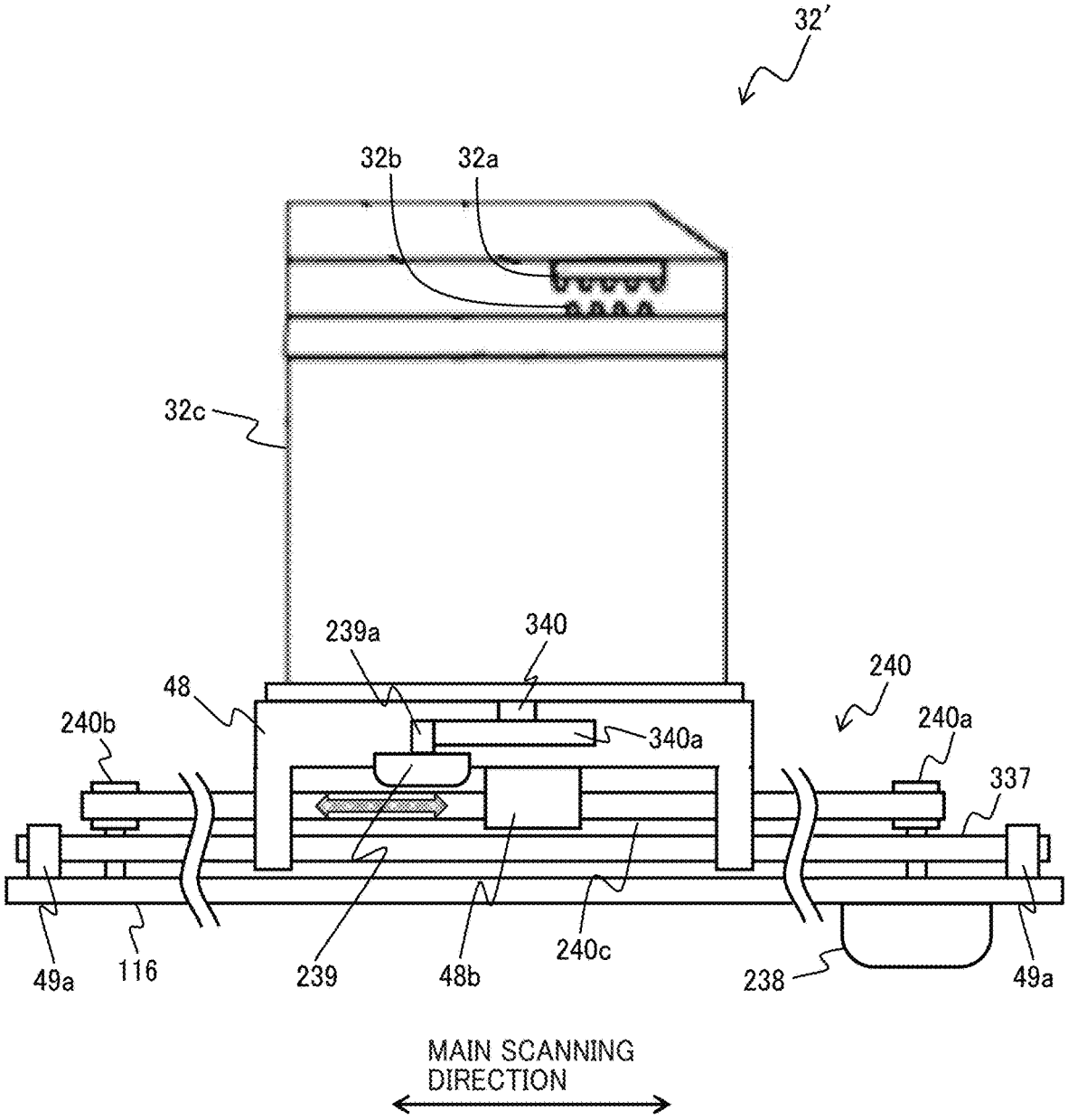
FIG. 27 is a schematic diagram illustrating a crimper of the post-processing apparatus according to another embodiment of the present disclosure, viewed from the downstream side of the crimper in the conveyance direction of a sheet.

FIG. 27 is a schematic diagram illustrating the crimper 32' as viewed from the downstream side in the conveyance direction.

As illustrated in FIGS. 26A, 26B, and 26C, the crimper 32' and the staple binder 156 are disposed downstream from the internal tray 22 in the conveyance direction. The crimper 32' is movable in the main scanning direction along the surface of the sheet bundle Pb placed on the internal tray 22. Further, the crimper 32' is rotatable in the forward and reverse directions about a crimper shaft 340 extending in the thickness direction of the sheet bundle Pb placed on the internal tray 22.

Similarly, the staple binder 156 is movable in the main scanning direction of the sheet bundle Pb. Further, the staple binder 156 is rotatable in the forward and reverse directions about a stapler shaft 84 extending in thickness direction of the sheet bundle Pb. The other components of the staple binder 156 are similar to, even if not the same as, those of the staple binder 55 (see FIG. 12) of the post-processing apparatus 3 according to the first embodiment. For this reason, a detailed description thereof is omitted.

As illustrated in FIG. 27, the crimper 32' includes a guide rail 337 extending in the main scanning direction at a position downstream from the internal tray 22 in the conveyance direction. The crimper 32' includes a crimper movement motor 238 as a driving source. The base 48 supporting the crimping frame 32*c* has a fastening portion 48*b* for fastening the timing belt 240*c* at the bottom of the base 48. The driving force of the crimper movement motor 238 is transmitted to the base 48 by the drive transmission assembly 240 that includes the pullies 240*a* and 240*b*, the timing belt 240*c*, and the fastening portion 48*b*. By so doing, the crimper 32' is moved in the main scanning direction along the surface of the sheet bundle Pb placed on the internal tray 22, in other words, along the guide rail 337. A crimper shaft 340 including a drive transmission gear 340*a* is fixed to a bottom face of the crimping frame 32*c* that holds the components of the crimper 32'.

The crimper shaft 340 and the drive transmission gear 340*a* are held by the base 48 on which the crimping frame 32*c* is disposed, so as to be rotatable in the forward and reverse directions. The drive transmission gear 340*a* meshes with an output gear 239*a* of a crimper pivot motor 239. When the driving force of the crimper pivot motor 239 is transmitted to the crimper shaft 340 via the output gear 239*a* and the drive transmission gear 340*a*, the crimper 32' rotates in the forward and reverse directions on the base 48 about the crimper shaft 340 extending in the thickness direction of the sheet P placed on the internal tray 22. The guide rail 337, the crimper movement motor 238, the crimper pivot motor 239, the crimper shaft 340, and the drive transmission assembly 240 constitute at least part of a driving assembly of the crimper 32' according to the present embodiment.

The crimper 32' is movable between a standby position HP2 illustrated in FIG. 26A and a position where the crimper 32' faces the first binding position B1 illustrated in FIGS. 26B and 26C. The standby position HP2 is away in the main scanning direction from the sheet bundle Pb placed on the internal tray 22. For example, in FIGS. 26A, 26B, and 26C, the standby position HP is distanced to the right of the sheet bundle Pb along the main scanning direction. The first binding position B1 is a position on the sheet bundle Pb placed on the internal tray 22. However, the specific position of the first binding position B1 is not limited to the position illustrated in FIGS. 26B and 26C. The first binding position B1 may be one or more positions along the main scanning direction at the downstream end, in the conveyance direction, of the sheet P.

The posture of the crimper 32' changes or is pivoted between a parallel binding posture illustrated in FIG. 26B and an oblique binding posture illustrated in FIG. 26C. In other words, the crimper 32' is rotatable in the forward and reverse directions about the crimper shaft 340. The parallel binding posture is a posture of the crimper 32' in which the longitudinal direction of the upper crimping teeth 32*a* and the lower crimping teeth 32*b* (in other words, a rectangular crimp binding trace) is along the main scanning direction. The oblique binding posture is a posture of the crimper 32' in which the longitudinal direction of the upper crimping teeth 32*a* and the lower crimping teeth 32*b* (i.e., the rectangular crimp binding trace) is inclined with respect to the main scanning direction.

The rotational angle, which is an angle of the upper crimping teeth 32*a* and the lower crimping teeth 32*b* with respect to the main scanning direction, in the oblique binding posture is not limited to the angle illustrated in FIG. 26C. The rotational angle in the oblique binding posture may be any angle provided that the upper crimping teeth 32*a* and the lower crimping teeth 32*b* face the sheet bundle Pb placed on the internal tray 22.

The post-processing apparatus 3A includes the liquid applier 131 and a hole punch 132. The liquid applier 131 and the hole punch 132 are disposed upstream from the internal tray 22 in the opposite conveyance direction. In addition, the liquid applier 131 and the hole punch 132 are disposed at different positions in the opposite conveyance direction to simultaneously face one sheet P that is conveyed by the conveyance roller pairs 10 to 19.

Figure 33:
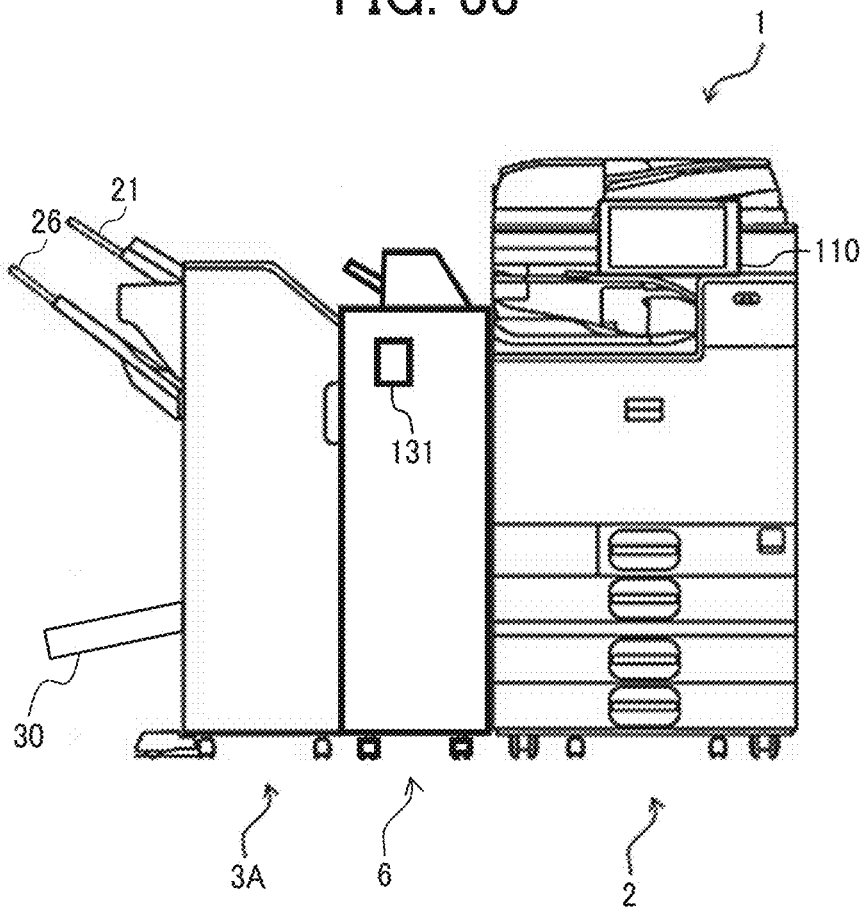
FIG. 33 is a diagram illustrating an overall configuration of an image forming system according to a modification of the embodiment illustrated in FIG. 1.

The liquid applier 131 and the hole punch 132 according to the present embodiment are disposed between the conveyance roller pairs 10 and 11. However, the arrangement of the liquid applier 131 is not limited to the example of FIG. 25. For example, in a case where an inserter 6 is disposed between the image forming apparatus 2 and the post-processing apparatus 3A as illustrated in FIG. 33, the liquid applier 131 may be disposed inside the inserter 6 located upstream from the post-processing apparatus 3A in a direction in which the sheet P is conveyed from the image forming apparatus 2 to the post-processing apparatus 3A. Examples of the inserter 6 include, but are not limited to, an apparatus that allows a pre-printed medium, which is to be conveyed to the post-processing apparatus 3A together with the sheet P conveyed from the image forming apparatus 2, to be fed as a cover sheet, an insertion sheet, or a partition sheet without passing through the image forming apparatus 2.

Figure 28A:
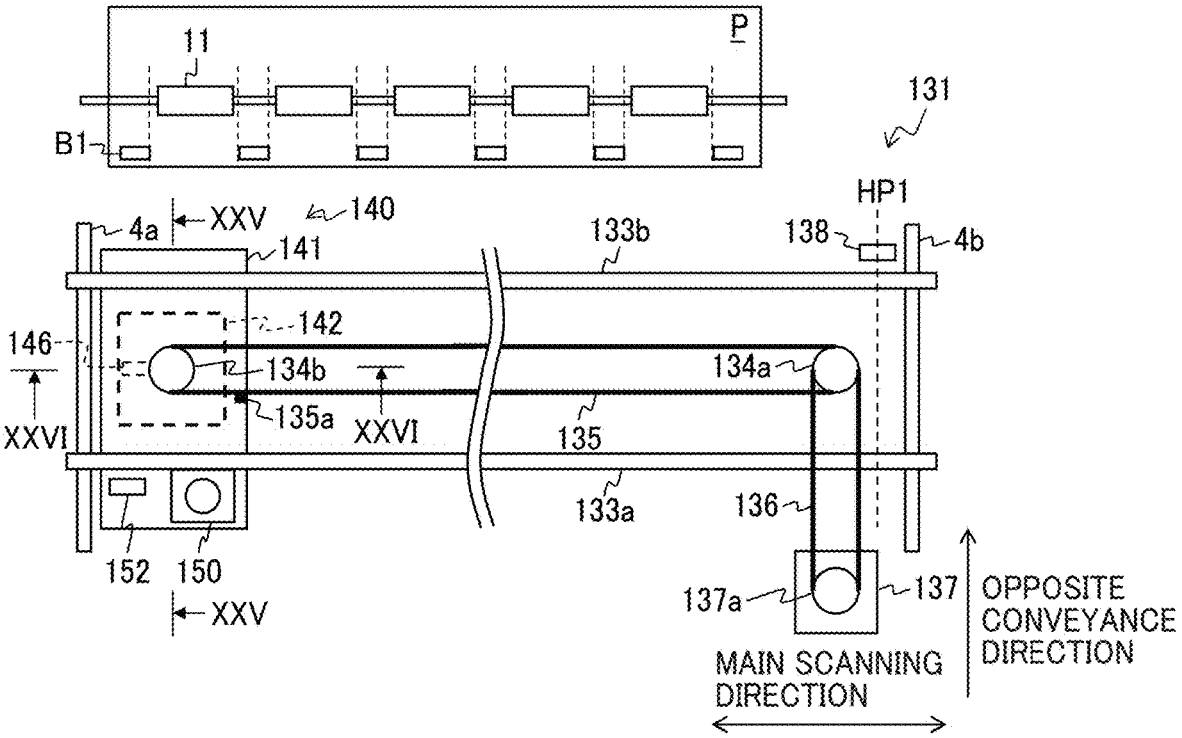
FIGS. 28A and 28B are diagrams illustrating a liquid applier of the post-processing apparatus according to another embodiment of the present disclosure, viewed from the thickness direction of a sheet.

As illustrated in FIG. 28A, the conveyance roller pair 11 is located so as not to overlap, in the main scanning direction, the first liquid application position B1 on the sheet P to which the liquid has been applied by a liquid application head 146 of the liquid applier 131. This arrangement is to prevent the amount of liquid at the first liquid application position B1 from decreasing due to the multiple roller pairs pressing the first liquid application position B1 when the conveyance roller pair 11 conveys the sheet P. As a result, when the sheet P reaches the crimper 32' disposed downstream from the liquid applier 131 in the opposite conveyance direction, the amount of liquid at the first liquid application position B1 is sufficient to maintain the binding strength. Accordingly, the binding strength of the sheet bundle Pb is prevented from decreasing due to a decrease in the amount of liquid at the first liquid application position B1 (corresponding to the first binding position B1) while the sheet P is conveyed.

In addition, the multiple roller pairs of the conveyance roller pair 11 that is located so as not to overlap the first liquid application position B1 on the sheet P in the main scanning direction prevents the conveying performance of the sheet P from being worse due to the adhesion of liquid to the multiple roller pairs and further prevents a conveyance jam caused by the worsened conveying performance of the sheet P.

Although only the conveyance roller pair 11 has been described above, the multiple roller pairs of the conveyance roller pairs 14 and 15 are preferably located so as not to overlap the first liquid application position B1 on the sheet P in the main scanning direction, like the multiple roller pairs of the conveyance roller pair 11.

The liquid applier 131 applies liquid to the sheet P that is conveyed by the conveyance roller pairs 10 and 11. In the following description, the application of liquid may be referred to as "liquid application." The hole punch 132 punches a hole in the sheet P that is conveyed by the conveyance roller pairs 10 and 11 such that the hole passes through the sheet P in the thickness direction of the sheet P. The processor disposed near the liquid applier 131 is not limited to the hole punch 132. Alternatively, the processor may be an inclination corrector that corrects an inclination or skew of the sheet P that is conveyed by the conveyance roller pairs 10 and 11.

Figure 28B:
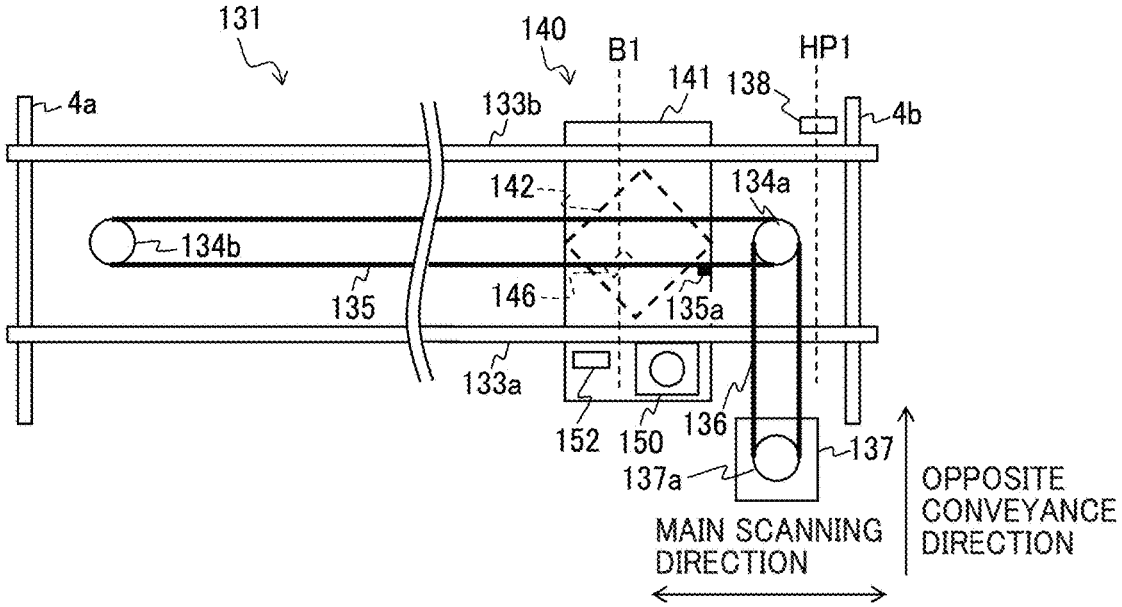

FIGS. 28A and 28B are schematic views of the liquid applier 131 in the thickness direction of the sheet P, according to another embodiment of the present disclosure.

Figure 29A:
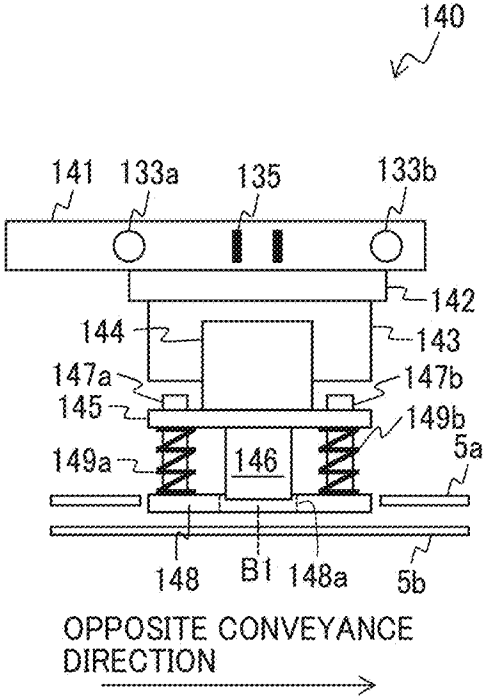
FIGS. 29A, 29B, and 29C are cross-sectional views of the liquid applier taken along a line XXV-XXV of FIG. 28A.
Figure 29B:
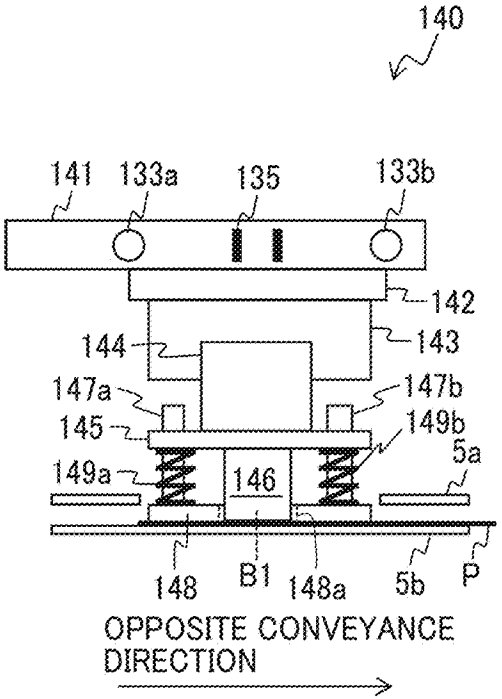
Figure 29C:
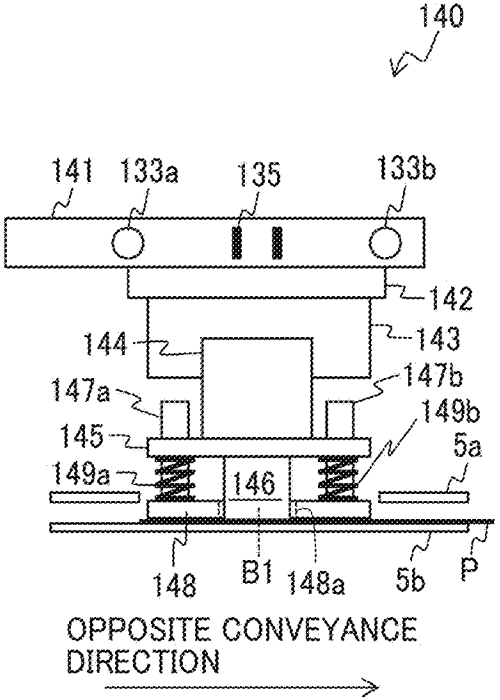

FIGS. 29A, 29B, and 29C are cross-sectional views of the liquid applier 131 taken along line XXV-XXV of FIG. 28A.

Figure 30A:
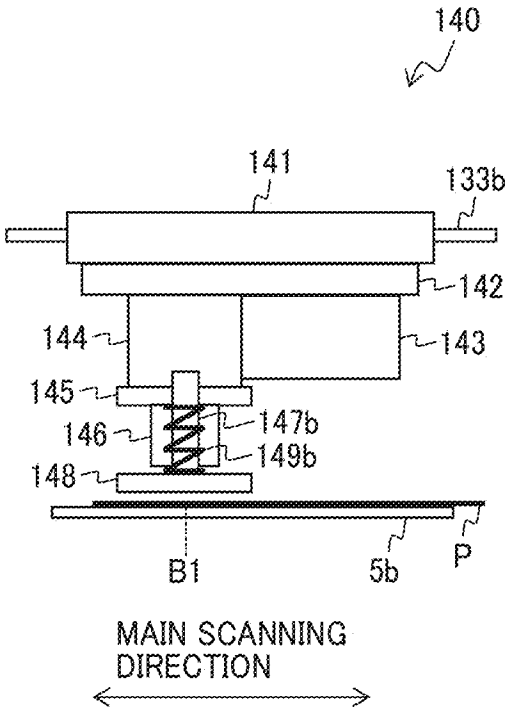
FIGS. 30A, 30B, and 30C are cross-sectional views of the liquid applier taken along a line XXVI-XXVI of FIG. 28A.
Figure 30B:
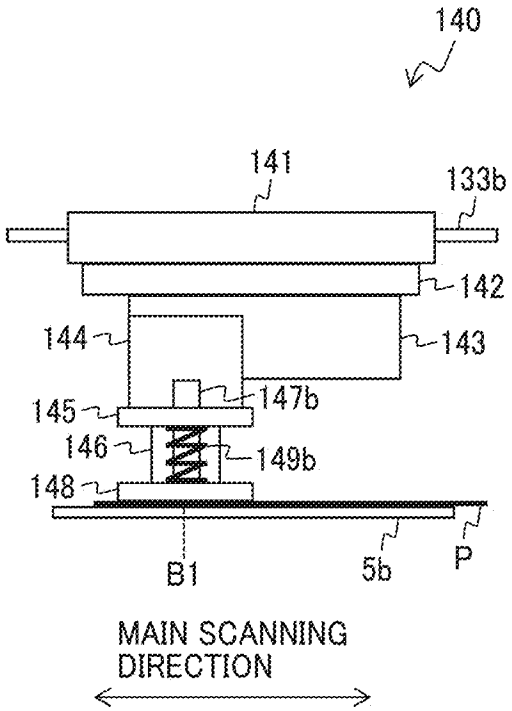
Figure 30C:
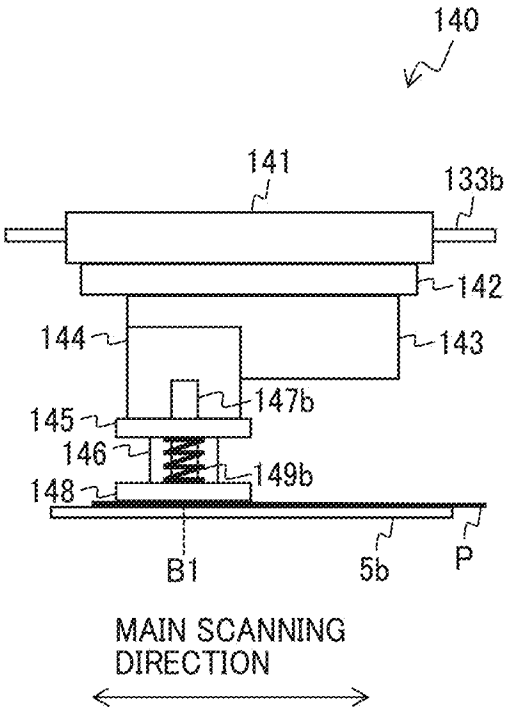

FIGS. 30A, 30B, and 30C are cross-sectional views of the liquid applier 131 taken along line XXVI-XXVI of FIG. 28A.

As illustrated in FIGS. 28A to 30C, the liquid applier 131 includes a pair of guide shafts 133*a* and 133*b*, a pair of pulleys 134*a* and 134*b*, endless annular belts 135 and 136, a liquid applier movement motor 137, a standby position sensor 138, and a liquid application unit 140.

The guide shafts 133*a* and 133*b*, each extending in the main scanning direction, are spaced apart from each other in the opposite conveyance direction. The pair of guide shafts 133*a* and 133*b* are supported by a pair of side plates 4*a* and 4*b* of the post-processing apparatus 3A. The pair of guide shafts 133*a* and 133*b* support the liquid application unit 140 such that the liquid application unit 140 can move in the main scanning direction.

The pair of pulleys 134*a* and 134*b* is disposed between the pair of guide shafts 133*a* and 133*b* in the opposite conveyance direction. The pair of pulleys 134*a* and 134*b* are spaced apart from each other in the main scanning direction. The pair of pulleys 134*a* and 134*b* are supported by a frame of the post-processing apparatus 3A so as to be rotatable in the forward and reverse directions about the respective shafts extending in the thickness direction of the sheet P.

The endless annular belt 135 is looped around the pair of pulleys 134*a* and 134*b*. The endless annular belt 135 is coupled to the liquid application unit 140 by a coupling portion 135*a*. The endless annular belt 136 is entrained around the pulley 134*a* and a driving pulley 137*a* that is fixed to an output shaft of the liquid applier movement motor 137. The liquid applier movement motor 137 generates a driving force to move the liquid application unit 140 in the main scanning direction.

As the liquid applier movement motor 137 rotates, the endless annular belt 136 circulates around the pulley 134*a* and the driving pulley 137*a* to rotate the pulley 134*a*. As the pulley 134*a* rotates, the endless annular belt 135 circulates around the pair of pulleys 134*a* and 134*b*. As a result, the liquid application unit 140 moves in the main scanning direction along the pair of guide shafts 133*a* and 133*b*. The liquid application unit 140 reciprocates in the main scanning direction in response to switching of the rotation direction of the liquid applier movement motor 137.

The standby position sensor 138 detects that the liquid application unit 140 has reached a standby position HP1 (see FIGS. 28A and 28B) in the main scanning direction. The standby position sensor 138 then outputs a standby position signal indicating the detection result to the controller 100*b*, which will be described below with reference to FIG. 31. The standby position sensor 138 is, for example, an optical sensor including a light emitter and a light receiver. The liquid application unit 140 at the standby position blocks an optical path between the light emitter and the light receiver. The standby position sensor 138 outputs the standby position signal in response to the light output from the light emitter not being received by the light receiver. The specific configuration of the standby position sensor 138 is not limited to the configuration described above.

As illustrated in FIGS. 292A to 29C, the conveyance passage inside the post-processing apparatus 3A is defined by an upper guide plate 5*a* and a lower guide plate 5*b*, which are apart from each other in the thickness direction of the sheet P. The liquid application unit 140 is located to face an opening of the upper guide plate 5*a*. In other words, the liquid application unit 140 is disposed to face the conveyance passage (a position at which the liquid application unit 140 is to face the sheet P conveyed along the conveyance passage) through the opening of the upper guide plate 5*a*.

Figure 31:
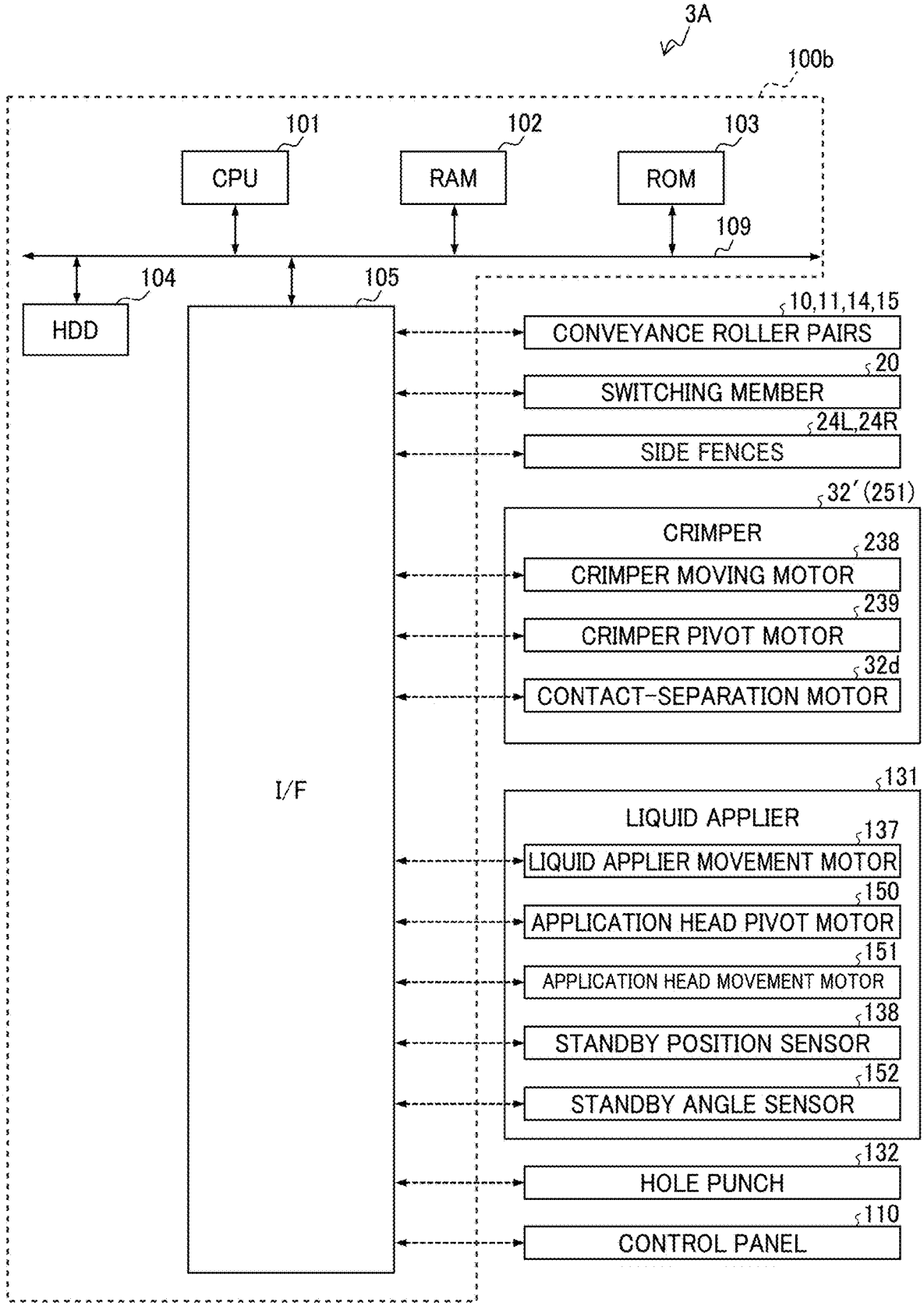
FIG. 31 is a control block diagram illustrating a hardware configuration of the post-processing apparatus according to another embodiment to control the operation of the post-processing apparatus.

As illustrated in FIGS. 28A to 30C, the liquid application unit 140 includes a base 141, a rotary bracket 142, a liquid storage tank 143, an application head mover 144, a holder 145, the liquid application head 146, columns 147*a* and 147*b*, a pressure plate 148, coil springs 149*a* and 149*b*, the application head pivot motor 150, the application head movement motor 151 (see FIG. 31), and a standby angle sensor 152 (see FIG. 31).

The base 141 is supported by the pair of guide shafts 133*a* and 133*b* so as to be slidable in the main scanning direction. The base 141 is coupled to the endless annular belt 135 by the coupling portion 135*a*. The base 141 supports the components of the liquid application unit 140 such as the rotary bracket 142, the liquid storage tank 143, the application head mover 144, the holder 145, the liquid application head 146, the columns 147*a* and 147*b*, the pressure plate 148, the coil springs 149*a* and 149*b*, the application head pivot motor 150, the application head movement motor 151, and the standby angle sensor 152.

The rotary bracket 142 is attached to the lower face of the base 141 so as to be rotatable in the forward and reverse directions about an axis extending in the thickness direction of the sheet P. The rotary bracket 142 is rotated with respect to the base 141 by a driving force transmitted from the application head pivot motor 150. The rotary bracket 142 retains the liquid storage tank 143, the application head mover 144, the holder 145, the liquid application head 146, the columns 147*a* and 147*b*, the pressure plate 148, and the coil springs 149*a* and 149*b*.

The standby angle sensor 152, which is also illustrated in FIG. 31, detects that the rotary bracket 142 has reached a standby angle. The standby angle sensor 152 then outputs a standby angle signal indicating the detection result to the controller 100*b*. The standby angle is, for example, an angle for the parallel binding. The standby angle sensor 152 is, for example, an optical sensor including a light emitter and a light receiver. The rotary bracket 142 at the standby angle blocks an optical path between the light emitter and the light receiver. The standby angle sensor 152 outputs the standby angle signal in response to the light output from the light emitter not being received by the light receiver. The specific configuration of the standby angle sensor 152 is not limited to the configuration described above.

FIG. 28A illustrates the rotary bracket 142 in a position for the parallel binding that is performed by the crimper 32' disposed downstream from the liquid applier 131 in a direction in which the sheet P is conveyed.

FIG. 28B illustrates the rotary bracket 142 in a position for the oblique binding (i.e., corner binding) that is performed by the crimper 32' disposed downstream from the liquid applier 131 in the direction in which the sheet P is conveyed.

The liquid storage tank 143 stores liquid to be applied to the sheet P. The application head mover 144 is attached by the liquid storage tank 143 so as to be movable (e.g., up and down) in the thickness direction of the sheet P. The application head mover 144 is moved with respect to the liquid storage tank 143 by a driving force transmitted from the application head movement motor 151. The holder 145 is attached to a lower end of the application head mover 144. The liquid application head 146 projects from the holder 145 toward the conveyance passage (downward in the present embodiment). The liquid that is stored in the liquid storage tank 143 is supplied to the liquid application head 146. The liquid application head 146 is made of a material having a relatively high liquid absorption (e.g., sponge or fiber).

The columns 147*a* and 147*b* project downward from the holder 145 around the liquid application head 146. The columns 147*a* and 147*b* are movable relative to the holder 145 in the thickness direction. The columns 147*a* and 147*b* have respective lower ends holding the pressure plate 148. The pressure plate 148 has a through hole 148*a* at a position where the through hole 148*a* faces the liquid application head 146. The coil springs 149*a* and 149*b* are fitted around the columns 147*a* and 147*b*, respectively, between the holder 145 and the pressure plate 148. The coil springs 149*a* and 149*b* bias the columns 147*a* and 147*b* and the pressure plate 148 in a direction away from the holder 145.

As illustrated in FIGS. 29A and 30A, before the sheet P is conveyed to the position where the sheet P faces the opening of the upper guide plate 5*a*, the pressure plate 148 is positioned at or above the opening. Subsequently, when the sheet P that is conveyed by the conveyance roller pairs 10 and 11 stops at a position where the first liquid application position B1 on the sheet P faces the opening, the application head movement motor 151 is rotated in a first direction. As a result, the application head mover 144, the holder 145, the liquid application head 146, the columns 147*a* and 147*b*, the pressure plate 148, and the coil springs 149*a* and 149*b* are moved down together to allow the pressure plate 148 to contact the sheet P. The first liquid application position B1 corresponds to the first binding position B1 to be crimped and bound by the edge binder 251, specifically, the crimper 32'.

As the application head movement motor 151 keeps rotating in the first direction after the pressure plate 148 contacts the sheet P, the coil springs 149*a* and 149*b* are compressed to further move down the application head mover 144, the holder 145, the liquid application head 146, and the columns 147*a* and 147*b*. As a result, as illustrated in FIGS. 29B and 30B, a lower face of the liquid application head 146 contacts the sheet P through the through hole 148*a*. As a result, the liquid contained in the liquid application head 146 is applied to the sheet P.

Further rotation of the application head movement motor 151 in the first direction further strongly presses the liquid application head 146 against the sheet P as illustrated in FIGS. 29C and 30C. Accordingly, the amount of liquid that is applied to the sheet P increases. In other words, the liquid applier 131 changes the pressing force of the liquid application head 146 against the sheet P to adjust the amount of liquid that is applied to the sheet P.

On the other hand, the rotation of the application head movement motor 151 in the second direction opposite to the first direction moves up the application head mover 144, the holder 145, the liquid application head 146, the columns 147*a* and 147*b*, the pressure plate 148, and the coil springs 149*a* and 149*b* together. As a result, as illustrated in FIGS. 29A and 30A, the liquid application head 146 and the pressure plate 148 are separated from the sheet P. In other words, the liquid applier 131 includes the liquid application head 146 that can be separated from the sheet P.

FIG. 31 is a block diagram illustrating a control block hardware configuration of the post-processing apparatus 3A to control the operation of the post-processing apparatus 3A according to another embodiment of the present disclosure.

As illustrated in FIG. 31, the post-processing apparatus 3A includes a central processing unit (CPU) 101, a random access memory (RAM) 102, a read only memory (ROM) 103, a hard disk drive (HDD) 104, and an interface (I/F) 105. The CPU 101, the RAM 102, the ROM 103, the HDD 104, and the I/F 105 are connected to each other via a common bus 109.

The CPU 101 is an arithmetic unit and controls the overall operation of the post-processing apparatus 3A.

The RAM 102 is a volatile storage medium that allows data to be read and written at high speed. The CPU 101 uses the RAM 102 as a work area for data processing.

The ROM 103 is a read-only non-volatile storage medium that stores programs such as firmware. The HDD 104 is a non-volatile storage medium that allows data to be read and written and has a relatively large storage capacity.

The HDD 104 stores, e.g., an operating system (OS), various control programs, and application programs.

By an arithmetic function of the CPU 101, the post-processing apparatus 3A processes, for example, a control program stored in the ROM 103 and an information processing program (application program) loaded into the RAM 102 from a storage medium such as the HDD 104. Such processing configures a software controller including various functional modules of the post-processing apparatus 3A. The software controller thus configured cooperates with hardware resources of the post-processing apparatus 3A to construct functional blocks that implement functions of the post-processing apparatus 3A. In other words, the CPU 101, the RAM 102, the ROM 103, the HDD 104, and the I/F 105 constitute at least part of a controller 100*b* serving as a control device that controls the operation of the post-processing apparatus 3A.

The I/F 105 is an interface that connects the conveyance roller pairs 10, 11, 14, and 15, the switching member 20, the side fences 24L and 24R, the crimper movement motor 238, the crimper pivot motor 239, a contact-separation motor 32*d*, a liquid applier movement motor 137, an application head pivot motor 150, an application head movement motor 151, a standby position sensor 138, a standby angle sensor 152, a hole punch 132, and a control panel 110 to the common bus 109.

The controller 100*b* controls, via the I/F 105, the operations of the conveyance roller pairs 10, 11, 14, and 15, the switching member 20, the side fences 24L and 24R, the crimper movement motor 238, the crimper pivot motor 239, the contact-separation motor 32*d*, the liquid applier movement motor 137, the application head pivot motor 150, the application head movement motor 151, and the hole punch 132. The controller 100*b* acquires detection results from the standby position sensor 138 and the standby angle sensor 152 through the I/F 105.

Although FIG. 31 illustrates the components of the liquid applier 131 and the edge binder 251 (the crimper 32') that executes the edge binding, the components of the saddle binder 28 that executes the saddle binding are controlled by the controller 100*b* like the components of the liquid applier 131 and the edge binder 251 (the crimper 32') that executes the edge binding.

As illustrated in FIG. 33, the image forming apparatus 2 includes the control panel 110. The control panel 110 includes an operation device that receives instructions input by an operator and a display serving as a notifier that notifies the operator of information. The control panel includes, for example, physical input buttons and a touch screen overlaid on a display. The control panel 110 acquires information from the user through the operation unit and provides the information to the user through the display. The post-processing apparatus 3A may include a control panel 110 similar to the above-described control panel 110 of the image forming apparatus 2.

Figure 32:
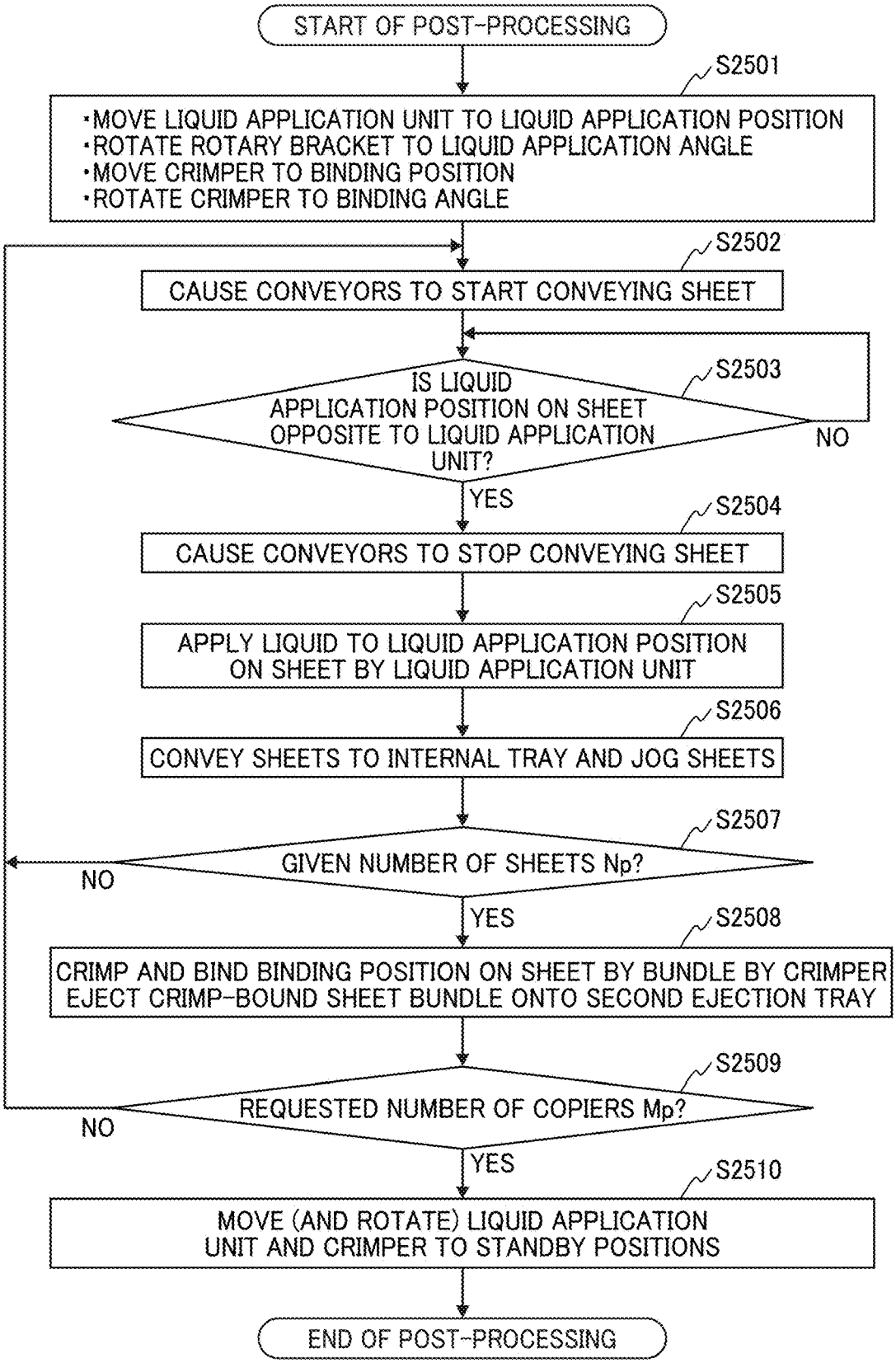
FIG. 32 is a flowchart of post-processing performed by the post-processing apparatus according to another embodiment of the present disclosure.

FIG. 32 is a flowchart of the post-processing process performed by the post-processing apparatus 3A according to another embodiment of the present disclosure. Specifically, FIG. 32 is a flowchart of a process to execute the one-point binding illustrated in FIGS. 26A to 26D.

For example, the controller 100*b* executes the post-processing illustrated in FIG. 32 when the controller 100*b* acquires an instruction to execute the post-processing from the image forming apparatus 2. In the following description, the instruction to execute the post-processing may be referred to as a "post-processing command." The post-processing command includes, for example, the number of sheets P of the sheet bundle Pb (referred to as "given number of sheets Np"), the number of sheet bundles Pb to be subjected to binding processing, the first binding position B1 (corresponding to the first liquid application position B1), the angle of the first binding position B1 (corresponding to the angle of the first liquid application position B1), the type of binding process (parallel binding process or oblique binding process), and a process that is executed in parallel with the liquid application process (i.e., punching a hole in the present embodiment). In the following description, the number of sheets P of the sheet bundle Pb may be referred to as a "given number of sheets Np," and the number of sheet bundles Pb to be subjected to binding processing may be referred to as "requested number of copies Mp." At the start of the post-processing, the liquid application unit 140 is at the standby position HP1 illustrated in FIGS. 28A to 28C, and the rotary bracket 142 is held at the standby angle (corresponding to the parallel binding posture) at the standby position HP1.

First, the controller 100*b* drives the liquid applier movement motor 137 to move the liquid application unit 140 (corresponding to a liquid applier) in the main scanning direction such that a liquid application head 146 moves from the standby position HP1 to a position where the liquid application head 146 can face the first liquid application position B1 (see FIG. 28B) corresponding to the first binding position B1 illustrated in FIG. 26. If the type of the binding process instructed by the post-processing command is "oblique binding process," the controller 100*b* drives the application head pivot motor 150 to rotate the rotary bracket 142. Thus, the liquid application head 146 is rotated from the standby angle to the liquid application angle corresponding to the "oblique binding posture" (step S2501). It is ascertained, based on a pulse signal output from a rotary encoder of the liquid applier movement motor 137, that the liquid application head 146 has reached the position where the liquid application head 146 can face the first liquid application position B1. Similarly, it is ascertained, based on a pulse signal output from a rotary encoder of the application head pivot motor 150, that the liquid application head 146 has reached the liquid application angle. If the type of the binding process instructed by the post-processing command is "parallel binding process", the controller 100*b* omits the above-described operation of rotating the rotary bracket 142. In other words, the liquid application unit 140 moves in the main scanning direction while holding the rotary bracket 142 at the standby angle.

Further, the controller 100*b* drives the crimper movement motor 238 to move the crimper 32' from the standby position HP2 to the position where the crimper 32' can face the first binding position B1 as illustrated in FIGS. 26A and 26B (step S2501). Alternatively, if the type of the binding process instructed by the post-processing command is "oblique binding process," the controller 100*b* drives the crimper pivot motor 239 to rotate the crimper 32' from the standby angle to the crimping angle corresponding to the "oblique binding posture" (step S2501). It is ascertained, based on a pulse signal output from a rotary encoder of the crimper movement motor 238, that the crimper 32' has reached the position where the crimper 32' can face the first binding position B1. Similarly, it is ascertained, based on a pulse signal output from a rotary encoder of the crimper pivot motor 239, that the crimper 32' has reached the crimping angle.

If the type of the binding process instructed by the post-processing command is "parallel binding process," the controller 100*b* omits the above-described operation of rotating the crimper 32'. In other words, the crimper 32' moves in the main scanning direction while maintaining the standby angle.

Subsequently, the controller 100*b* drives the conveyance roller pairs 10 and 11 to start conveying the sheet P on which an image is formed by the image forming apparatus 2 (step S2502). The controller 100*b* determines whether the first liquid application position B1 on the sheet P faces first the liquid application unit 140 (more specifically, the liquid application head 146) (step S2503). In other words, the controller 100*b* determines whether the liquid application unit 140 has faced the first liquid application position B1 on the sheet P. When the first liquid application position B1 on the sheet P has not faced the liquid application unit 140 (NO in step S2503), the controller 100*b* repeats the processing in step S2503. In other words, the controller 100*b* continues driving the conveyance roller pairs 10 and 11 until the first liquid application position B1 on the sheet P faces the liquid application head 146 (YES in step S2503). When the first liquid application position B1 on the sheet P has faced the liquid application head 146 (YES in step S2503), the controller 100*b* causes the first liquid application position B1 to stop the conveyance roller pairs 10 and 11 (step S2504). It is ascertained, based on a pulse signal output from a rotary encoder of a motor that drives the conveyance roller pairs 10 and 11, that the first liquid application position B1 on the sheet P has faced the liquid application head 146.

The controller 100*b* causes the liquid application unit 140 to execute the process of applying liquid to the first liquid application position B1 on the sheet P (step S2505). More specifically, the controller 100*b* rotates the application head movement motor 151 in the first direction to bring the liquid application head 146 into contact with the first liquid application position B1 on the sheet P. The controller 100*b* changes the pressing force of the liquid application head 146 (i.e., the amount of rotation or rotation speed of the application head movement motor 151) depending on the amount of liquid to be applied to the sheet P.

The amount of liquid that is applied to the sheet P may be the same for all the sheets P of the sheet bundle Pb or may be different for each sheet P. For example, the controller 100*b* may decrease the amount of liquid applied to a sheet P conveyed later. The amount of rotation of the application head movement motor 151 may be ascertained based on a pulse signal outputted from a rotary encoder of the application head movement motor 151.

The controller 100*b* drives the conveyance roller pairs 10, 11, 14, and 15 to place a sheet P on the internal tray 22 (step S2506). The controller 100*b* moves the side fences 24L and 24R to align the position of the sheet P or the sheet bundle Pb placed on the internal tray 22 in the main scanning direction (step S2506). In short, the controller 100*b* performs so-called jogging.

The controller 100*b* determines whether the number of sheets P placed on the internal tray 22 has reached the given number of sheets Np indicated by the post-processing command (step S2507). When the controller 100*b* determines that the number of sheets P placed on the internal tray 22 has not reached the given number of sheets Np (NO in step S2507), the controller 100*b* executes the operations of steps S2502 to S2507 again until the number of sheets P placed on the internal tray 22 reaches the given number of sheets Np (YES in step S2507).

By contrast, when the controller 100*b* determines that the number of sheets P that are placed on the internal tray 22 has reached the given number of sheets Np (YES in step S2507), the controller 100*b* causes the crimper 32' to crimp the binding position B1 (corresponding to the first liquid application position B1) on the sheet bundle Pb to which the liquid has been applied by the liquid application unit 140 (step S2508). In addition, the controller 100*b* rotates the conveyance roller pair 15 to eject the crimped sheet bundle Pb to the second ejection tray 26 (step S2508).

The controller 100*b* determines whether the number of sheet bundles Pb thus ejected to the second ejection tray 26 has reached the requested number of copies Mp indicated by the post-processing command (step S2509). When the controller 100*b* determines that the number of the sheet bundles Pb ejected to the second ejection tray 26 has not reached the requested number of copies Mp (NO in step S2509), the controller 100*b* repeats the processing of steps S2502 to S2509 until the number of the sheet bundles Pb ejected to the second ejection tray 26 reaches the requested number of copies Mp (YES in step S2509).

When the controller 100*b* determines that the number of sheet bundles Pb ejected to the second ejection tray 26 reaches the requested number of copies Mp (YES in step S2509), the controller 100*b* drives the liquid applier movement motor 137 to move the liquid application unit 140 to the standby position HP1 (see FIG. 28) and drives the crimper movement motor 238 to move the crimper 32' to the standby position HP2 (see FIG. 26) (step S2510). When the posture that is instructed by the post-processing command is the "oblique binding posture," the controller 100*b* drives the application head pivot motor 150 and the crimper pivot motor 239 to rotate the liquid application unit 140 and crimper 32' and the parallel binding posture (standby angle) into the parallel binding posture (step S2510). By contrast, when the posture that is instructed by the post-processing command is the "parallel binding posture," the controller 100*b* skips the aforementioned operation of rotating the liquid application unit 140 and the crimper 32' to the parallel binding posture (standby angle). In steps S2501 and S2510, the execution order of the movement in the main scanning direction and the rotation in the forward and reverse directions of the liquid application unit 140 and the crimper 32' is not limited to the aforementioned order and may be reversed.

The embodiments of the present disclosure are applied to the edge binder 25 that executes the edge binding as described above. However, the embodiments of the present disclosure may be applied to the saddle binder 28 that executes the saddle binding.

The controller 100*b* of the post-processing apparatus 3A according to the second embodiment illustrated in FIG. 25 is provided separately from the controller 100*a* of the image forming apparatus 2 as in the configuration of FIG. 1. However, embodiments of the present disclosure are not limited to the above-described configuration. For example, as illustrated in FIG. 34A, the controller 100*b* of the post-processing apparatus 3A may be disposed in the image forming apparatus 2. Further, as in the configuration of FIG. 34B, the controller 100*b* of the post-processing apparatus 3A may be integrated with the controller 100*a* of the image forming apparatus 2.

As in the configuration of FIG. 35A, the controller 100*b* of the post-processing apparatus 3A may be divided into a controller 100*b*1 (e.g., a driver system such as a motor) and a controller 100*b*2 (a detector such as a sensor) according to the function, and the controller 100*b*2 of the post-processing apparatus 3A may be disposed in the image forming apparatus 2. Further, as in the configuration of FIG. 35B, the controller 100*b*2 of the post-processing apparatus 3A disposed in the image forming apparatus 2 may be integrated with the controller 100*a* of the image forming apparatus 2.

As described above, the control method by the controller 100*b* described above is implemented by cooperation between hardware resources of a computer and a program as computer software. In other words, the control method may be executed by causing an arithmetic device, a storage device, an input device, an output device, and a control device to operate in cooperation with each other based on a program. In addition, the program may be written in, for example, a storage device or a storage medium and distributed, or may be distributed through, for example, an electric communication line.

Embodiments of the present disclosure are not limited to the above-described embodiments, and numerous additional modifications and variations are possible in light of the teachings within the technical scope of the appended claims. It is therefore to be understood that the above-described embodiments of the present disclosure may be practiced otherwise by those skilled in the art than as specifically described herein. Such embodiments and variations thereof are included in the scope and gist of the embodiments of the present disclosure and are included in the embodiments described in claims and the equivalent scope thereof.

A description is now given below of several aspects of the present disclosure.

Aspect 1

In Aspect 1, a medium processing apparatus (for example, the post-processing apparatus 3) includes a liquid applier (for example, the liquid applier 31), a binder (for example, the crimper 32), a mover (for example, the application head mover 144), a binder rotator (for example, the crimper pivot assembly 52), a liquid applier rotator (for example, the liquid applier pivot assembly 126), and a collision avoidance assembly (for example, the collision avoidance assembly 90). The liquid applier applies liquid to a part of at least one medium (for example, the sheet P). The binder is disposed adjacent to the liquid applier in a main scanning direction orthogonal to a conveyance direction of the at least one medium to perform a given process on a bundle of media (for example, the sheet bundle Pb) including the at least one medium on which the liquid is applied by the liquid applier. The mover causes the liquid applier and the binder to move in the main scanning direction along a surface of the at least one medium. The binder rotator rotates the binder about a binder shaft (for example, the crimper shaft 54) orthogonal to the conveyance direction and the main scanning direction to change a posture of the binder between an inclined binding posture in which a longitudinal direction of the binder is inclined to the main scanning direction and a parallel binding posture in which the longitudinal direction of the binder is the main scanning direction. The liquid applier rotator rotates the liquid applier about a liquid applier shaft (for example, the liquid applier shaft 53) disposed parallel to the binder shaft to change a posture of the liquid applier between an inclined application posture in which a longitudinal direction of the liquid applier is inclined to the main scanning direction and a parallel application posture in which the longitudinal direction of the liquid applier is the main scanning direction, contacts the liquid applier moving to a first side in the main scanning direction at a posture changing position (for example, the posture changing position D) to change the posture of the liquid applier from the inclined application posture to the parallel application posture, and contacts the liquid applier moving to a second side that is opposite to the first side in the main scanning direction at the posture changing position to change the posture of the liquid applier from the parallel application posture to the inclined application posture. The collision avoidance assembly to, when the liquid applier and the binder move to the second side in the main scanning direction, allow a passing of the binder in the inclined binding posture by a restriction position (for example, the restriction position E) at which the binder reaches before the liquid applier reaches the posture changing position, and avoid the passing of the binder in the parallel binding posture by the restriction position.

Aspect 2

In Aspect 2, in the medium processing apparatus (for example, the post-processing apparatus 3) according to Aspect 1, the collision avoidance assembly includes a restriction member (for example, the restriction member 91) and a contact member (for example, the contact member 92). The restriction member moves with the binder (for example, the crimper 32). The contact member is disposed at the restriction position to cause the binder in the inclined binding posture not to contact the restriction member and the binder in the parallel binding posture to contact the restriction member when the binder is moved to the second side in the main scanning direction.

Aspect 3

In Aspect 3, in the medium processing apparatus (for example, the post-processing apparatus 3) according to claim 2, the contact member (for example, the contact member 92) is movable in the conveyance direction of the medium (for example, the sheet P) between a contact position at which the binder (for example, the crimper 32) overlaps with a trajectory of movement of the restriction member (for example, the restriction member 91) when the binder is in the parallel binding posture and a retracted position deviated toward the conveyance direction of the medium from the trajectory of movement of the restriction member, the collision avoidance assembly (for example, the collision avoidance assembly 90) includes a biasing member (for example, the coil spring 93) to bias the contact member toward the contact position. The restriction member causes the contact member to move from the contact position to the retracted position against a biasing force of the biasing member to allow the passing of the binder in the parallel binding posture by the restriction position, when the binder in the parallel binding posture is moved to the first side in the main scanning direction, and the binder in the parallel binding posture to contact the contact member at the contact position to allow the passing of the binder in the parallel binding posture by the restriction position when the binder in the parallel binding posture is moved to the second side in the main scanning direction.

Aspect 4

In Aspect 4, in the medium processing apparatus (for example, the post-processing apparatus 3) according to Aspect 2 or 3 further includes circuitry (for example, the controller 100*b*) to control the mover and the binder rotator. The circuitry is to cause the liquid applier (for example, the liquid applier 31) and the binder (for example, the crimper 32) move to the second side in the main scanning direction until the restriction member (for example, the restriction member 91) contacts the contact member (for example, the contact member 92) when the circuitry determines that the liquid applier and the binder are moved by a force different from a driving force of the mover, cause the liquid applier and the binder to move to the first side in the main scanning direction by an amount of movement given in advance in response to a contact of the restriction member to the contact member and change the posture of the binder from the parallel binding posture to the inclined binding posture, and cause the liquid applier and the binder to move to the second side in the main scanning direction from the restriction position to a standby position (for example, the standby position HP) on the second side in the main scanning direction.

Aspect 5

In Aspect 5, in the medium processing apparatus (for example, the post-processing apparatus 3) according to any one of Aspects 2 to 4, the restriction member (for example, the restriction member 91) is attached to an upstream end of the binder (for example, the crimper 32) in the conveyance direction of the medium (for example, the sheet P).

Aspect 6

In Aspect 6, in the medium processing apparatus (for example, the post-processing apparatus 3) according to any one of Aspects 2 to 5, the contact member (for example, the contact member 92) is attached to a support (for example, the posture changing lever 111) to movably support the liquid applier (for example, the liquid applier 31) and the binder (for example, the crimper 32).

Aspect 7

In Aspect 7, in the medium processing apparatus (for example, the post-processing apparatus 3) according to any one of Aspects 1 to 6, the binder (for example, the crimper 32) binds the bundle of media (for example, the sheet bundle Pb) by pressing and deforming a part of the bundle of media.

Aspect 8

In Aspect 8, in the medium processing apparatus (for example, the post-processing apparatus 3) according to any one of Aspects 1 to 6, the binder (for example, the crimper 32) binds the bundle of media (for example, the sheet bundle Pb) by penetrating a staple through a part of the bundle of media.

Aspect 9

In Aspect 9, an image forming system (for example, the image forming system 1) includes an image forming apparatus (for example, an image forming apparatus 2) and the medium processing apparatus (for example, the post-processing apparatus 3) according to any one of Aspects 1 to 8. The image forming apparatus forms an image on a medium (for example, the sheet P). The medium processing apparatus performs the process on a bundle of media (for example, the sheet bundle Pb) including the medium on which the image is formed by the image forming apparatus.

Aspect 10

In Aspect 10, a medium processing apparatus (for example, the post-processing apparatus 3) includes a liquid applier (for example, the liquid applier 31), a binder (for example, the crimper 32), a mover (for example, the application head mover 144), a first rotator (for example, the crimper pivot assembly 52), and a second rotator (for example, the liquid applier pivot assembly 126). The liquid applier applies liquid to a part of at least one medium (for example, the sheet P) conveyed in a conveyance direction. The binder is disposed adjacent to the liquid applier in a main scanning direction orthogonal to the conveyance direction to perform a given process on a bundle of media (for example, the sheet bundle Pb) including the at least one medium on which the liquid is applied by the liquid applier. The mover causes the liquid applier and the binder to move between a first side and a second side in the main scanning direction along a surface of the at least one medium. The first rotator rotates the binder about a first shaft (for example, the crimper shaft 54) to change a posture of the binder between a first inclined posture in which a lateral direction of the binder is inclined to the main scanning direction and a first parallel posture in which the lateral direction of the binder is parallel to the main scanning direction. The second rotator rotates the liquid applier about a second shaft (for example, the liquid applier shaft 53) to change a posture of the liquid applier between a second inclined posture in which a lateral direction of the liquid applier is inclined to the main scanning direction and a second parallel posture in which the lateral direction of the liquid applier is parallel to the main scanning direction. The second rotator includes a posture change assembly (for example, the posture changing member 114, the guide rail 115, the biasing spring 117, the posture changing member stopper 118) and a collision avoidance assembly (for example, the collision avoidance assembly 90). The posture change assembly changes the posture of the liquid applier from the second inclined posture to the second parallel posture at a posture changing position (for example, the posture changing position D) when the liquid applier moves toward the first side in the main scanning direction, and the posture of the liquid applier from the second parallel posture to the second inclined posture at the posture changing position when the liquid applier moves toward the second side. The collision avoidance assembly allows the binder in the first inclined posture to pass a restriction position (for example, the restriction position E), and restrict the binder in the first parallel posture from passing through the restriction position. The binder reaches the restriction position before the liquid applier reaches the posture changing position.

Aspect 11

In Aspect 11, in the medium processing apparatus (for example, the post-processing apparatus 3) according to Aspect 10, the collision avoidance assembly includes a restrictor (for example, the restriction member 91) and a contact (for example, the contact member 92). The restrictor moves with the binder (for example, the crimper 32). The contact is disposed at the restriction position to cause the binder in the first inclined posture to pass through the restrictor, and cause the binder in the first parallel posture to contact the restrictor to restrict a movement of the binder, in response to the movement of the binder from the first side toward the second side in the main scanning direction.

Aspect 12

In Aspect 12, in the medium processing apparatus (for example, the post-processing apparatus 3) according to Aspect 11, the contact (for example, the contact member 92) is movable in the conveyance direction between a contact position at which the restrictor of the binder (for example, the crimper 32) in the first parallel posture contacts the contact and a retracted position at which the restrictor of the binder in the first parallel posture does not contact the contact. The collision avoidance assembly (for example, the collision avoidance assembly 90) further includes a biasing member (for example, the coil spring 93) to bias the contact toward the contact position. The contact moves from the contact position to the retracted position against a biasing force of the biasing member to allow the binder in the first parallel posture to pass through the restriction position in response to a movement of the binder from the second side toward the first side in the main scanning direction. The contact at the contact position contacts the restrictor of the binder in the first parallel posture to restrict the binder in the first parallel posture from passing through the restriction position in response to a movement of the binder from the first side toward the second side in the main scanning direction.

Aspect 13

In Aspect 13, in the medium processing apparatus (for example, the post-processing apparatus 3) according to Aspect 11 or 12 further includes circuitry (for example, the controller 100*b*) to control the mover and the first rotator (for example, the crimper pivot assembly 52). The circuitry is to determine whether the liquid applier (for example, the liquid applier 31) and the binder (for example, the crimper 32) are moved by a force different from a driving force of the mover (for example, the application head mover 144), cause the liquid applier and the binder to move toward the second side in the main scanning direction until the restrictor (for example, the restriction member 91) contacts the contact (for example, the contact member 92) when the circuitry determines that the liquid applier and the binder are moved by the force different from the driving force of the mover, cause the liquid applier and the binder to move toward the first side in the main scanning direction by a predetermined amount in response to the restrictor contacting the contact, change the posture of the binder from the first parallel posture to the first inclined posture, and cause the liquid applier and the binder to move to a standby position (for example, the standby position HP) at the second side of the restriction position in the main scanning direction in response to a posture change of the binder from the first parallel posture to the first inclined posture.

Aspect 14

In Aspect 14, in the medium processing apparatus (for example, the post-processing apparatus 3) according to any one of Aspects 11 to 13, the restrictor (for example, the restriction member 91) is attached to an upstream end of the binder (for example, the crimper 32) in the conveyance direction.

Aspect 15

In Aspect 15, in the medium processing apparatus (for example, the post-processing apparatus 3) according to any one of Aspects 11 to 14, the contact (for example, the contact member 92) is attached to a support (for example, the posture changing lever 111) to movably support the liquid applier (for example, the liquid applier 31) and the binder (for example, the crimper 32).

Aspect 16

In Aspect 16, in the medium processing apparatus (for example, the post-processing apparatus 3) according to any one of Aspects 10 to 15, the binder (for example, the crimper 32) presses and deforms a part of the bundle of media (for example, the sheet bundle Pb) to bind the bundle of media.

Aspect 17

In Aspect 17, in the medium processing apparatus (for example, the post-processing apparatus 3) according to any one of Aspects 10 to 15, the binder (for example, the crimper 32) causes a staple to penetrate through a part of the bundle of media (for example, the sheet bundle Pb) to bind the bundle of media.

Aspect 18

In Aspect 18, an image forming system (for example, the image forming system 1) includes an image forming apparatus (for example, an image forming apparatus 2) and the medium processing apparatus (for example, the post-processing apparatus 3) according to any one of Aspects 10 to 17. The image forming apparatus forms an image on a medium (for example, the sheet P). The medium processing apparatus performs the given process on the bundle of media (for example, the sheet bundle Pb) including the medium on which the image is formed by the image forming apparatus.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A medium processing apparatus comprising:

a liquid applier to apply liquid to a part of at least one medium conveyed in a conveyance direction;

a binder adjacent to the liquid applier in a main scanning direction orthogonal to the conveyance direction to perform a given process on a bundle of media including the at least one medium on which the liquid is applied by the liquid applier;

a mover to cause the liquid applier and the binder to move between a first side and a second side in the main scanning direction along a surface of the at least one medium;

a first rotator to rotate the binder about a first shaft to change a posture of the binder between:

a first inclined posture in which a lateral direction of the binder is inclined to the main scanning direction; and a first parallel posture in which the lateral direction of the binder is parallel to the main scanning direction; and a second rotator to rotate the liquid applier about a second shaft to change a posture of the liquid applier between:

a second inclined posture in which a lateral direction of the liquid applier is inclined to the main scanning direction; and a second parallel posture in which the lateral direction of the liquid applier is parallel to the main scanning direction, wherein the second rotator includes:

a posture change assembly to:

change the posture of the liquid applier from the second inclined posture to the second parallel posture at a posture changing position when the liquid applier moves toward the first side in the main scanning direction; and change the posture of the liquid applier from the second parallel posture to the second inclined posture at the posture changing position when the liquid applier moves toward the second side; and a collision avoidance assembly to:

allow the binder in the first inclined posture to pass a restriction position; and restrict the binder in the first parallel posture from passing through the restriction position, and the binder reaches the restriction position before the liquid applier reaches the posture changing position.

2. The medium processing apparatus according to claim 1, wherein the collision avoidance assembly includes:

a restrictor moving with the binder; and a contact disposed at the restriction position to:

cause the binder in the first inclined posture to pass through the restrictor; and cause the binder in the first parallel posture to contact the restrictor to restrict a movement of the binder, in response to the movement of the binder from the first side toward the second side in the main scanning direction.

3. The medium processing apparatus according to claim 2, wherein the contact is movable in the conveyance direction between:

a contact position at which the restrictor of the binder in the first parallel posture contacts the contact; and a retracted position at which the restrictor of the binder in the first parallel posture does not contact the contact, the collision avoidance assembly further includes a biasing member to bias the contact toward the contact position, the contact moves from the contact position to the retracted position against a biasing force of the biasing member to allow the binder in the first parallel posture to pass through the restriction position, in response to a movement of the binder from the second side toward the first side in the main scanning direction, and the contact at the contact position contacts the restrictor of the binder in the first parallel posture to restrict the binder in the first parallel posture from passing through the restriction position, in response to a movement of the binder from the first side toward the second side in the main scanning direction.

4. The medium processing apparatus according to claim 2, further comprising circuitry to control the mover and the first rotator, wherein the circuitry is configured to:

determines whether the liquid applier and the binder are moved by a force different from a driving force of the mover;

cause the liquid applier and the binder to move toward the second side in the main scanning direction until the restrictor contacts the contact when the circuitry determines that the liquid applier and the binder are moved by the force different from the driving force of the mover;

cause the liquid applier and the binder to:

move toward the first side in the main scanning direction by a predetermined amount in response to the restrictor contacting the contact; and change a posture of the binder from the first parallel posture to the first inclined posture; and cause the liquid applier and the binder to move to a standby position at the second side of the restriction position in the main scanning direction, in response to a posture change of the binder from the first parallel posture to the first inclined posture.

5. The medium processing apparatus according to claim 2, wherein the restrictor is attached to an upstream end of the binder in the conveyance direction.

6. The medium processing apparatus according to claim 2, wherein the contact is attached to a support to movably support the liquid applier and the binder.

7. The medium processing apparatus according to claim 1, wherein the binder is configured to press and deform a part of the bundle of media to bind the bundle of media.

8. The medium processing apparatus according to claim 1, wherein the binder causes a staple to penetrate through a part of the bundle of media to bind the bundle of media.

9. An image forming system comprising:

an image forming apparatus to form an image on a medium; and the medium processing apparatus according to claim 1 to perform the given process on the bundle of media including the medium on which the image is formed by the image forming apparatus.

* * * * *